US005955691A

United States Patent [19]

Suzuki et al.

[11] Patent Number: 5,955,691

[45] Date of Patent: Sep. 21, 1999

[54] SOFTWARE SOUND SOURCE

[75] Inventors: Hideo Suzuki; Motoichi Tamura; Yoshimasa Isozaki; Hideyuki Masuda; Masahiro Shimizu, all of Hamamatsu, Japan

[73] Assignee: Yamaha Corporation, Hamamatsu, Japan

[21] Appl. No.: 08/904,327

[22] Filed: Jul. 31, 1997

[30] Foreign Application Priority Data

| | | | |
|---|---|---|---|
| Aug. 5, 1996 | [JP] | Japan | 8-221780 |
| Aug. 9, 1996 | [JP] | Japan | 8-227807 |
| Aug. 30, 1996 | [JP] | Japan | 8-246957 |

[51] Int. Cl.[6] ..... G10H 7/00

[52] U.S. Cl. ..... 84/604; 84/622

[58] Field of Search ..... 84/622, 659, 603, 84/604

[56] References Cited

U.S. PATENT DOCUMENTS

| | | | |
|---|---|---|---|
| 3,809,788 | 5/1974 | Deutsch . | |
| 4,573,390 | 3/1986 | Saito . | |
| 5,319,151 | 6/1994 | Shiba et al. . | |
| 5,376,752 | 12/1994 | Limberis et al. . | |
| 5,432,293 | 7/1995 | Nonaka et al. . | |
| 5,677,504 | 10/1997 | Kurata . | |
| 5,698,806 | 12/1997 | Yamada et al. | 84/622 X |
| 5,703,310 | 12/1997 | Kurakake et al. . | |
| 5,703,312 | 12/1997 | Takahashi et al. . | |

FOREIGN PATENT DOCUMENTS

| | | |
|---|---|---|
| 0 722 162 | 7/1996 | European Pat. Off. . |
| WO 80/01215 | 6/1980 | WIPO . |
| WO 96/18995 | 6/1996 | WIPO . |

*Primary Examiner*—Jeffrey W. Donels
*Attorney, Agent, or Firm*—Graham & James LLP

[57] ABSTRACT

A music apparatus uses a processing unit of a universal type having an extended instruction set used to carry out parallel computation steps in response to a single instruction which is successively issued when executing a program. A software module defines a plurality of channels and is composed of a synthesis program executed by the processing unit using the extended instruction set so as to carry out synthesis of waveforms of musical tones through the plurality of the channels. The plurality of the channels are optimally grouped into parallel sets each containing at least two channels. The synthesis of the waveforms of at least two channels belonging to each parallel set are carried out concurrently by the parallel computation steps. A buffer has a capacity sufficient to store the waveform samples allotted to one frame period. A cache has a capacity sufficient to store a subset of the waveform samples which is an integer division of the set allotted to one frame period. The synthesis program is executed by the processing unit at one frame period so as to carry out synthesis of a set of waveform samples allotted to one frame period while efficiently accessing the cache. Any designated subroutine programs are sequentially called in response to call instructions to process the waveform samples during the synthesis.

53 Claims, 28 Drawing Sheets

SOFTWARE SOUND SOURCE

BACKGROUND OF THE INVENTION

The present invention generally relates to a tone generating apparatus and a tone generating method for generating music tones by executing predetermined music generating software on a computer.

A tone generating apparatus is known in which music tones are generated by executing a predetermined music tone generating software on a general-purpose processor such as a CPU (Central Processing Unit). Such an apparatus is called a software sound source. Recently, as higher performance is required of this software sound source, so is higher speeds of music tone processing to meet this requirement.

Recently, CPUs have been proposed that have instructions each capable of executing a plurality of arithmetic operations concurrently. These CPUs include for example a CPU made by Intel Corporation that has an extended instruction set called MMX.

In the conventional parallel processing as applied to graphic processing, adjacent pixels each represented by one byte data (eight bits) are grouped and the processing operations for the plurality of grouped pixels are performed in parallel. When voice processing and tone generating processing are performed in parallel, a plurality of samples (each represented by 16-bit data) that continue one after another in time are grouped, and amplitude control and filter processing are performed on each group.

It is also possible to perform the above-mentioned processing by use of the above-mentioned CPU having an extended instruction set capable of executing a plurality of arithmetic operations by a single instruction in parallel. Referring to FIG. 5, there is shown a block diagram illustrating an algorithm for executing effect processing of a software sound source. Referring to FIG. 6A, there is shown a detailed circuit diagram illustrating an APn circuit of FIG. 5. Referring to FIG. 6B, there is shown a detailed circuit diagram illustrating a CFn circuit of FIG. 5. As shown in FIGS. 6A and 6B, there are sections in which two pieces of input data are multiplied by a predetermined coefficient and the resultant pieces of data are added together. These sections are (m4, m5, and a5) and (m6, m7, and a6) in FIG. 6A and (m9, m10, a7) in FIG. 6B, for example. The arithmetic operations in these sections can be executed with a single instruction if a CPU is used having an extended instruction set capable of multiplying two pieces of input data by a predetermined coefficient and adding the resultant data together, thereby realizing high-speed processing. Actually, however, such high-speed processing is only realized by well contriving computational operations in one processing algorithm. This inevitably leaves portions that cannot be completely processed in parallel, preventing the advantages of parallel processing from being fully used.

The processing of generating music tone waveforms includes processing for obtaining a current waveform sample from a past waveform sample during the course of address generation, envelope generation, and filtering. To be more specific, in address generation, a current address is obtained based on an address one sampling period before. In envelope generation, a current envelope value is obtained based on an immediately preceding envelope value. In filtering, a filter computation is performed based on values of a past waveform sample and a current input waveform sample to generate and output an output waveform sample. Thus, obtaining a current waveform sample from a past waveform sample makes it difficult to process in parallel the waveform samples adjacent to each other in terms of time.

A tone generating apparatus is known in which music tones are generated by executing a predetermined music tone generating software on a general-purpose processor such as a CPU. Such an apparatus is called a software sound source. Some software sound sources also use a software effector to provide effects such as reverberation on a generated music tone and output the effect-added tone. Recently, it is required to enhance the performance of software sound sources to provide a variety of effects.

A software sound source is provided with a buffer area for waveform generation to generate a plurality of samples collectively when synthesizing a music tone by software. FIG. 9B shows an example of a waveform generating buffer area. As shown in FIG. 9B, reference numerals 1, 2, . . . , 128 denote storage areas for 128 sets of waveform samples which are time-series data sequentially arranged in terms of time. One set of waveform sample storage area is composed of DryL, DryR, and Rev. DryL denotes a storage area for a waveform sample to which reverberation of the stereophonic left side is not attached. DryR denotes a storage area for a waveform sample to which reverberation of the stereophonic right side is not attached. Rev denotes a storage area for a waveform sample to which reverberation is attached. Namely, the waveform samples are held in an interleaved form with a combination of DryL, DryR, and Rev as one unit. This is because it is convenient for these effects to align the buffer in this order when writing output data of each channel in waveform computation.

For example, a software sound source generates waveform samples for one frame (128 samples) of all channels through which a music tone is generated for each frame, which is a predetermined time interval. The software sound source accumulates the generated waveform samples in a waveform generating buffer shown in FIG. 9B, and outputs waveform data. First, 128 samples of the first channel are generated and the generated samples are weighted such that values of DryL, DryR, and Rev of each sample are respectively multiplied with predetermined coefficients. The weighted samples are stored in the waveform generating buffer of FIG. 9B. Next, 128 samples of the second channel are generated, the generated samples are weighted, and the weighted samples are accumulated in the waveform generating buffer of FIG. 9B. Then, 128 samples of the third channel are generated, the generated samples are weighted, and the weighted samples are accumulated in the waveform generating buffer of FIG. 9B. These operations are repeated for all channels to vocalize musical tones. The generated waveform data is passed to a sound I/O device (an LSI called CODEC for executing input/output operations of music tone waveform data) by a DMAC (Direct Memory Access Controller) instructed so by the system. The sound I/O device performs digital-to-analog conversion on the received waveform data and vocalizes the converted data through a sound system.

The software sound source is required to provide a variety of effects. A problem is, however, that the sequence of computations (or the connecting relationship between effectors) for providing a plurality of effects cannot be altered dynamically.

Some processors used for the software sound source have an internal or external cache memory. However, a data structure of the waveform generating buffer as shown in FIG. 9B easily causes cache miss at waveform generation, especially, at computation by software effector. For example, in the example of FIG. 9B, the software effector for calculating reverberation performs computation by taking Rev of 128 samples intermittently stored in an interleaved manner, often resulting in cache miss. When the effect attached is reverberation alone, not so much overhead is caused. As the number of effects attached increases, however, the chance of cache miss especially increases. For example, if three types of effects (reverberation, chorus, and variation) are attached and there are seven output systems, the data structure of FIG. 9B is extended to DryL, DryR, Rev, ChorusL, ChorusR, VariationL, and VariationR, which are handled as one unit arranged for 128 samples in the waveform generating buffer. In this case, the effector executes computational processing in the following sequence:

(1) Computation for variation is executed by collecting VariationL and VariationR for 128 samples;

(2) Computation for chorus is executed by collecting ChorusL and ChorusR for 128 samples; and (3) Computation for reverberation is executed by collecting Rev for 128 samples.

Therefore, access must be frequently made to the data areas arranged intermittently in the waveform generating buffer, thereby increasing the chance of cache miss, and seriously lowering processing efficiency.

A conventional music apparatus is generally composed of a MIDI (Musical Instrument Digital Interface), a performance message section in which performance information is inputted from a keyboard or a sequencer, a sound source for generating music tone waveforms, and a central processing unit (CPU) for controlling the sound source according to the inputted performance information. The CPU executes sound source driver processing such as channel assignment and parameter conversion according to the inputted performance information. In addition, the CPU supplies a converted parameter and a sounding start command (note-on command) to an assigned channel in the sound source. The sound source generates music tone waveforms based on the supplied parameters. For the sound source, hardware such as an electronic circuit is used. The above-mentioned conventional setup inevitably makes the music tone generator dedicated to the music tone generation. Consequently, the generation of music tones requires to prepare a dedicated music tone generator. In generating music tones by a general-purpose processor such as a personal computer, a dedicated sound source is attached externally. Alternatively, an extended board having several IC chips such as a music tone generating chip for generating music tone waveforms, a waveform ROM for storing waveform data, and a coder/decoder (CODEC) composed of an A/D converter, a D/A converter, a FIFO buffer, and an interface circuit is connected to the personal computer for music tone generation.

Recently, a music tone generating module or a so-called software sound source has been proposed in which the operations of the above-mentioned hardware sound source are replaced by sound source processing based on a computer program and performance processing, and the sound source processing are executed by the CPU. The performance processing herein denotes processing equivalent to the above-mentioned sound source driver processing in which, based on the inputted information such as MIDI data, control information for controlling music tones is generated. The sound source processing herein denotes processing in which, based on the control information generated by the performance processing, music tone waveforms are synthesizes. According to this music tone generating module, only providing a D/A converting chip in addition to the CPU and software enables music tone generation without using a dedicated hardware music tone generator and a sound source board.

The software sound sources as mentioned above are classified into various types according to a method of simulating an acoustic musical instrument; for example, PCM sound sourcing, FM sound source, and physical model sound source. To synthesize music tones in any type of these sound sources, it is required to separately prepare a sound source processing program corresponding to each type. This gives rise to a problem of significantly increasing the storage capacity for storing the sound source processing programs and waveform data necessary for sound processing.

Another problem is that, since there is no standard data format for these sound sources, it is impossible to synthesize music tones by an algorithm in which the different sound sources such as mentioned above are integrated with each other.

SUMMARY OF THE INVENTION

It is therefore an object of the present invention to provide a music tone generating apparatus and a music tone generating method capable of performing waveform synthesis computations at speeds higher than before in a software sound source that is realized by a CPU capable of executing a plurality of operations with a single instruction.

It is another object of the present invention to provide a music tone generating apparatus and a music tone generating method capable of dynamically altering the sequence of effect attaching processing computations.

It is still another object of the present invention to provide a music tone generating apparatus and a music tone generating method in which cache miss hardly occurs at waveform generation, especially at effect attaching computation in a software sound source, thereby enhancing computational and processing efficiencies.

It is yet another object of the present invention to provide a music tone generating method that realizes a software sound source based on a plurality of sound synthesis methods with a relatively small storage capacity.

It is a further object of the present invention to provide a music tone generating method capable of synthesizing music tones by an algorithm in which a plurality of software sound sources are integrated with each other.

According to a first aspect of the invention, a music apparatus comprises a processing unit of a universal type having an extended instruction set used to carry out parallel computation steps in response to a single instruction which is successively issued when executing a program, a software module defining a plurality of channels and being composed of a synthesis program executed by the processing unit using the extended instruction set so as to carry out synthesis of waveforms of musical tones through the plurality of the channels such that the plurality of the channels are optimally grouped into parallel sets each containing at least two channels and such that the synthesis of the waveforms of at least two channels belonging to each parallel set are carried out concurrently by the parallel computation steps, a buffer memory for accumulatively storing the waveforms of the plurality of the channels, another software module composed of an effector program executed by the processing unit using the extended instruction set if the effector program contains parallel computation steps to apply an effect to the waveforms stored in the buffer memory, and a converter for converting the waveforms into the musical tones.

Preferably, the processing unit executes the synthesis program so as to carry out the synthesis of the waveforms, the synthesis including one type of the parallel computation steps treating a relatively great computation amount so that the plurality of the channels are optimally grouped into parallel sets each containing a relatively small number of channels, and another type of the parallel computation steps treating a relatively small computation amount so that the plurality of the channels are optimally grouped into parallel sets each containing a relatively great number of channels.

The inventive method of generating musical tones according to performance information through a plurality of channels by parallel computation steps, comprises successively providing performance information to command generation of musical tones, periodically providing a trigger signal at a relatively slow rate to define a frame period between successive trigger signals, periodically providing a sampling signal at a relatively fast rate such that a plurality of sampling signals occur within one frame period, carrying out continuous synthesis in response to each trigger signal to produce a sequence of waveform samples of the musical tones for each frame period according to the provided performance information, the continuous synthesis being carried out using the extended instruction set such that the plurality of the channels are optimally grouped into parallel sets each containing at least two channels so that the continuous synthesis of the waveform samples of at least two channels belonging to each parallel set are carried out concurrently by the parallel computation steps, and converting each of the waveform samples in response to each sampling signal into a corresponding analog signal to thereby generate the musical tones.

According to a second aspect of the invention, a music apparatus for generating musical tones by means of a software, comprises a processor that periodically works each frame period for executing the software to carry out synthesis of a set of waveform samples allotted to one frame period, a buffer having a capacity sufficient to store the waveform samples allotted to one frame period, the buffer being used as a working area by the processor for storing a temporary set of the waveform samples which are treated by the processor during the course of the synthesis and for storing a final set of the waveform samples which are obtained upon completion of the synthesis, a cache having a capacity sufficient to store a subset of the waveform samples which is an integer division of the set allotted to one frame period such that the capacity of the buffer is set to an integer multiple of the capacity of the cache, the cache being hit by the processor before the buffer is addressed by the processor so as to carry out the synthesis of each subset of the waveform samples more efficiently than that the buffer is otherwise addressed by the processor, and a converter that converts the final set of the waveform samples stored in the buffer into the musical tones.

Further, the inventive music apparatus using a processor to generate musical tones, comprises a synthesis module periodically executed by the processor at each frame period so as to carry out synthesis of a set of waveform samples allotted to one frame period, a plurality of buffers each having a capacity sufficient to store the set of the waveform samples allotted to the same frame period after the synthesis, a plurality of effector modules each being linked to a corresponding one of the buffers, each effector module being executed by the processor to carry out modification of the set of the waveform samples reserved in the corresponding buffer to create a different effect, a mixer module executed by the processor to carry out computation of one set of the waveform samples stored in one buffer with another set of the waveform samples stored in another buffer so as to mix different effects, a controller that provides an total effect algorithm for instructing the processor to execute the effector modules and the mixer module in a predetermined sequence to create a total effect which is desired mixture of the different effects, and that designates one of the buffers to store the set of the waveform samples after completion of the modification and the computation, and a converter for converting the set of the waveform samples stored in the designated buffer into the musical tones with the total effect.

Preferably, the mixer module is executed by the processor to carry out computation of adding one set of the waveform samples stored in one buffer to another set of the waveform samples stored in another buffer by a desired ratio so as to mix different effects, the set of the waveform samples being reserved in said another buffer after the computation.

Preferably, the mixer module is commonly utilized to carry out the computation between any pair of the buffers as specified by the total effect algorithm.

Preferably, the controller comprises an editor that edits the total effect algorithm to arrange the sequence by which the processor sequentially executes selected ones of the effector modules and the mixer module in a desired order to create the desired total effect.

Preferably, the inventive music apparatus further comprises a cache having a capacity sufficient to store a subset of the waveform samples which is an integer division of the set of the waveform samples allotted to one frame period such that the capacity of each buffer is set to an integer multiple of the capacity of the cache, the cache being hit by the processor before the buffer is addressed by the processor so as to carry out the synthesis of each subset of the waveform samples more efficiently than that each buffer is otherwise addressed by the processor.

The inventive method of generating musical tones according to performance information through a plurality of channels, comprises successively providing performance information to command generation of musical tones, periodically providing a trigger signal at a relatively slow rate to define a frame period between successive trigger signals, periodically providing a sampling signal at a relatively fast rate such that a plurality of sampling signals occur within one frame period, carrying out continuous synthesis in response to one trigger signal to produce a set of waveform samples of the musical tones through the plurality of channels for one frame period according to the provided performance information, accessing a buffer having a capacity sufficient to store the waveform samples allotted to one frame period, the buffer being used as a working area by the processor for storing a temporary set of the waveform samples which are treated by the processor during the course of the continuous synthesis and for storing a final set of the waveform samples which are obtained upon completion of the continuous synthesis and which are accumulated throughout the plurality of the channels, addressing a cache having a capacity sufficient to store a subset of the waveform samples which is an integer division of the set of the waveform samples allotted to one frame period, the cache being hit by the processor before the buffer is addressed by the processor so as to carry out the continuous synthesis of each subset of the waveform samples more efficiently than that the buffer is otherwise addressed by the processor, and converting each of the waveform samples reserved in the buffer as the final set in response to each sampling signal into a corresponding analog signal to thereby generate the musical tones.

The inventive method of generating musical tones according to performance information, comprises successively providing performance information to command generation of musical tones, periodically providing a trigger signal at a relatively slow rate to define a frame period between successive trigger signals, periodically providing a sampling signal at a relatively fast rate such that a plurality of sampling signals occur within one frame period, periodically executing a synthesis module at each frame period in response to each trigger signal so as to carry out synthesis of a set of waveform samples allotted to one frame period, addressing a plurality of buffers each having a capacity sufficient to store the set of the waveform samples allotted to the same frame period after the synthesis, executing a plurality of effector modules each being linked to a corresponding one of the buffers to carry out modification of the set of the waveform samples reserved in the corresponding buffers to create different effects, executing a mixer module executed to carry out computation of one set of the waveform samples stored in one buffer with another set of the waveform samples stored in another buffer so as to mix different effects, providing an total effect algorithm for instructing execution of the effector modules and the mixer module in a predetermined sequence to create a total effect which is desired mixture of the different effects, designating one of the buffers to store the set of the waveform samples after completion of the modification and the computation, and converting each of the waveform samples stored in the designated buffer in response to each sampling signal into a corresponding analog signal so as to generate the musical tones with the total effect.

According to a third aspect of the invention, a method using a processor for generating musical tones through groups of channels according to performance information, comprises the steps of loading a first synthesis program prepared for a first group of channels and a second synthesis program prepared for a second group of channels together with a subroutine program utilized commonly for both of the first synthesis program and the second synthesis program, successively providing performance information to command generation of musical tones, periodically providing a trigger signal at a relatively slow rate to define one frame period between successive trigger signals, periodically providing a sampling signal at a relatively fast rate such that a plurality of sampling signals occur within one frame period, executing the first synthesis program by the processor at one frame period so as to carry out synthesis of each set of waveform samples allotted to one frame period through each channel of the first group such that the subroutine program runs to process the waveform samples during the synthesis, each set of the waveform samples being reserved in a buffer after the synthesis, executing the second synthesis program by the processor at one frame period so as to carry out synthesis of each set of waveform samples allotted to one frame period through each channel of the second group such that the subroutine program runs to process the waveform samples during the synthesis, each set of the waveform samples being reserved in a buffer after the synthesis, and converting each of the waveform samples reserved in the buffer in response to each sampling signal into a corresponding analog signal so as to generate the musical tones.

Preferably, the step of loading includes selecting at least one of subroutine programs which are designed for reading out waveform samples from a wave table, for filtering the waveform samples to modify the music tones, for creating an envelope of the waveform samples, for controlling an amplitude of the waveform samples, and for accumulating each set of the waveform samples into the buffer.

Preferably, the step of loading includes loading the selected subroutine program from a secondary memory into a primary memory which is used as a working area of the processor.

Preferably, the inventive method further includes the step of addressing a cache having a capacity sufficient to store a subset of the waveform samples which is a division of the set of the waveform samples allotted to one frame period, the cache being hit by the processor before the buffer is addressed by the processor while the processor runs the subroutine program to process each subset of the waveform samples.

The inventive method using a processor for generating musical tones through groups of channels according to performance information, comprises the steps of loading a first synthesis program prepared for a first group of channels and a second synthesis program prepared for a second group of channels, successively providing performance information to command generation of musical tones, periodically providing a trigger signal at a relatively slow rate to define one frame period between successive trigger signals, periodically providing a sampling signal at a relatively fast rate such that a plurality of sampling signals occur within one frame period, executing the first synthesis program by the processor at one frame period so as to carry out synthesis of each set of waveform samples allotted to each channel of the first group such that each set of the waveform samples belonging to the first group is preceding reserved in a buffer, executing the second synthesis program by the processor at the same frame period so as to carry out synthesis of each set of waveform samples allotted to each channel of the second group such that each set of the waveform samples belonging to the second group is succeeding reserved in a buffer after each set of the waveform samples belonging to the first group is reserved, and converting each of the waveform samples reserved in the buffer in response to each sampling signal into a corresponding analog signal so as to generate the musical tones.

The inventive method using a processor for generating musical tones according to performance information, comprises the steps of loading a synthesis program and an effector program together with a subroutine program utilized commonly for both of the synthesis program and the effector program, successively providing performance information to command generation of musical tones, periodically providing a trigger signal at a relatively slow rate to define one frame period between successive trigger signals, periodically providing a sampling signal at a relatively fast rate such that a plurality of sampling signals occur within one frame period, executing the synthesis program by the processor at one frame period so as to carry out synthesis of a set of waveform samples allotted to one frame period such that the subroutine program runs to process the waveform samples during the synthesis, the set of the waveform samples being reserved in a buffer after the synthesis, executing the effector program by the processor at one frame period so as to carry out modification of the set of the waveform samples reserved in the buffer to create a desired effect such that the subroutine program runs to process the waveform samples during the modification, each set of the waveform samples being reserved in a buffer after the modification, and converting each of the waveform samples reserved in the buffer in response to each sampling signal into a corresponding analog signal so as to generate the musical tones together with the desired effect.

The inventive method using a processor for generating musical tones according to performance information, comprises the steps of arranging an algorithm to designate desired ones of subroutine programs provisionally stored in a memory, assembling a synthesis program according to the algorithm such that the synthesis program contains call instructions for calling the designated subroutines from the memory, successively providing performance information to command generation of musical tones, periodically providing a trigger signal at a relatively slow rate to define one frame period between successive trigger signals, periodically providing a sampling signal at a relatively fast rate such that a plurality of sampling signals occur within one frame period, executing the synthesis program by the processor at one frame period so as to carry out synthesis of a set of waveform samples allotted to one frame period such that the designated subroutine programs are sequentially called in response to the call instructions to process the waveform samples during the synthesis, the set of the waveform samples being reserved in a buffer after the synthesis, and converting each of the waveform samples reserved in the buffer in response to each sampling signal into a corresponding analog signal so as to generate the musical tones together with the desired effect.

The above and other objects, features and advantages of the present invention will become more apparent from the accompanying drawings, in which like reference numerals are used to identify the same or similar parts in several views.

DETAILED DESCRIPTION OF PREFERRED EMBODIMENTS

Figure 1:
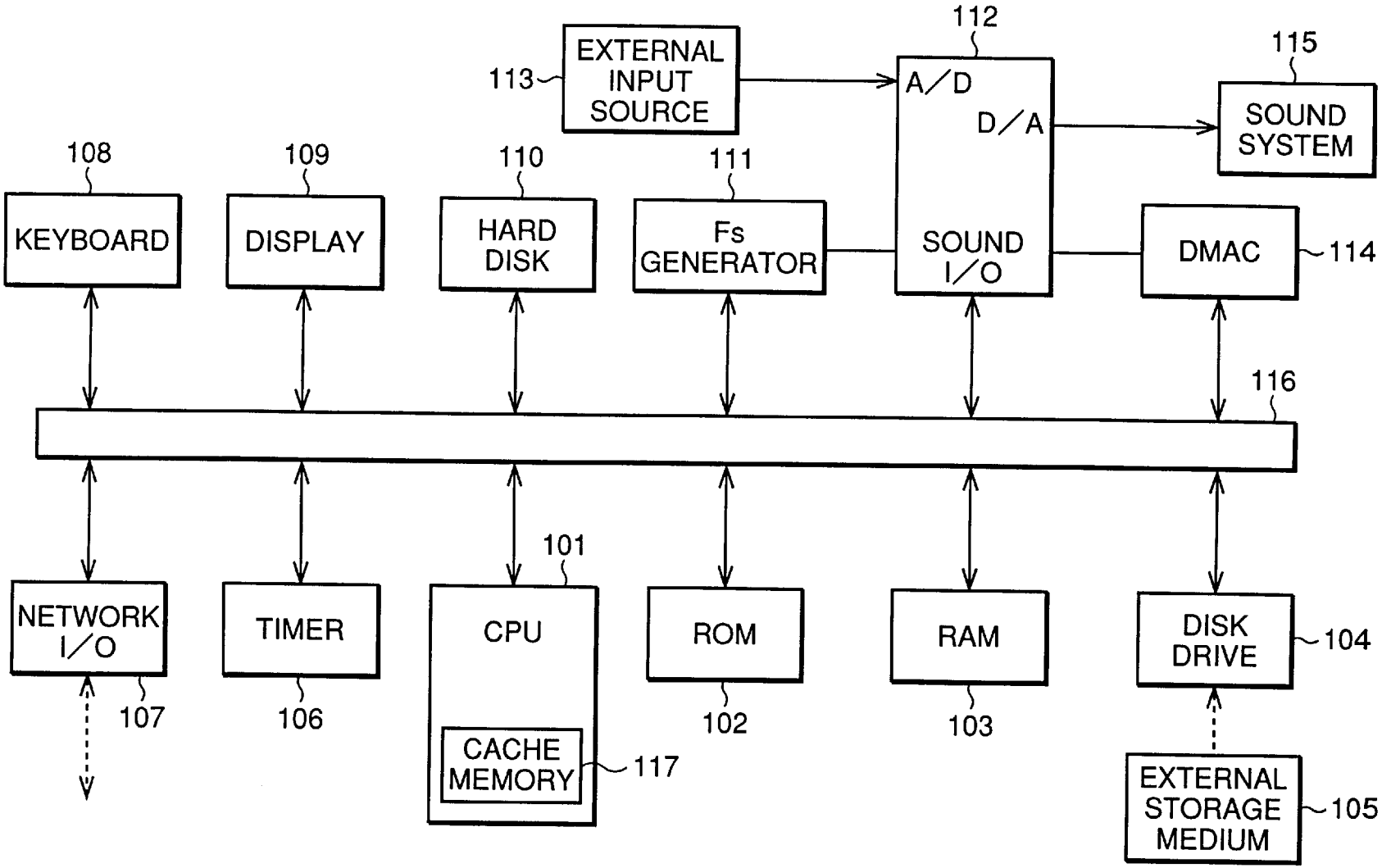
FIG. 1 is a block diagram illustrating an electronic musical instrument to which a music tone generating apparatus and a music tone generating method both associated with the present invention is applied.

This invention will be described in further detail by way of example with reference to the accompanying drawings. Now, referring to FIG. 1, there is shown a block diagram illustrating an electronic musical instrument to which a music tone generating apparatus and a music tone generating method both associated with the present invention are applied, the electronic musical instrument being practiced as one preferred embodiment of the invention. The electronic musical instrument has a central processing unit (CPU) 101, a read-only memory (ROM) 102, a random access memory (RAM) 103, a drive unit 104 of disks, a timer 106, a network input/output (I/O) interface 107, a keyboard 108, a display 109, a hard disk 110, a sampling clock (Fs) generator 111, a sound I/O 112, a DMA (Direct Memory Access) controller 114, a sound system 115, and a bus line 116.

The CPU 101 controls operations of the entire electronic musical instrument. The CPU 101 has an extended instruction set capable of executing a plurality of operations with a single instruction in parallel. more specific, data handled by a 64-bit register in the CPU is divided into four pieces of 16-bit data. The above-mentioned instruction set has an instruction that can simultaneously handle these four pieces of 16-bit data. Alternatively, the 64-bit data is handled as two pieces of 32-bit data. The instruction set has an instruction that can simultaneously handle these two-pieces of 32-bit data.

The ROM 102 stores a control program such as a program of the software sound source including a software effector executed by the CPU 101 and various parameter data. The ROM 102 also stores waveform data (namely, waveform sample data sampled at a predetermined rate) used for generating a music tone by executing the software sound source program by the CPU 101. It should be noted that the control program, various parameter data, and waveform data may be prepared in the RAM 103 instead of the ROM 102. In this case, the control program and data are supplied from an external storage medium 105 such as a CD-ROM or the network I/O interface 107. The supplied program and data are loaded into the RAM 103 or stored in the hard disk 110. The RAM 103 has work areas such as various registers, a waveform generating buffer, and reproducing buffers. The drive unit 104 inputs and outputs various data with the external storage medium 105 such as a floppy disk (FD) and a flush card. The hard disk 110 is a storage device for storing various data.

The timer 106 supplies a timer clock signal for causing a timer interrupt on the CPU 101 at a predetermined interval. The network I/O interface 107 transfers various data via an external public telephone line or a LAN (Local Area Network). The keyboard 108 is used by the user to enter various information into the electronic musical instrument. The display 109 visually presents various information. Through the keyboard and the display, the user performs various setting operations and issues commands necessary for controlling music tone generation.

The Fs generator 111 generates a sampling clock having frequency Fs supplied to the sound I/O 112. The sound I/O 112 is made up of an LSI called a coder/decoder (CODEC). The sound I/O 112 has an analog-to-digital (A/D) converting capability and a digital-to-analog (D/A) converting capability. An analog music tone signal from an external input source 113 is inputted in a A/D input terminal of the sound I/O 112, and the sound system 115 is connected to a D/A output terminal of the sound I/O 112. The sound I/O 112 incorporates two stack areas of FIFO (First-In, First-Out). One of the stack provides an input FIFO for holding the digital waveform data inputted via the A/D input terminal. The other provides an output FIFO for holding the digital waveform data outputted via the D/A output terminal.

The analog music tone signal inputted from the external input source 113 into the A/D input terminal of the sound I/O 112 is A/D-converted according to the sampling clock of frequency Fs. This signal may be compressed by ADPCM (Adaptive Differential Pulse Code Modulation) if required. The resultant digital signal is written into the input FIFO. If the input FIFO has waveform data, the sound I/O 112 requests the DMA controller 114 for processing the waveform data. In response to the request, the DMA controller 114 transfers the data to a previously allocated recording buffer area in the RAM 103. The DMA controller 114 performs this data transfer by causing a hardware interrupt on the CPU 101 every sampling clock Fs and by allocating the bus line 116. The allocation of the bus line 116 by the DMA controller 114 is transparent to the CPU 101.

On the other hand, if waveform data exists in the output FIFO in the sound I/O 112, the waveform data is D/A-converted every sampling clock Fs, and the resultant analog signal is sent to the sound system 115 via the D/A output terminal for sounding.

When the waveform data held in the output FIFO is outputted, the output FIFO is emptied. At this moment, the sound I/O 112 requests the DMA controller 114 for capturing the waveform data. The CPU 101 generates waveform data outputted beforehand, stores the generated waveform data in the reproducing buffers PB0 and PB1 in the RAM 103, and requests beforehand the DMA controller 114 for reproducing that waveform data. The DMA controller 114 causes an interrupt on the CPU 101 every sampling clock Fs to allocate the bus line 116, and transfers the waveform data in the reproducing buffer of the RAM 103 to the output FIFO of the sound I/O 112. The transfer of the waveform data by the DMA controller 114 is transparent to the CPU 101. The waveform data written into the output FIFO is sent to the sound system 115 every sampling clock Fs, and sounded as mentioned above.

The software sound source is realized by execution of the music tone generating software stored in the ROM 102 by the CPU 101. From the viewpoint of an application that uses the software sound source, the music tone generating software is registered as a driver. Next, the driver is started and a MIDI (Musical Instrument Digital Interface) event message representing various music performance is outputted to an API (Application Program Interface) associated with a predetermined software sound source to make the software sound source perform various processing operations associated with music tone generation. The CPU 101 is a general-purpose processor, and hence performs other processing such as placing the performance message or MIDI event to the API besides the software sound source processing. The processing for giving the performance message to the API by the CPU 101 includes outputting performance message generated real-time in response to an operation made on the keyboard to the API. It also includes outputting to the API the performance message according to an MIDI event inputted real-time via the network I/O 107. It further includes outputting a MIDI event sequence stored in the RAM 103 beforehand to the API as sequential performance messages. In this case, the data stored on the external storage medium 105 or the hard disk 110 may be used or the data inputted via the network I/O 107 may be used.

Figure 2:
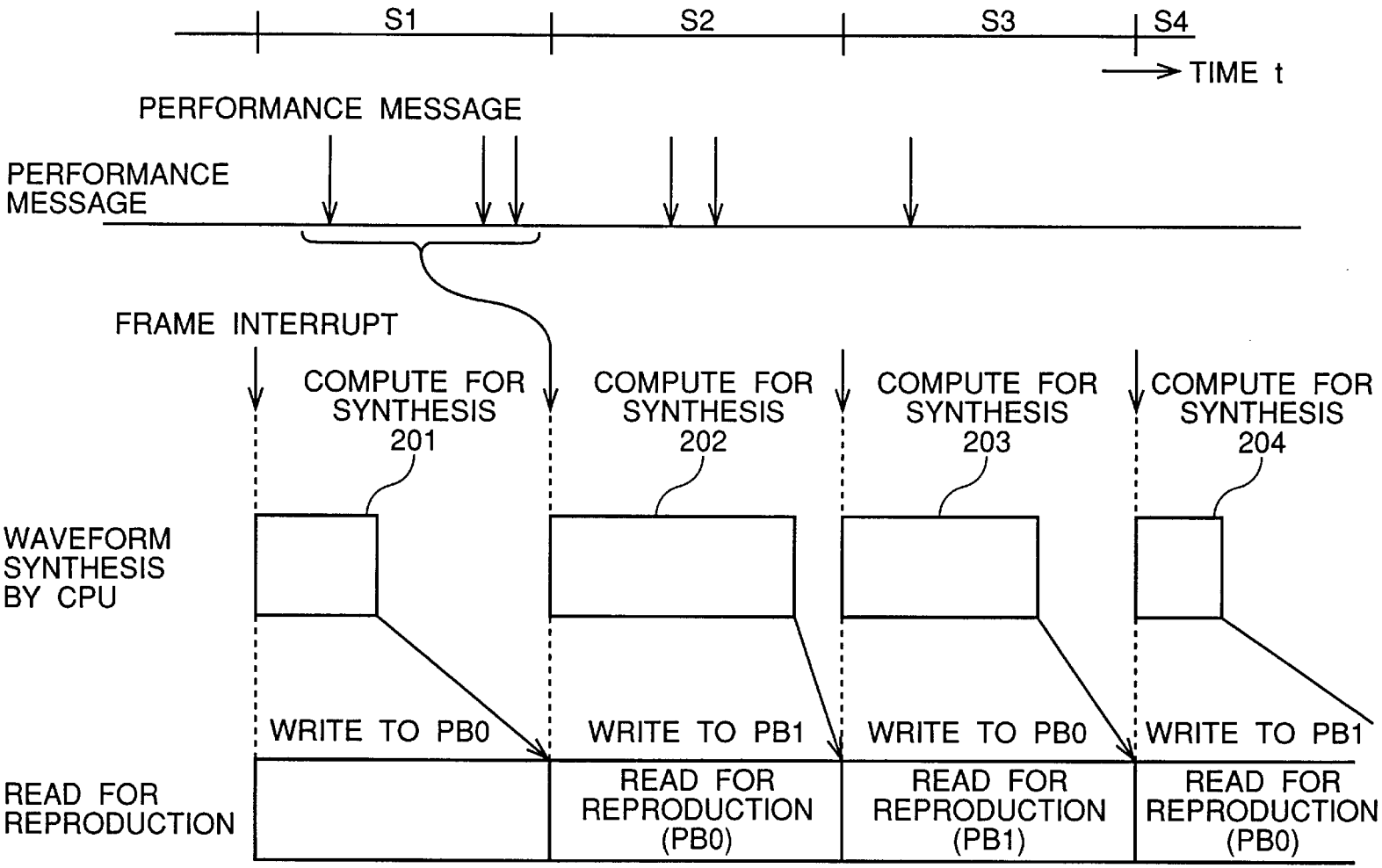
FIG. 2 is a diagram for explaining principles of generating music tones by a software sound source.

The following describes the principle of music tone generation by the software sound source with reference to FIG. 2. In FIG. 2, frames S1 through S4 denote time intervals in each of in which a predetermined number of samples (for example, 2×128 samples) are reproduced. Each downward arrow on the line of "performance message" denotes a performance message occurring at an indicated time. The performance message includes various MIDI events such as note-on, note-off, after-touch, and program change, which are inputted in the API associated with the above-mentioned software sound source. In the example of FIG. 2, three performance messages take place in frame S1, two in frame S2, and one in frame S3. The software sound source can simultaneously generate a plurality of music tones through a plurality of MIDI channels. The software sound source is adapted to control the music tones by software sound source registers for the plurality of channels prepared in the RAM 103. When a note-on event is inputted as a performance message, the software sound source performs tone assignment to the software sound source registers corresponding to the channels. Then, the software sound source writes the various data and the note-on to the software registers for controlling the sounding at the assigned channels associated therewith. When a note-off event is inputted as a performance message, the software sound source writes the note-off to the software sound source register associated with the channel concerned. The software sound source also writes a performance message such as alteration of after-touch other than note-on and note-off to the software sound source register corresponding to the channel concerned. The data written to the software sound source register in a certain time frame is used for the waveform synthesis computation at a succeeding time frame regardless of data type.

Rectangles 201 through 204 indicated in column "Waveform Generation by CPU" in FIG. 2 indicate sections for executing the waveform synthesis computations including the effect attaching by the CPU 101. In these waveform synthesis computations, music tone waveforms for the plurality of channels are generated based on the data for the plurality of channels set to the software sound source registers. According to the performance message, the software sound register is rewritten. On the other hand, the frame in which no performance message exists holds old data written to the software sound source registers in the past. Therefore, in each of the frames 201 through 204 of waveform generation, a waveform synthesis computation for an performance message detected in the frame immediately before or a frame before that is executed. Since a hardware interrupt is caused between frames, the waveform synthesis computation in each frame is triggered by this interrupt.

For example, for the three performance messages detected in frame S1, the waveform synthesis computation is triggered in the section 202 by the first frame interrupt in the following frame S2. Based on a result of this waveform synthesis computation, the CPU 101 generates the waveform data in the waveform generating buffer in the RAM 103. This waveform data is accumulated throughout the plurality of channels, and attached with an effect. The waveform data thus generated is written to the reproducing buffer areas in the RAM 103. These buffer areas are denoted by PB0 and PB1 of the same size arranged at continuous addresses. These buffer areas are called double buffers. The buffers PB0 and PB1 are used alternately for each frame. For example, the waveform data generated in the section 201 allotted to the frame S1 is written to the reproducing buffer area PB0 in the RAM 103. The waveform data generated in the section 202 allotted to the frame S2 is written to the reproducing buffer area PB1. The waveform data generated in the section 203 allotted to the frame S3 is written to the reproducing buffer area PB0. The waveform data generated in the section 204 allotted to the frame S4 is written to the reproducing buffer area PB1. Thus, the waveform data is alternately written to the PB0 and PB1.

The waveform data written to the reproducing buffers PB0 and PB1 is read out out and reproduced, upon triggered by the frame interrupt, at the succeeding frame next to the preceding frame in which the waveform data has been generated, as shown in column "Read And Reproduction" in FIG. 2. more specific, the waveform data generated in the frame S1 and written to the PB0 is read out in the following frame S2. The waveform data generated in the frame S2 and written to the PB1 is read out in the following frame S3. The waveform data generated in the frame S3 and written to the PB0 is read out in the following frame S4. Thus, the waveform data written to the PB0 and the PB1 is alternately read out for reproduction. The reading and reproduction are performed by the DMA controller 114 by causing an interrupt on the CPU 101 every sampling clock Fs to transfer the waveform data in the reproducing buffer (the PB0 or the PB1 whichever is specified) in the RAM 103 to the output FIFO of the sound I/O 112. The frame interrupt is caused at occurrence of return, namely, at the end of reproduction of the PB1, when the reproducing buffers PB0 and PB1 are read out in a loop the frame interrupt also occurs at passing the intermediate point of the loop reading, namely, at the end of the reproduction of the PB0. The frame interrupt is a hardware interrupt caused by the sound I/O 112, indicating the point of time at which reproduction of one frame has been completed. Namely, the sound I/O 112 counts the number of transferred samples, and causes a frame interrupt every time the number of samples equivalent to a half of the size of the reproducing buffers, namely a half of the total size of both the PB0 and the PB1, are transferred. The number of transferred samples are those transferred by the DMAC 114 from the PB0 and the PB1 to the output FIFO of the sound I/O.

The software sound source can simultaneously generate a plurality of music tones through a plurality of channels. Especially, in the present embodiment, the CPU 101 for realizing the software sound source has a capability of processing a plurality of data with a single instruction. This capability is used to process data through the plurality of channels for waveform generation in parallel, thereby enhancing the processing speed. The waveform generating process for one channel is composed of address generation, waveform sample reading, interpolation, filtering, volume control, and accumulation. In the present embodiment, these processing operations are executed for the plurality of channels simultaneously.

Figure 3:
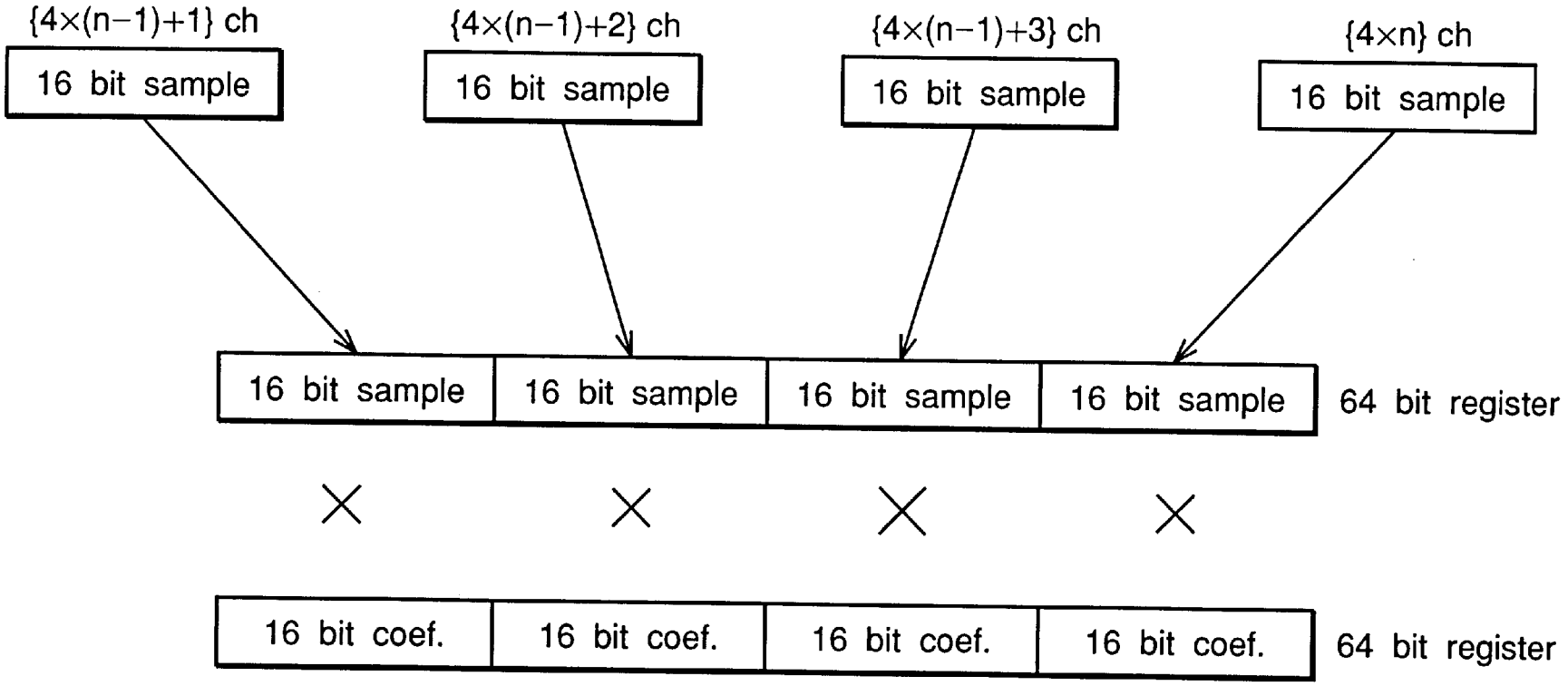
FIG. 3 is a diagram illustrating packing of data for four channels.

FIG. 3 shows a diagram illustrating a method of packing data for four channels. According to the above-mentioned extended instruction set of the CPU 101, 16 bits×4 data are set to one 64-bit register, on which arithmetic operations such as multiplication, addition, and subtraction can be performed simultaneously with 16 bits×4 data held in another 64-bit register. FIG. 3 shows an example of multiplication between these data. The data processing for the plurality of channels is divided into groups of four channels, and the processing operations for the four channels belonging to the same group is performed simultaneously. The four channels processed simultaneously are denoted by −4×(n−1)+1" through −4×n".

Figure 4:
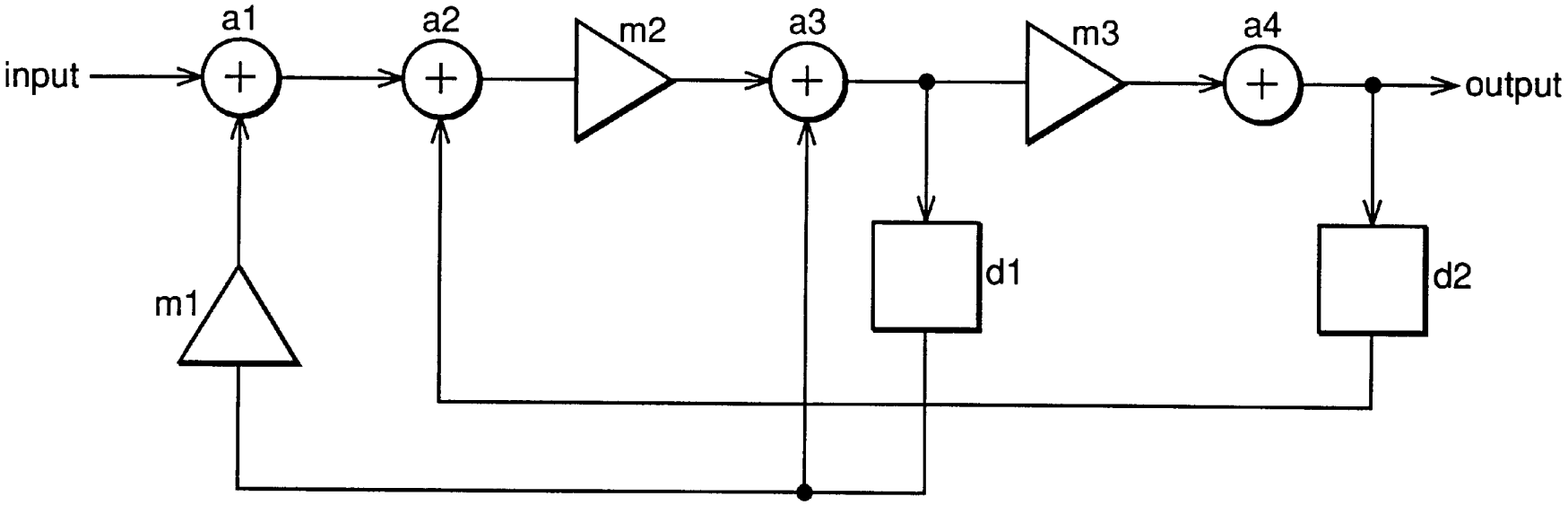
FIG. 4 is a diagram illustrating an example of an algorithm for timbre filtering of each channel.

FIG. 4 shows an example of an algorithm of timbre filter processing in each sounding channel. As seen from FIG. 4, this timbre filter processing is generally constituted by addition and multiplication. Therefore, use of the above-mentioned extended instruction set for processing the 16 bits×4 data in parallel can execute the timbre filter processing operations for four channels in parallel simultaneously. Delay processing by delay circuits d1 and d2 may be performed by writing the 16 bits×4=64-bit data to a predetermined address beforehand, and by reading the same at a desired delay.

Figure 5:
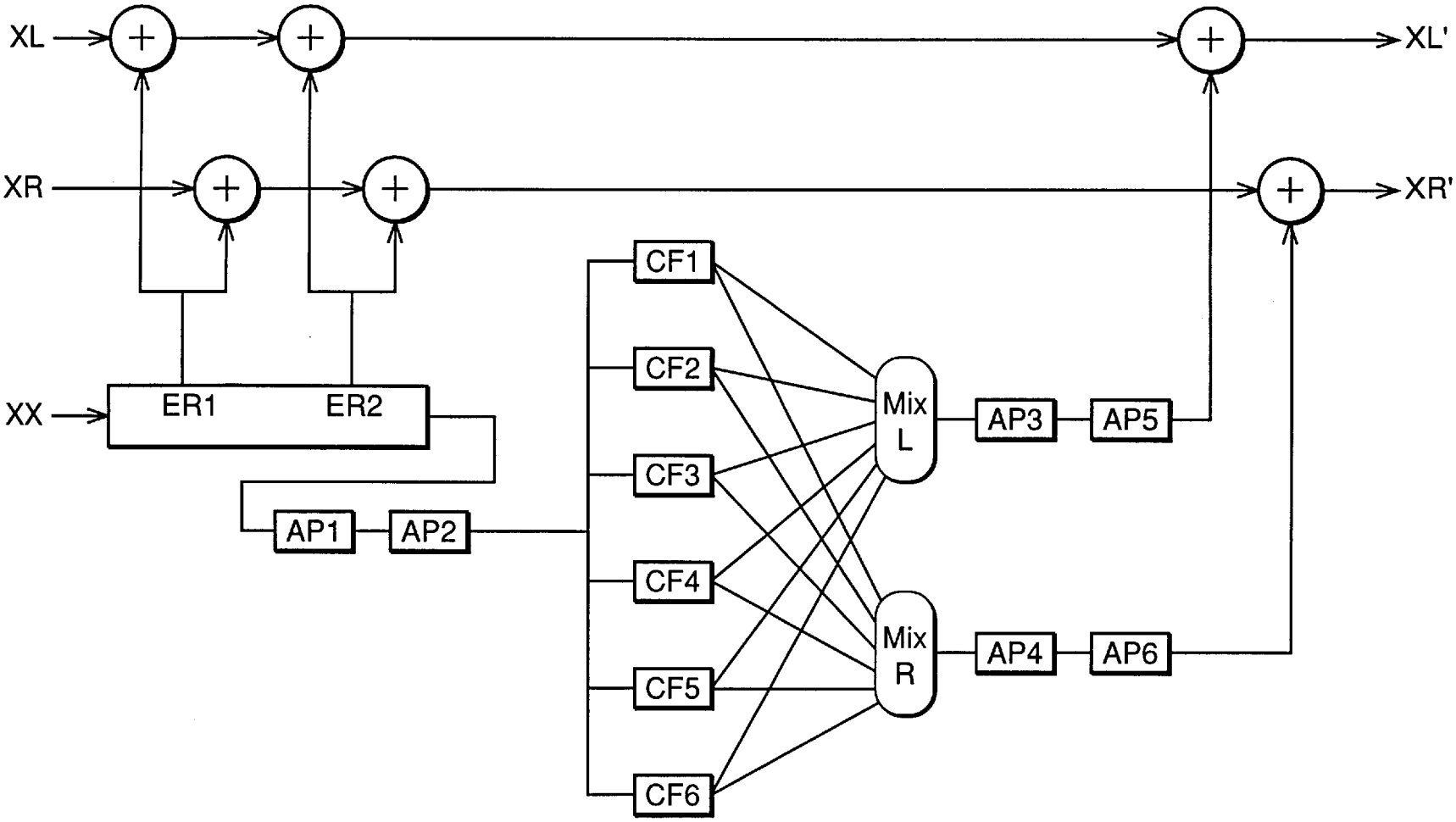
FIG. 5 is a diagram illustrating an example of an algorithm for effect processing.
Figure 6A:
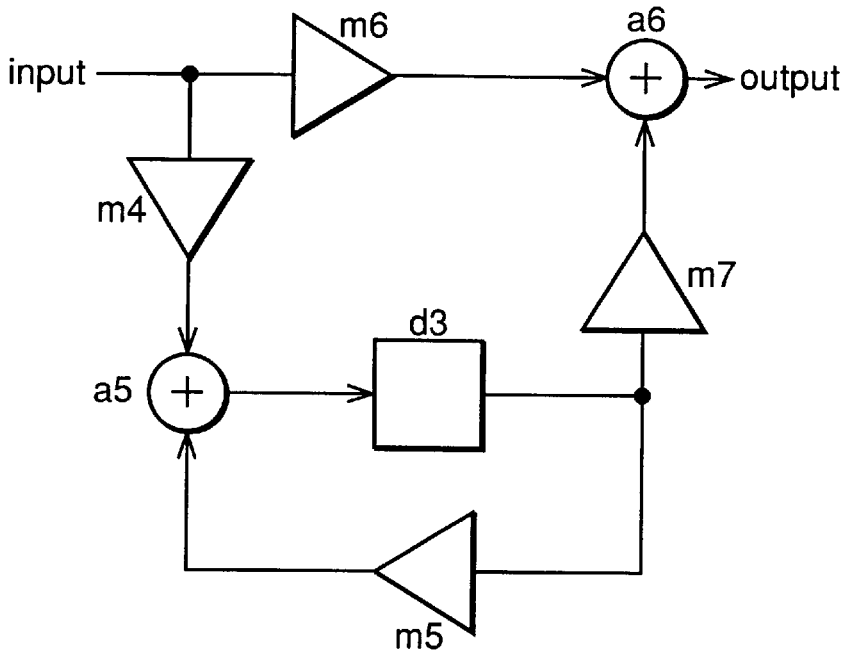
FIGS. 6A and 6B are detailed diagrams illustrating an APn and a CFn of FIG. 5.
Figure 6B:
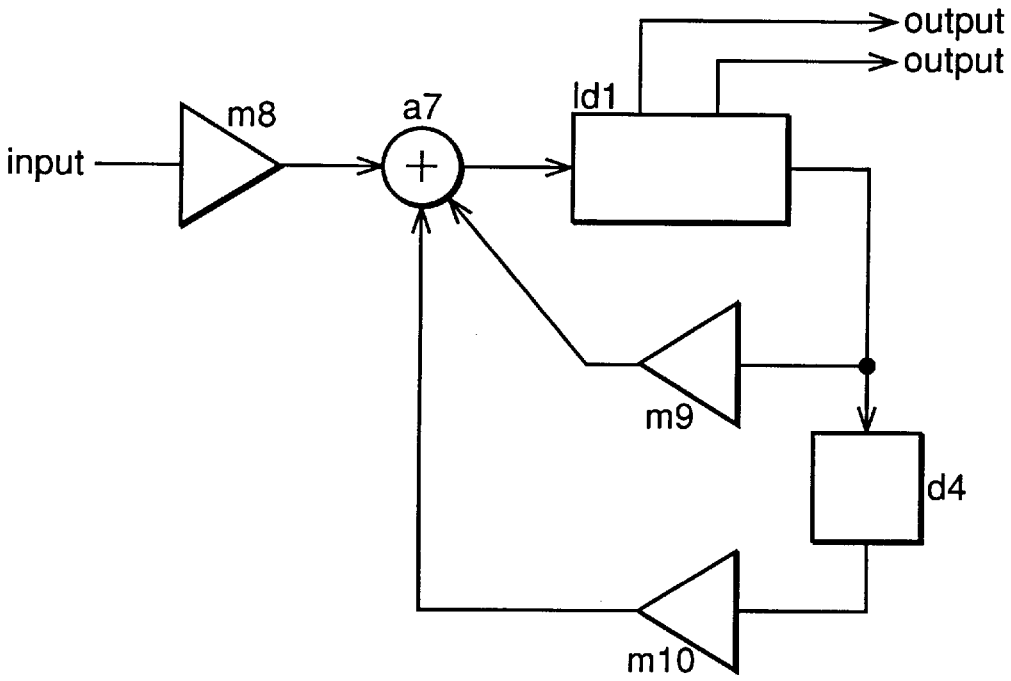

FIG. 5, FIGS. 6A and 6B show examples of algorithms of effect processing. Effect processing is not performed for each channel, but is performed after generating a waveform for each channel, accumulating the waveforms of all channels, and inputting the accumulated result to a buffer. The generated waveforms are provisionaly arranged into three routes. In FIG. 5, the waveform data inputted through three routes of XL, XR, and XX into an effector module. For one processing algorithm, the processing operations shown in FIGS. 5, 6A and 6B are performed. In such effect processing, portions of the computation in the processing algorithm that are executable in parallel are treated by the extended instruction set as much as possible, thereby increasing the processing speed. For example, computations (m4, m5, a5) and (m6, m7, a6) of FIG. 6A and (m9, m10, a7) of FIG. 6B are executed with a single instruction. Sometimes, instead of the algorithms of FIGS. 5, 6A and 6B, effect processing in which the same processing is performed on the outputs of stereophonic left and right channels. In this case, the effect processing operations for the outputs of stereophonic left and right channels can be performed at the same time by using an extended instruction set that processes 32 bits×2 data simultaneously.

The following describes the processing procedure of the CPU 101 of the above-mentioned electronic musical instrument with reference to the flowcharts of FIGS. 7A and 7B, and FIGS. 8A, 8B and 8C.

Figure 7B:
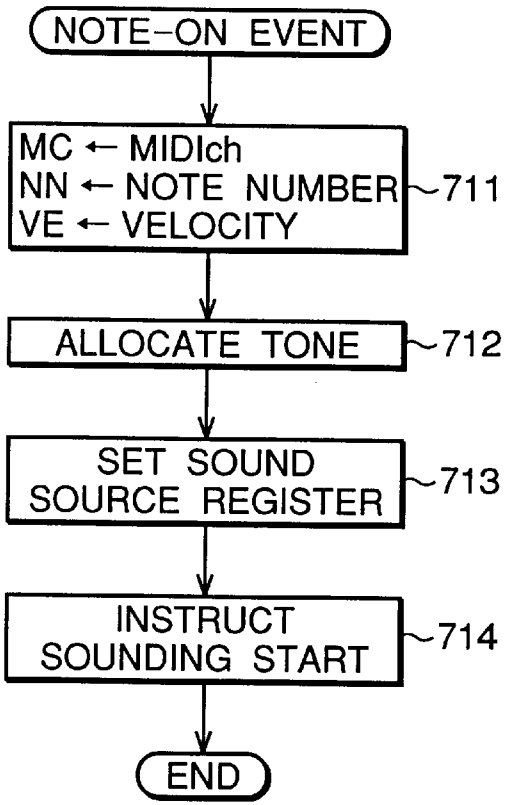
FIGS. 7A and 7B show flowcharts of a main routine and a note-on event routine.
Figure 7A:
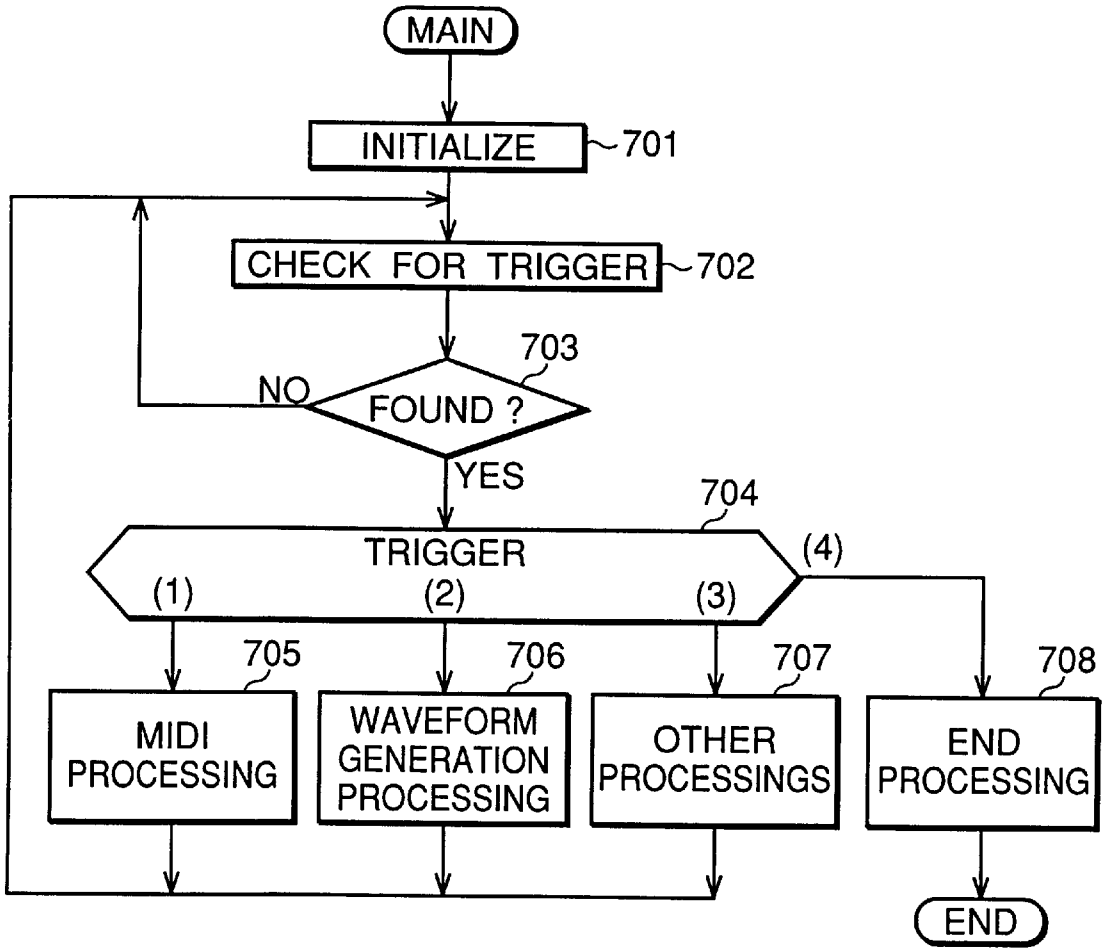

FIG. 7A shows a procedure of a main routine associated with tha software sound source contained in the control programs of the CPU 101. This main routine is registered in the OS (Operating System) as a software sound source driver. To generate a music tone by using a software sound source, this driver or the processing of FIG. 7A is first started to make valid the API associated with the software sound source beforehand. As shown in FIG. 7A, various initializing operations are performed in step 701. In this initialization, the reproducing buffers PB0 and PB1 are cleared, and the sound I/O 112 and the DMAC 114 are instructed to read the reproducing buffers PB0 and PB1 alternately as described in FIGS. 1 and 2, thereby starting the processing for reproduction beforehand. Then, in step 702, the CPU checks whether there is any trigger. If, in step 703, a trigger is found, the process goes to step 704. If no trigger is found, the process goes back to step 702. Trigger acceptance of steps 702 through 704 corresponds to acceptance of performance message to the API associated with the software sound source.

In step 704, the CPU determines a type of the trigger, and the process branches adccording to the determined type. If the trigger is an input of a MIDI event, the MIDI processing of step 705 is performed and then the process goes back to step 702. This MIDI event input and the MIDI processing of step 705 correspond to the acceptance of the performance message of FIG. 2. If, in step 704, the trigger is found a frame interrupt corresponding to completion of one-frame reproduction, the waveform generation processing of step 706 is performed and then the process goes back to step 702. The frame interrupt is a hardware interrupt that is caused every time the sound I/O 112 completes one-frame reproduction. The waveform generation processing of step 706 is the processing for performing the waveform synthesis computation shown in sections 201 through 204 of FIG. 2. In this waveform generation processing, the waveform data for one frame are generated and written to the reproducing buffers PB0 and PB1, alternately. The waveform data for one frame contain the number of waveform samples equivalent to a half of the total size of the reproducing buffers PB0 and PB1. If the trigger found in step 704 is another request, the processing according to the trigger is performed in step 707 and then the process goes back to step 702. Especially, if sampling of the external input source 113 by the sound I/O 112 is instructed, changing of software effector algorithm setting is instructed, or setting of a weighting coefficient for specifying the signal transmission level of each of the three routes outputted from the waveform generation processing to the effect attaching processing is instructed, corresponding processings are performed in step 707. If the trigger found in step 704 is a request for ending the software sound source, end processing is performed in step 708, upon which the main routine comes to an end.

FIG. 7B shows a procedure for the note-on event processing, which is one of the MIDI processes executed when a note-on is inputted at step 704. First, in step 711, a MIDI channel, a note number, and a velocity of the inputted note-on event are set to registers MC, NV, VE respectively. Next, in step 712, sounding channel assignment is performed. In step 713, information such as note number NN and velocity VE necessary for sounding is set to the software sound source of the assigned channel. In step 714, note-on is written to the software sound source register of the assigned sounding channel and a sounding start instruction is issued, upon which the note-on event processing comes to an end. Other MIDI event processing operations such as note-off are executed in generally the same manner as mentioned above. Namely, for note-off event processing, note-off is set to the software sound source register corresponding to the sounding channel concerned. For other performance messages, data corresponding to the performance message concerned is written to the software sound source register corresponding to the sounding channel concerned.

Figure 8A:
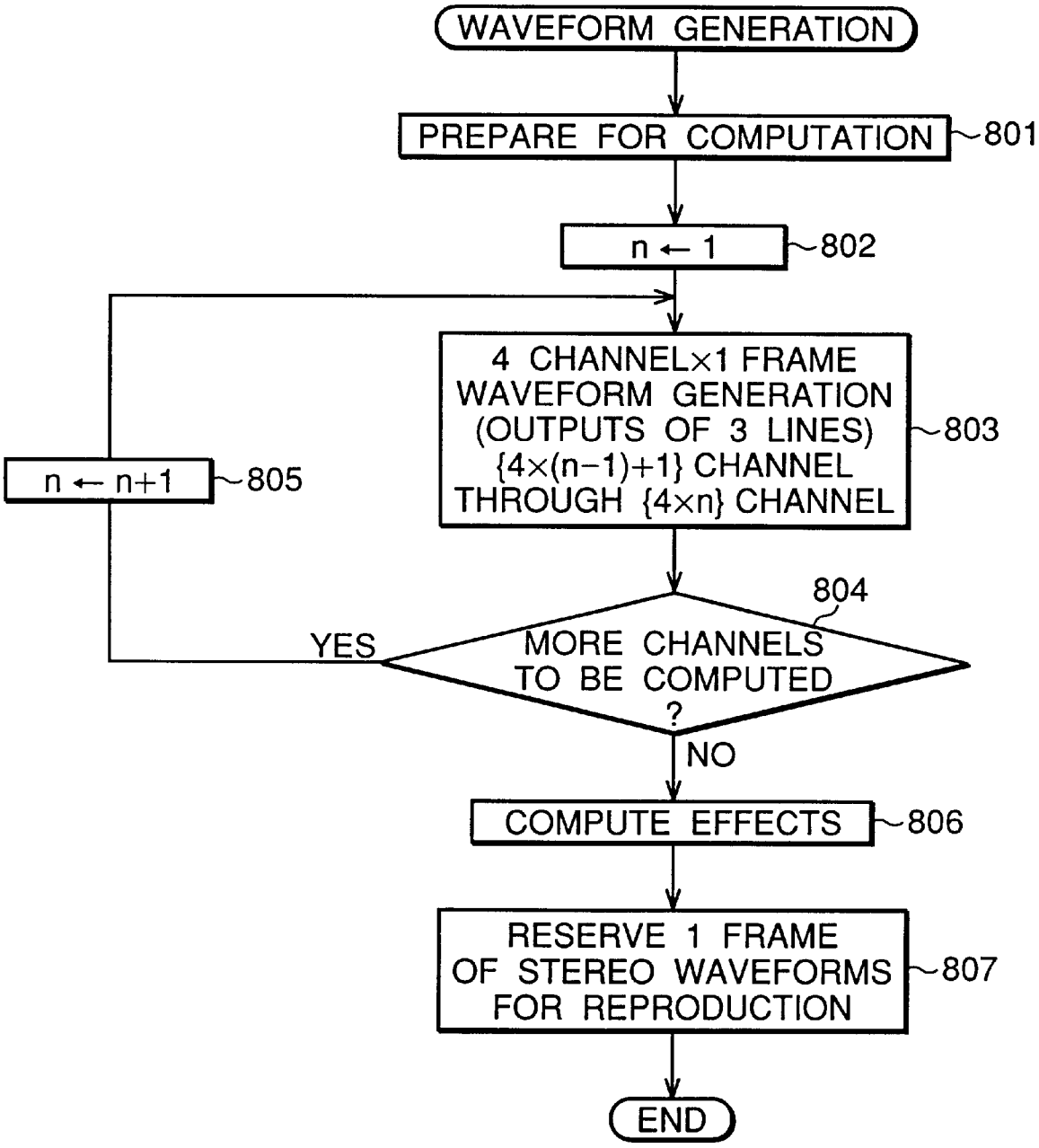
FIGS. 8A, 8B and 8C show flowcharts of a waveform generating routine, a routine for generating waveforms for four channels and for one frame, and a DMAC processing routine.

FIG. 8A shows a detailed procedure of the waveform generation processing of step 706. First, in step 801, the preparation for computation is performed. This includes the processing for recognizing a channel for which a waveform synthesis computation is performed with reference to the software sound source register, the processing for determining to which of the reproducing buffers PB0 and PB1 the waveforms for one frame generated by the waveform synthesis computation performed this time is set, and the processing for making preparations for the computation such as clearing all areas in the waveform generating buffer. Next, in step 802, "1" is set to a work register n and the process goes to step 803.

In step 803, waveform samples for four channels −4×(n−1)+1" through −4×n" are generated. In step 804, it is determined whether channels to be computed still remain. If such a channel is found, the value of the work register n is incremented and the process goes back to step 803. This operation is repeated until the waveform generation is performed for all channels to be computed. It should be noted that, since the waveform generation is performed in units of four channels, computation of an silent channel not currently sounding may be unnecessarily performed. Such a silent channel is controlled such that the volume becomes zero and hence does not affect the music tone to be outputted. If all channels are found completed in waveform generation in step 804, the process goes to step 806. In step 806, the effect processing as shown in FIGS. 5, 6A and 6B is performed. After the effect processing, the reproduction of the generated waveforms for one frame is reserved in step 807. This is the processing for copying the generated waveform samples to one of the reproducing buffers PB0 and PB1 not currently in use for reproduction. Since the processing for alternately reading the reproducing buffers PB0 and PB1 for reproduction has been started in step 701, it is satisfactory to only copy the generated waveforms to the reproducing buffer currently not use for reproduction.

Figure 8C:
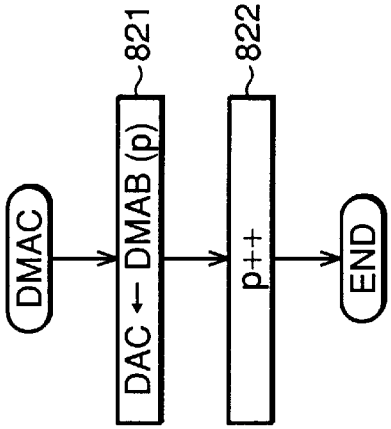
Figure 8B:
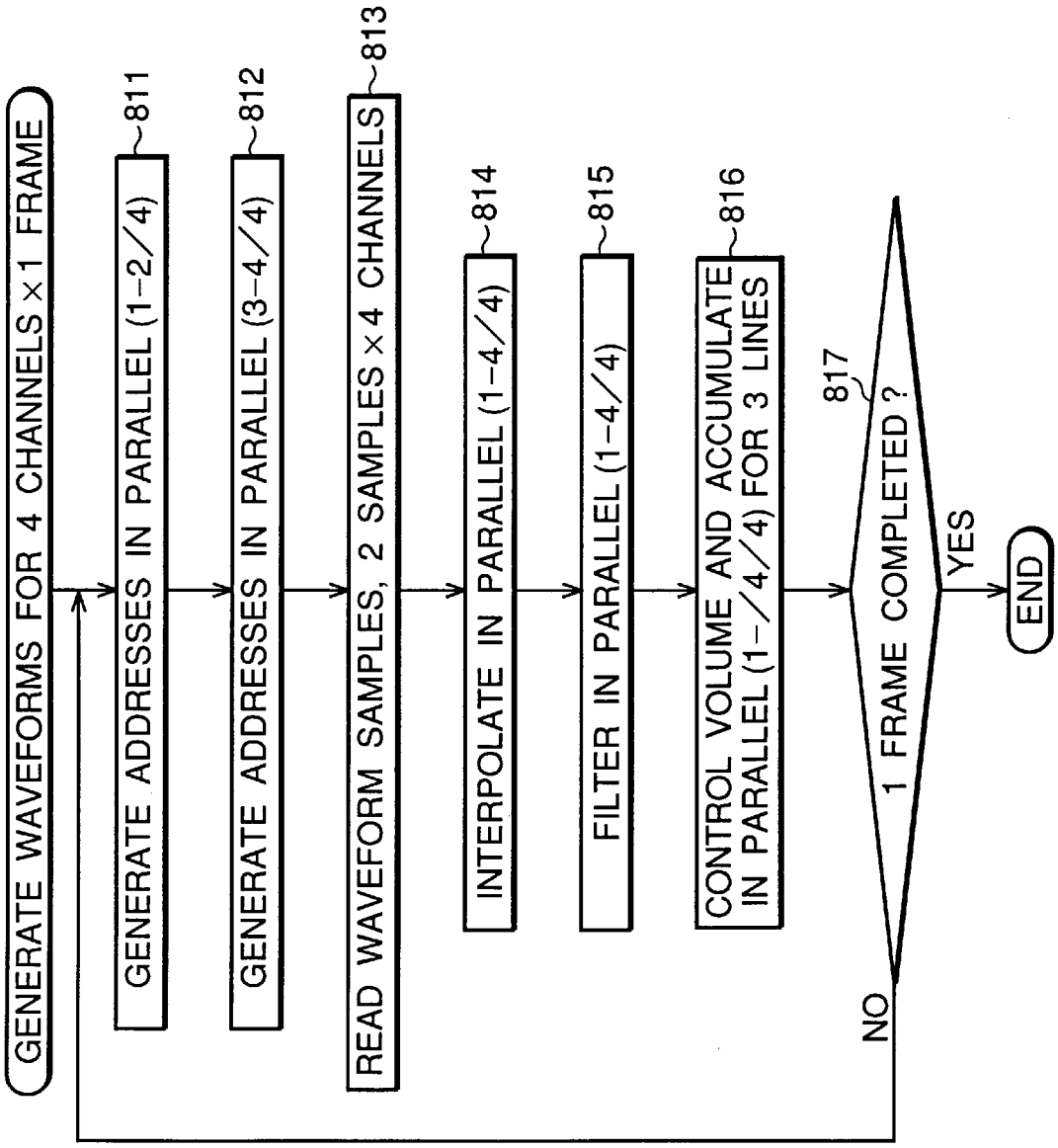

FIG. 8B shows a detailed procedure of generating one-frame waveforms for four channels performed in step 803 of FIG. 8A. In step 811, address generation for two of the above-mentioned four channels is performed and address generation for the remaining two channels is performed in step 812. The address generated here is a read address of the waveform data. In the present example, the address is prepared in the ROM 102. The address generated is longer than 16 bits, and therefore is generated in units of two channels. This is the parallel processing of two channels, hence the CPU 101 uses an extended instruction set for processing 32 bits×2 data in parallel.

Next, in step 813, the waveform samples are read out. It should be noted that, in the interpolation processing, linear interpolation using two samples is performed in each channel. Therefore, two waveform samples are read out for each channel, resulting in that the waveform samples for four channels are read out at one sequence. In step 814, the interpolating operations are performed for these four channels in parallel. Namely, the linear interpolation using two successive samples is performed. In step 815, filtering operations (FIG. 4) are performed for the four channels in parallel. In step 816, the processing operations for volume control and channel accumulation are performed for the four channels in parallel. This processing is to obtain the outputs of the three systems (XL, XR, and XX of FIG. 5) by multiplying the waveform of each channel by a predetermined level control coefficient and by accumulating the multiplication results. Because the processing of step 816 involves this multiplication, there are some portions that cannot be processed in parallel in this processing. In steps 814 through 816, the parallel processing is performed for the four channels, so that the CPU 101 uses the extended instruction set for processing 16 bits×4 data in parallel. Next, in step 817, it is determined whether the waveform samples for one frame have been generated. The number of samples for one frame is 128 sets by counting XL, XR, and XX as one set. If the generation has not yet been completed, the process goes back to step 811, in which a next waveform sample is generated. When the samples for one frame have been generated, the one-frame waveform generation processing comes to an end.

The following describes the processing of the DMA controller 114 during the reproduction with reference to the flowchart of FIG. 8C. At reproduction, a sample request interrupt (one of the hardware interrupts) is issued every sampling period by the sound I/O 112. Accordingly, the DMA controller 114 performs the processing of FIG. 8C. First, in step 821, one sample stored in the reproducing buffers PB0 and PB1 is sent to the output FIFO of the sound I/O 112. The waveform data written to the output FIFO is D/A-converted every sampling period as described with reference to FIG. 1, and the resultant analog signal is sent to the sound system 115. It should be noted that "DMAB" in step 821 denotes the reproducing buffers PB0 and PB1. Because the reproducing buffers PB0 and PB1 can be regarded as the buffers of the DMA, this notation DMAB is used. Next, in step 822, a pointer p is incremented to end the processing. The pointer p is used for reading one sample form the reproducing buffers PB0 and PB1. Thus, while incrementing the pointer p, one sample is passed from the reproducing buffers PB0 and PB1 every sampling period to the sound I/O 112. It should be noted that the pointer p is incremented by one by one for sequentially reading the samples from the top of the PB0 to the end of the PB1. When the last sample of the PB1 has been read, it is necessary to update the pointer value such that the pointer p points at the first sample of PB0. This operation is automatically performed by the DMA controller 114.

According to the above-mentioned first preferred embodiment, waveforms are generated in a predetermined time period (frame) longer than the sampling period, and the waveform samples for the predetermined period are collectively generated, so that the overhead is lower than that of the waveform generation performed at every sampling period, thereby reducing the processing time. If the CPU has a multiway cache memory, caching for a plurality of channels for continuously processing in parallel the waveform data in the ROM 103 and the waveforms for one frame being generated can be realized, resulting in a significantly efficient computation for waveform generation. Further, in the waveform generation processing, address generation is performed in parallel by increasing the number of processing bits and by decreasing the number of channels, while other processing operations such as interpolation and amplitude control are performed in parallel by decreasing the number of processing bits and by increasing the number of channels. Namely, the parallel number of channels is varied according to the data to be handled, thereby enhancing the computational efficiency and shortening the processing time.

In step 804 of FIG. 8A, if there is a channel which is being sounded and left uncomputed and it is expected that the synthesis computation will not complete within the generation period, the process may go to step 806 instead of going back to step 803. In the above-mentioned first preferred embodiment, 64 bits are processed in parallel as a set of 16 bits×4 data or another set of 32 bits×2 data. It will be apparent that the 64 bits may be processed in parallel in any other data widths. In the above-mentioned embodiment, the time length of one frame is equivalent to 128 music tone waveforms. It will be apparent that one frame may be longer or shorter than this value. For example, one frame may be equivalent to 64 samples or 1024 samples. LFO and pitch envelope processing may be added to the above-mentioned embodiment to control effects such as vibrato and tremolo. If the number of bits of the effect control waveform generated is 8, this generation processing can be performed in parallel for 8 channels.

The present invention includes a storage medium 105 as shown in FIG. 1. This storage medium is a machine-readable media containing instructions for causing the apparatus to perform the music tone generating method through a plurality of channels. This music tone generating method is realized by the following steps: first, performance information is supplied; second, a timing signal is generated at a predetermined time interval; and third, waveform data for a plurality of channels according to the above-mentioned performance information is generated every time the timing signal is generated. In the third step, processing operations for the plurality of channels are processed in parallel in units of n channels (n being two or a higher integer number) and the waveform data for a plurality of continuous samples is generated and outputted. Then, the generated waveform data is supplied to a D/A converter, one sample by one sample, every sampling period, and converted into an analog waveform.

According to the first aspect of the invention, a music apparatus comprises a processing unit of a universal type having an extended instruction set used to carry out parallel computation steps in response to a single instruction which is successively issued when executing a program, a software module defining a plurality of channels and being composed of a synthesis program executed by the processing unit using the extended instruction set so as to carry out synthesis of waveforms of musical tones through the plurality of the channels such that the plurality of the channels are optimally grouped into parallel sets each containing at least two channels and such that the synthesis of the waveforms of at least two channels belonging to each parallel set are carried out concurrently by the parallel computation steps, a buffer memory for accumulatively storing the waveforms of the plurality of the channels, another software module composed of an effector program executed by the processing unit using the extended instruction set if the effector program contains parallel computation steps to apply an effect to the waveforms stored in the buffer memory, and a converter for converting the waveforms into the musical tones.

Preferably, the processing unit executes the synthesis program so as to carry out the synthesis of the waveforms, the synthesis including one type of the parallel computation steps treating a relatively great computation amount so that the plurality of the channels are optimally grouped into parallel sets each containing a relatively small number of channels, and another type of the parallel computation steps treating a relatively small computation amount so that the plurality of the channels are optimally grouped into parallel sets each containing a relatively great number of channels.

The inventive method of generating musical tones according to performance information through a plurality of channels by parallel computation steps, comprises successively providing performance information to command generation of musical tones, periodically providing a trigger signal at a relatively slow rate to define a frame period between successive trigger signals, periodically providing a sampling signal at a relatively fast rate such that a plurality of sampling signals occur within one frame period, carrying out continuous synthesis in response to each trigger signal to produce a sequence of waveform samples of the musical tones for each frame period according to the provided performance information, the continuous synthesis being carried out using the extended instruction set such that the plurality of the channels are optimally grouped into parallel sets each containing at least two channels so that the continuous synthesis of the waveform samples of at least two channels belonging to each parallel set are carried out concurrently by the parallel computation steps, and converting each of the waveform samples in response to each sampling signal into a corresponding analog signal to thereby generate the musical tones.

The following describes an electronic musical instrument practiced as a second preferred embodiment of the present invention. Basically, the second preferred embodiment has generally the same hardware constitution as that of the first preferred embodiment shown in FIG. 1 and a software sound source operating according to the principle shown in FIG. 2, and operates according to the main flowcharts shown in FIGS. 7A and 7B.

Now, referring to FIG. 1, the CPU 101 controls the operations of the entire electronic musical instrument practiced as the second embodiment. The CPU 101 incorporates a cache memory 117. The cache line (cache block) size of the cache memory 117 is 32 bytes. To be more specific, when the CPU 101 reads one data byte at a given address from the ROM 102 or the RAM 103, continuous 32 bytes including the one byte at that address are copied to a predetermined cache line in the cache memory 117. Then, if read request occurs for data of any of these 32 bytes, the data in that cache line is supplied instead of reading data from the ROM 102 or the RAM 103. Access to the cache memory is performed significantly fast. Therefore, while the data is in the cache memory 117, the data can be processed significantly fast. It should be noted that the cache memory is of two types; write-through and write-back. In the second embodiment, the cache memory of write-though type is used.

Figure 9A:
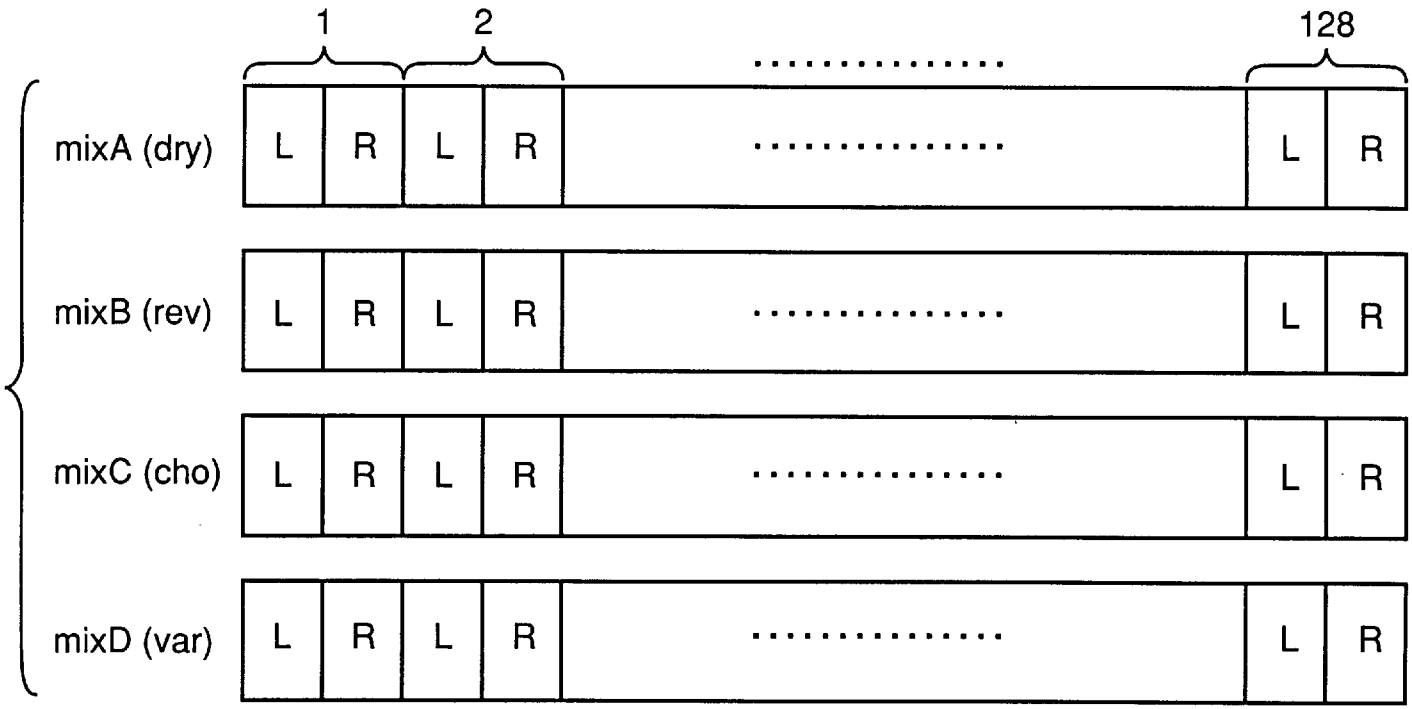
FIGS. 9A and 9B are a diagram illustrating an example of constitution of a waveform generating buffer associated with the present invention and an example of a constitution of a conventional waveform buffer.

FIG. 9A shows an example of the constitution of waveform generating buffers used by the CPU 101 for waveform generation. These buffers are denoted by mixA, mixB, mixC, and mixD. The mixA is for a dry tone; in this buffer, waveform data to which no effect is attached is set. The mixB is for reverberation; in this buffer, waveform data inputted into reverberation processing is set. The mixC is for chorus; in this buffer, waveform data inputted into chorus processing is set. The mixD is for variation; in this buffer, waveform data inputted into variation processing is set. Each of the buffers mixA, mixB, mixC, and mixD is made up of a storage area for 128 sets of samples (2×128=256 samples), each set being composed of a storage area for stereophonic left side (L) waveform sample and a storage area for stereophonic right side (R) waveform sample. Each of the L side waveform sample and the R side waveform sample is a 16-bit (2-byte) sample. Each of the mixA, the mixB, the mixC, and the mixD is subjected to boundary adjustment that they are sequentially cached in units of 32-byte (namely 16 samples) from the top of addresses.

Figure 10:
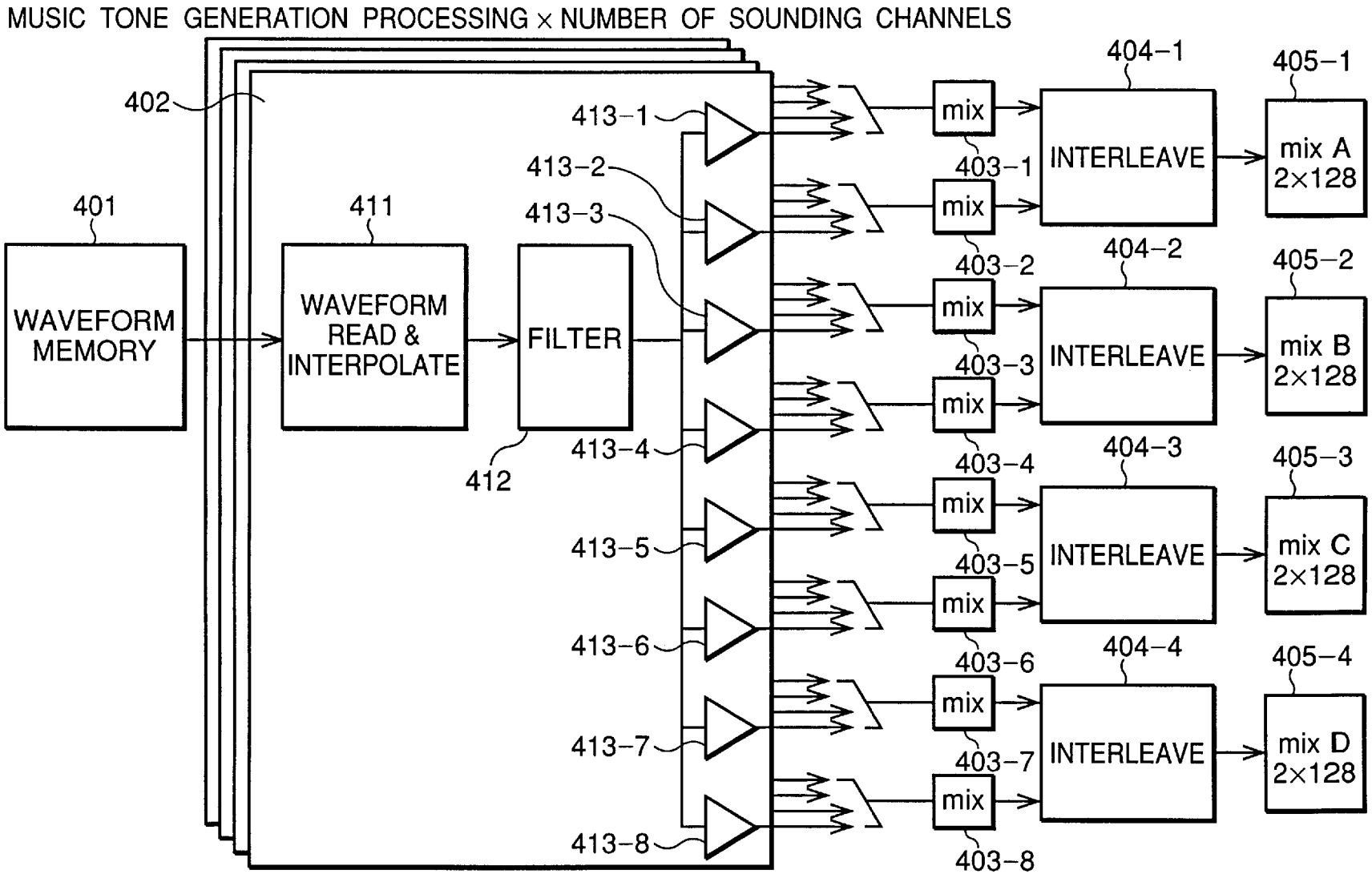
FIG. 10 is a diagram illustrating an example of an algorithm of operations including music tone generation by a software sound source and channel accumulation.

FIG. 10 shows an example of an algorithm of the processing covering from music tone generation by a software sound source to channel accumulation. A waveform memory 401 stores waveform sample data sampled by a predetermined rate. In this example, waveform data prepared in the ROM 102 is used. Alternatively, waveform data prepared in the RAM 103 may be used. For the waveform data in the RAM 103, data read from the external storage medium 105 or the hard disk 110, data inputted via the network I/O 107, or waveform data obtained by sampling the external input 113 by the sound I/O 112 may be used.

The software sound source executes the music tone generation processing 402 for the required number of channels. The maximum number of channels is predetermined according to the processing capability of the CPU. Computation can be started with any channel. For example, the computation can be performed on a last-in fast-out basis. Sometimes, a channel for which volume level has been reduced may have lower priority. For music tone generation for one channel, waveform data is read out from the waveform memory by waveform read & interpolation processing 411, and the read waveform data is interpolated. Next, the interpolated waveform data is filtered by a filter 412. Then, the filtered waveform data is divided into eight routes or lines, which are multiplied by predetermined coefficients by multipliers 413-1 through 413-8, respectively. The outputs of the eight lines include dry L output obtained by multiplying a dry L (stereophonic left side) coefficient through the multiplier 413-1, dry R output obtained by multiplying a dry R (stereophonic right side) coefficient through the multiplier 413-2, reverberation L output obtained by multiplying a reverberation L coefficient through the multiplier 413-3, reverberation R output obtained by multiplying a reverberation R coefficient through the multiplier 413-4, chorus L output obtained by multiplying a chorus L coefficient through the multiplier 413-5, chorus R output obtained by multiplying a chorus R coefficient through the multiplier 413-6, variation L output obtained by multiplying variation L coefficient through the multiplier 413-7, and variation R output obtained by multiplying variation R coefficient through the multiplier 413-8. The outputs of these eight lines each obtained for each channel are independently mixed or channel-accumulated by mixers 403-1 through 403-8. The accumulated outputs are interleaved by interleave processing operations 404-1 through 404-4 in L and R. The interleaved data are set to the waveform generating buffers mixA, mixB, mixC, and mixD of FIG. 9 as shown in 405-1 through 405-4.

Figure 11:
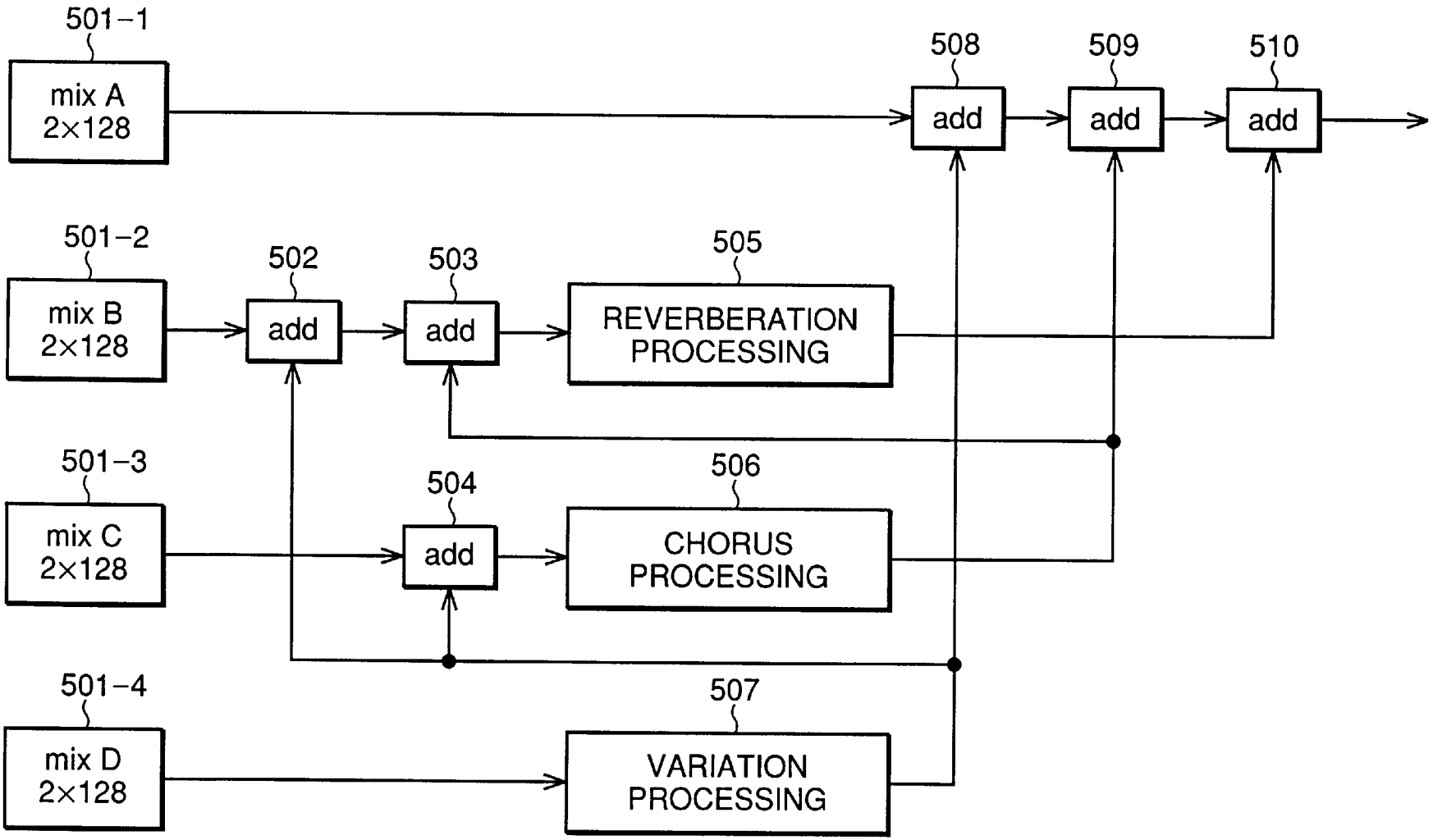
FIG. 11 is a diagram illustrating an example of an algorithm of a software effector for attaching a plurality of effects to waveform data.

The user can enter an effect edit command through the keyboard 108 and the display 109. In step 707 of the main flow shown in FIG. 7, an effect edit processing program can be executed to edit the algorithm and parameters of a software effector. FIG. 11 shows an example of an algorithm of the software effector set by editing by the user. This algorithm is adapted to apply a plurality of effects to the waveform data reserved in the waveform generating buffers mixA, mixB, mixC, and mixD in the processing of FIG. 10.

In editing the algorithm of the software effector, the number of blocks of the processing by the software effector (three blocks in FIG. 11), the processing contents of each block (reverberation, chorus, and variation in FIG. 11), and information about connection between blocks (connection between three blocks by five add processing in FIG. 11) are designated by the user, for example. The effect edit processing program automatically determines the sequence of effect processing on a plurality of specified blocks and a plurality of add processing operations such that the designated connection is enabled and sets up an effect processing program having the algorithm shown in FIG. 11. The algorithm shown on FIG. 11 indicates the processing composed of the following procedures (1) through (6).

(1) The waveform data is read out from the waveform generating buffer mixD 501-4, the variation processing 507 is performed on the read data, and the resultant data is overwritten to the mixD.

(2) Add(mixD→mixA) 508, add(mixD→mixB) 502, and add(mixD→mixC) 504 are executed. In the add processing, each sample in the buffer indicated before "→" is weighted by multiplying the sample by a predetermined coefficient and the weighted sample is added to a sample in the buffer indicated after "→". The add processing is carried out by using a common routine, while the weight coefficient is specified beforehand according to which processing result is weighted and to which the weighted result is added. Thus, the results of the variation processing 507 are weighted by the add processing operations 508, 502 and 504, and the weighted results are added to the waveform data in the dry buffer mixA, the reverberation buffer mixB, and the chorus buffer mixC.

(3) The waveform data in the waveform generating buffer mixC is obtained by adding the weighted waveform data on which the variation processing has been performed by the add processing 504 to the original waveform data prepared for the input in the chorus processing. This data is read out, the chorus processing 506 is performed in the read data, and the result is overwritten to the mixC.

(4) Add(mixC→mixA) 509 and add(mixC→mixB) are executed. Thus, by the add processing operations 509 and 503, the results of the chorus processing 506 are weighted and the weighted results are added to the waveform data in the dry buffer mixA and the waveform data in the reverberation buffer mixB, respectively.

(5) The waveform generating buffer mixB holds the data obtained by adding the weighted waveform data on which the variation processing 507 has been performed by the add processing 502 to the waveform data prepared for the input in the reverberation processing and adding the weighted waveform data on which the chorus processing 506 has been performed by the add processing 503 to that added data. The resultant waveform data is read out from the mixD, the reverberation processing 505 is performed on the read data, and the resultant data is overwritten to the mixB.

(6) Add(mixB→mixA) 510 is executed. Thus, by this add processing 510, the result of the reverberation processing 505 is weighted and the weighted data is added to the waveform data in the dry buffer mixA. Consequently, the waveform data obtained by attaching variation, chorus, and reverberation effects to the dry waveform data is finally set to the mixA.

The above-mentioned reverberation processing 505, chorus processing 506, and variation processing 507 impart the various effects to the waveform data of the mixB, mixC, and mixD, and overwrite these buffers with the effect imparted data. The add processing operations 502 through 504 and 508 through 510 are common routines. Therefore, appropriate arrangement of these routines can change the sequence in terms of the connection relationship between the software effectors representative of a plurality of effect attaching operations. The common routines "add" are available because the waveform generating buffers are separately provided to the corresponding effects, and the same structure is given to these buffers. In the second embodiment of the present invention, the algorithms of the software effectors can be designated without any restriction by means of the keyboard 108, for example.

According to the second embodiment of the present invention, a cache hit rate can be remarkably increased by executing the waveform generation through the algorithms shown in FIGS. 10 and 11 in units corresponding to the cache line size, thereby enhancing the speed of music tone synthesis computation. The speeding up of the processing by caching will be described in detail with reference to flowcharts shown in FIGS. 12A and 12B.

Figure 12A:
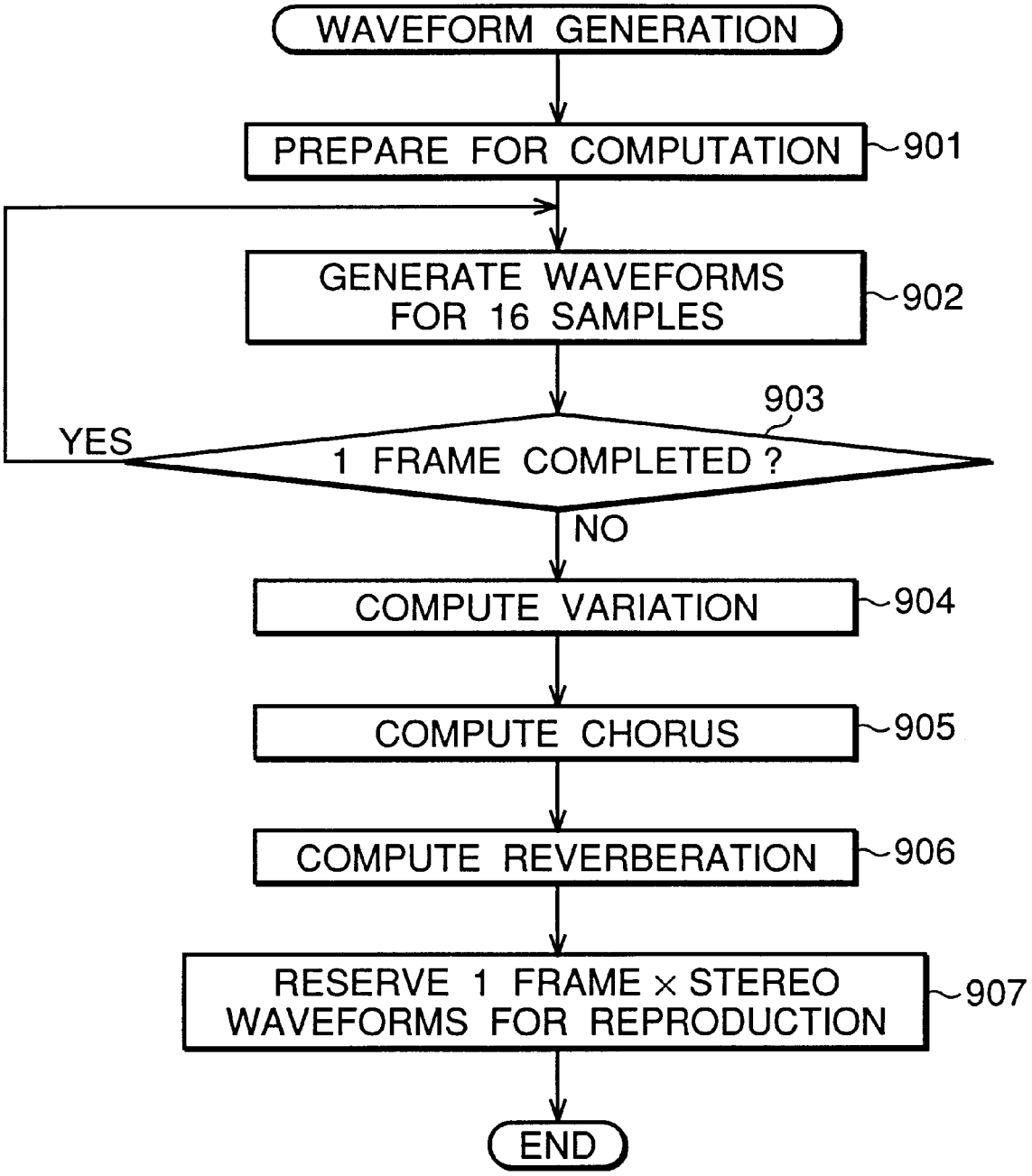
FIGS. 12A and 12B show flowcharts of a waveform generation processing routine and a routine for generating waveforms for 16 samples.

FIG. 12A shows a detailed procedure of the waveform generation processing performed in step 706. By this waveform generation processing, music tone generation is performed with the algorithms shown in FIGS. 10 and 11. First, in step 901, preparation for computation is made. This preparation processing includes the processing for recognizing a channel for which computation for waveform generation is performed with reference to a software sound source register, the processing for determining to which of the waveform generating buffers PB0 and PB1 the waveform for one frame generated this time by this computation of waveform generation is to be set, and the processing for clearing all areas of the waveform generating buffers mixA, mixB, mixC, and mixD. Next, in step 902, computations for generating waveforms for 16 samples associated with all channels are performed. It should be noted that counting the samples of stereophonic L and R as a unit results in 2×16=32 samples. The processing of algorithm shown in FIG. 10 is performed for 16 samples, and the waveforms for 2×16 samples are stored in each of the waveform generating buffers mixA, mixB, mixC, and mixD.

In step 903, it is determined whether the waveform samples for one frame have been generated. Namely, it is determined whether 2×128 samples have been generated in each of the waveform generating buffers mixA, mixB, mixC, and mixC shown in FIG. 9. If the generation of samples for one frame has not been completed, the process goes back to step 902, in which next 2×16 samples are generated. By repeating the operation of step 902, 2×16 waveform samples are loaded into the waveform generating buffers mixA, mixB, mixC, and mixD shown in FIG. 9 from the top to the end.

Figure 9B:
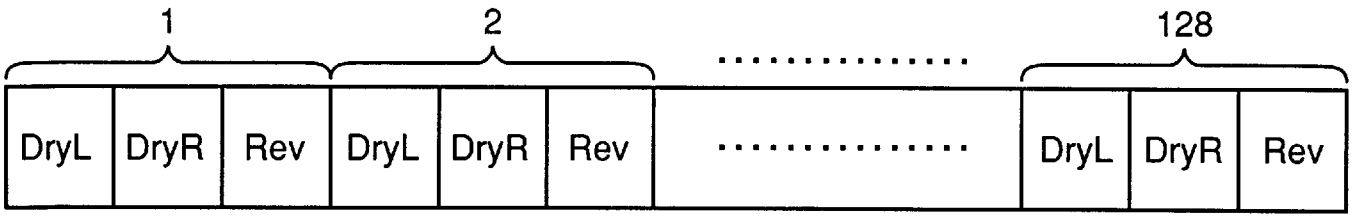
FIG.9B PRIOR ART

When the waveform samples for one frame have been generated in the waveform generating buffers mixA, mixB, mixC, and mixD shown in FIG. 9 in step 903, the process goes to step 904. In steps 904, 905, and 906, variation, chorus, and reverberation effects are attached, respectively. In these processing operations, the variation processing, the chorus processing, the reverberation processing, and the add processing are performed according to the sequence specified by the algorithm designated by the user as described with reference to FIG. 11. It should be noted that changing in setting of the algorithms of the software effectors is conducted by the other processing at step 707 shown in FIG. 7A. The software effector processing operations of steps 904, 905, and 906 are performed in units of 2×16 samples likewise steps 902 and 903. Namely, the processing of the algorithm shown in FIG. 11 is performed for 2×16 samples from the top of the waveform generating buffers mixA, mixB, mixC, and mixD. Then, the processing shown in FIG. 11 is performed for the next 2×16 samples. This processing is repeated until 2×128 samples attached with effects are eventually obtained in the waveform generating buffer mixA. Each of the variation processing, chorus processing, reverberation processing, and add processing described with reference to FIG. 11 is conducted in the unit of 2×16 samples.

It should be noted that FIG. 12A does not show the add processing described with reference to FIG. 11. Actually, this add processing is included in the effect block processing of steps 904 through 906. The variation processing of step 904 includes the procedures described in (1) and (2) above. The chorus processing of step 905 includes the procedures described in (3) and (4) above. The reverberation processing of step 906 includes the procedures described in (5) and (6) above.

It should also be noted that the effect processing in each of steps 904, 905, and 906 may be performed for one frame collectively rather than in units of 2×16 samples. Namely, the variation processing, chorus processing, reverberation processing, and add processing described with reference to FIG. 11 may be performed for one frame at a time. In this case, the caching is also working well for every 16 samples during the one-frame processing. This setup may lower the hit rate in the inter-processing among the buffers, but still raises the hit rate with respect to the registers and within each buffer for use in each effect processing. As compared with the sounding processing, the effect processing takes time before results are obtained, so that it is more efficient to process the samples for one frame at a time. It is still more efficient if this collective processing is performed in units of 16 samples locally. Namely, to make it hard for cache miss to occur, it is a good approach to process continuous pieces of data in a short period.

After the software effector processing, the generated waveform samples for one frame (namely, 2×128 samples in the mixA) are reserved for reproduction. This is the processing for copying the waveform samples from the mixA to one of the reproducing buffers PB0 and PB1 (the buffer currently not used for reproduction). Since the processing for alternately reading the reproducing buffers PB0 and PB1 has already been started, only copying the waveforms in the reproducing buffer not used for reproduction causes sounding of the waveform concerned. In this example, the waveform generating buffer mixA, and the reproducing buffers PB0 and PB1 are provided separately from each other. Alternatively, two planes of mixA may be prepared to provide the PB0 and the PB1, respectively. In this case, the waveform generation processing is performed on the reproducing buffers directly, so that the processing for copying the waveforms generated in step 907 is not required, thereby enhancing the processing speed.

Figure 12B:
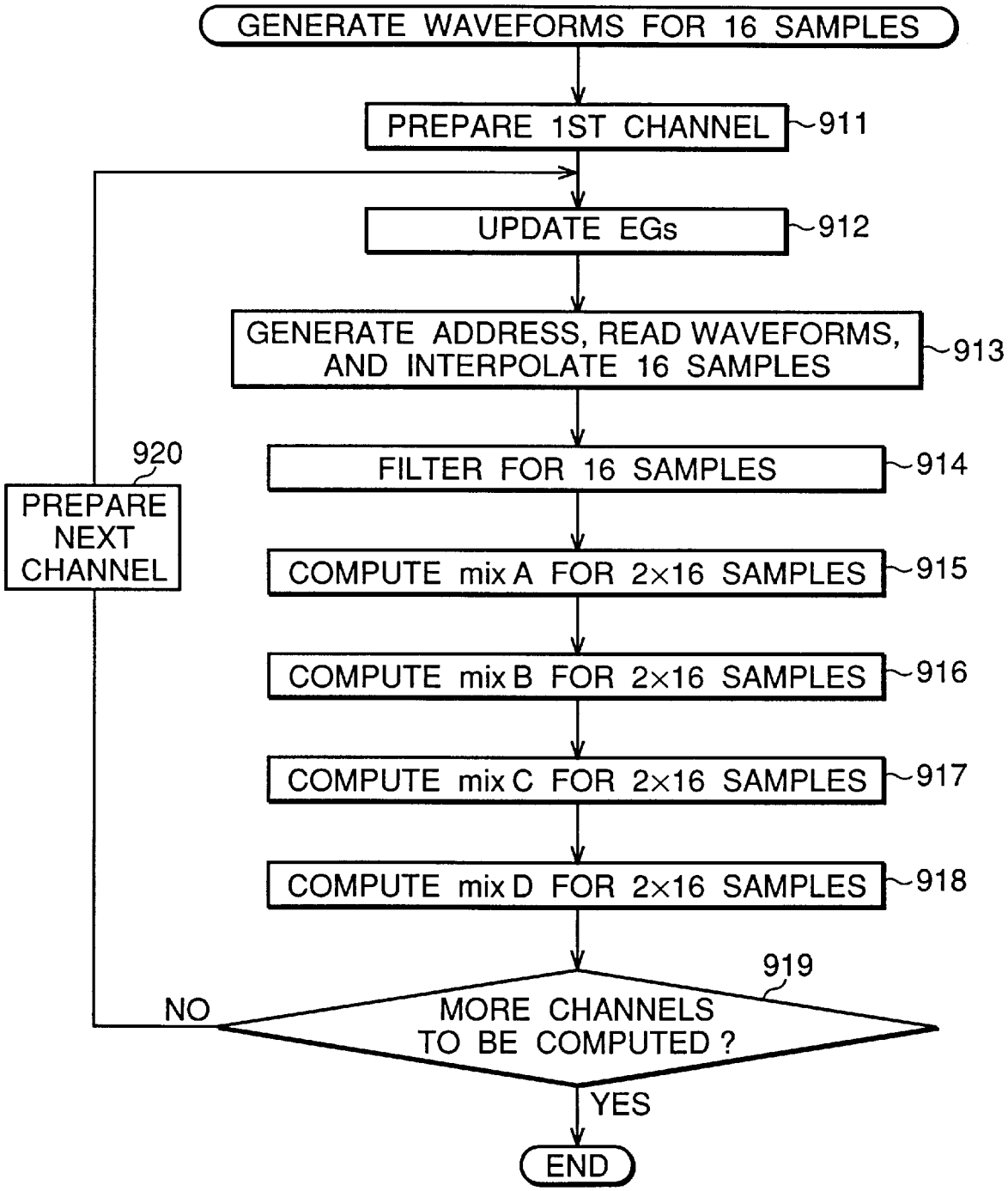

FIG. 12B shows a detailed procedure of generating waveforms for 16 samples (or 2×16=32 samples if counted in units of the samples of stereophonic L and R) performed in step 902 of FIG. 12A. First, in step 911, preparation for computation is made for the first channel. By the preparation of step 901 of FIG. 12A, channels to be subjected to computation for waveform generation and the priority among the channels are determined. Therefore, in step 911, a channel having the highest priority is made the first channel. Next, in steps 912 through 918, waveforms are generated for 16 samples for the channel concerned.

In step 912, an envelope value used in later processing is obtained. The envelope value is generated by envelope generation processing that outputs an envelope waveform of ADSR (attack, decay, sustain, release). The envelope value generated in step 912 is used commonly by the 16 samples currently being processed. One generated envelope value is commonly used by the 16 samples. Namely, one envelope value is generated for every 16 waveform samples. Next, in step 913, address generation, waveform reading, and interpolation denoted by reference 411 of FIG. 10 are performed for 16 samples. In step 914, these samples are filtered (412 of FIG. 10). At this point of time, each of these samples is not yet divided into stereophonic L and R, and hence is monaural.

In step 915, 2×16 samples for the mixA are computed. Namely, the following processing is performed on the monaural 16 samples outputted from the filter processing 412 shown in FIG. 10. First, a dry weighting coefficient (dryL) is added to the envelope value obtained in step 912. These coefficient and envelope value are both on dB scale, so that the addition is equivalent to multiplication on linear scale. Then, the added result of the above-mentioned coefficient and envelope value is multiplied in exponential conversion by an adder 413-1 by each waveform sample value outputted from the filter processing 412. Thus, 16 samples of the dry L are obtained. The dry R waveform samples are also obtained in generally the same manner by using the dry R coefficient. The dry L and R sample waveforms (2×16=32) are accumulated to the mixA.

As with step 915, reverberation L and R (2×16=32) sample waveforms are accumulated to the mixB in step 916. In step 917, chorus L and R (2×16=32) sample waveforms are accumulated to the mixC. In step 918, variation L and R (2×16=32) sample waveforms are accumulated to the mixD. It will be apparent that different weighting coefficients are used for dry, reverberation, chorus, and variation.

Next, in step 919, it is determined whether channels remain uncomputed. If yes, preparation for the next computation is made in step 920, and the process goes back to step 912. The computation starts with a channel having higher priority. This operation is repeated to generate waveforms for 16 samples for each of stereophonic L and R, the generated waveforms being accumulated to the waveform generating buffers mixA, mixB, mixC, and mixD. If no more channel is found in step 919, the waveform generating processing comes to an end.

In the waveform synthesis computation shown in FIGS. 12A and 12B, the waveform generation including effect attaching is performed in units of 2×16 samples. Sixteen samples are 32 bytes long. Each of the waveform generating buffers mixA, mixB, mixC, and mixD shown in FIG. 9 has adequate boundaries such that these buffers are sequentially cached from the top in units of 32 bytes. Therefore, when the first sample of the mixA is accessed for example, the 16 samples including this first sample are cached in the cache memory 117. Since the waveform generation processing is performed in the cache memory 117 while these 16 samples are being processed, waveform generation can be performed very fast. When stereophonic L and R are considered, the processing is performed in units of 64 bytes for 2×16 samples. Adjacent groups of 16 samples are cached in different cache lines, so that two cache lines are used in this case.

Especially, in the second preferred embodiment, the user can arbitrarily designate the algorithms of attaching a plurality of effects, so that the effect attaching is performed in a variety of sequences. Since the different waveform generating buffers are provided for different effects, the processing of one effect is performed on the corresponding buffer. This buffer stores only the waveform samples used for the effect attached. Namely, this buffer has no sample that is unnecessary for the effect attaching concerned. This setup remarkably increases the cache hit efficiency, thereby enhancing the effect of caching.

In the above-mentioned second preferred embodiment, as seen from steps 902 and 903 of FIG. 12A and from FIG. 12B, the processing for generating waveforms for 16 samples over all channels is performed in an inner loop and this waveform generation processing for 16 samples is kept performed in an outer loop until one frame is processed, thereby generating the waveforms for one frame. In some cases, the inner and outer loop processing operations may be exchanged with each other. Namely, the waveform generation for 16 samples associated with one channel may be repeated in the inner loop until the waveforms for one frame are generated, which is executed in the outer loop for each channel, thereby generating the eventual waveforms for one frame. According to the second preferred embodiment, the waveforms are generated in units of 16 samples for all channels, resulting in a high cache hit rate. However, if the CPU processing performance is low, the waveform generation for one frame may not be completed within the time of one frame. On the contrary, in the above-mentioned approach in which the inner and outer loops are exchanged, the waveforms for the channel having higher priority are first generated for one frame. Therefore, even if the waveform generation for all channels is not completed within one frame time, the channel having the higher priority is sounded. It will be apparent that these approaches coexist, in which the former approach is used for a predetermined number of channels while the latter approach is used for the remaining channels.

In the above-mentioned second preferred embodiment, the cache memory of write-through type is used. It will be apparent that the cache memory of write-back type may be used. In the write-back type, waveform update processing is enabled in the cache memory, resulting in faster waveform generation. It will be also apparent that the user can designate not only the states of connection between effect to modules but also the number and contents of these effector modules. The number of samples subjected to caching differs from CPU to CPU, so that units in which waveform generation is performed may be changed accordingly. The number of buffers for waveform generation is four, the mixA through the mixD in the above-mentioned second preferred embodiment. This corresponds to that the number of effect blocks in the subsequent stage is three. According to the number of effect blocks, the number of buffers is altered. Since the buffers for imparting the effects and the buffer for dry tones are required, the total number of buffers is set to the number of effect blocks plus one.

According to the second aspect of the invention, a music apparatus for generating musical tones by means of a software, comprises a processor that periodically works each frame period for executing the software to carry out synthesis of a set of waveform samples allotted to one frame period, a buffer having a capacity sufficient to store the waveform samples allotted to one frame period, the buffer being used as a working area by the processor for storing a temporary set of the waveform samples which are treated by the processor during the course of the synthesis and for storing a final set of the waveform samples which are obtained upon completion of the synthesis, a cache having a capacity sufficient to store a subset of the waveform samples which is an integer division of the set allotted to one frame period such that the capacity of the buffer is set to an integer multiple of the capacity of the cache, the cache being hit by the processor before the buffer is addressed by the processor so as to carry out the synthesis of each subset of the waveform samples more efficiently than that the buffer is otherwise addressed by the processor, and a converter that converts the final set of the waveform samples stored in the buffer into the musical tones.

Further, the inventive music apparatus using a processor to generate musical tones, comprises a synthesis module periodically executed by the processor at each frame period so as to carry out synthesis of a set of waveform samples allotted to one frame period, a plurality of buffers each having a capacity sufficient to store the set of the waveform samples allotted to the same frame period after the synthesis, a plurality of effector modules each being linked to a corresponding one of the buffers, each effector module being executed by the processor to carry out modification of the set of the waveform samples reserved in the corresponding buffer to create a different effect, a mixer module executed by the processor to carry out computation of one set of the waveform samples stored in one buffer with another set of the waveform samples stored in another buffer so as to mix different effects, a controller that provides an total effect algorithm for instructing the processor to execute the effector modules and the mixer module in a predetermined sequence to create a total effect which is desired mixture of the different effects, and that designates one of the buffers to store the set of the waveform samples after completion of the modification and the computation, and a converter for converting the set of the waveform samples stored in the designated buffer into the musical tones with the total effect.

Preferably, the mixer module is executed by the processor to carry out computation of adding one set of the waveform samples stored in one buffer to another set of the waveform samples stored in another buffer by a desired ratio so as to mix different effects, the set of the waveform samples being reserved in said another buffer after the computation.

Preferably, the mixer module is commonly utilized to carry out the computation between any pair of the buffers as specified by the total effect algorithm.

Preferably, the controller comprises an editor that edits the total effect algorithm to arrange the sequence by which the processor sequentially executes selected ones of the effector modules and the mixer module in a desired order to create the desired total effect.

Preferably, the inventive music apparatus further comprises a cache having a capacity sufficient to store a subset of the waveform samples which is an integer division of the set of the waveform samples allotted to one frame period such that the capacity of each buffer is set to an integer multiple of the capacity of the cache, the cache being hit by the processor before the buffer is addressed by the processor so as to carry out the synthesis of each subset of the waveform samples more efficiently than that each buffer is otherwise addressed by the processor.

The inventive method of generating musical tones according to performance information through a plurality of channels, comprises successively providing performance information to command generation of musical tones, periodically providing a trigger signal at a relatively slow rate to define a frame period between successive trigger signals, periodically providing a sampling signal at a relatively fast rate such that a plurality of sampling signals occur within one frame period, carrying out continuous synthesis in response to one trigger signal to produce a set of waveform samples of the musical tones through the plurality of channels for one frame period according to the provided performance information, accessing a buffer having a capacity sufficient to store the waveform samples allotted to one frame period, the buffer being used as a working area by the processor for storing a temporary set of the waveform samples which are treated by the processor during the course of the continuous synthesis and for storing a final set of the waveform samples which are obtained upon completion of the continuous synthesis and which are accumulated throughout the plurality of the channels, addressing a cache having a capacity sufficient to store a subset of the waveform samples which is an integer division of the set of the waveform samples allotted to one frame period, the cache being hit by the processor before the buffer is addressed by the processor so as to carry out the continuous synthesis of each subset of the waveform samples more efficiently than that the buffer is otherwise addressed by the processor, and converting each of the waveform samples reserved in the buffer as the final set in response to each sampling signal into a corresponding analog signal to thereby generate the musical tones.

The inventive method of generating musical tones according to performance information, comprises successively providing performance information to command generation of musical tones, periodically providing a trigger signal at a relatively slow rate to define a frame period between successive trigger signals, periodically providing a sampling signal at a relatively fast rate such that a plurality of sampling signals occur within one frame period, periodically executing a synthesis module at each frame period in response to each trigger signal so as to carry out synthesis of a set of waveform samples allotted to one frame period, addressing a plurality of buffers each having a capacity sufficient to store the set of the waveform samples allotted to the same frame period after the synthesis, executing a plurality of effector modules each being linked to a corresponding one of the buffers to carry out modification of the set of the waveform samples reserved in the corresponding buffers to create different effects, executing a mixer module executed to carry out computation of one set of the waveform samples stored in one buffer with another set of the waveform samples stored in another buffer so as to mix different effects, providing an total effect algorithm for instructing execution of the effector modules and the mixer module in a predetermined sequence to create a total effect which is desired mixture of the different effects, designating one of the buffers to store the set of the waveform samples after completion of the modification and the computation, and converting each of the waveform samples stored in the designated buffer in response to each sampling signal into a corresponding analog signal so as to generate the musical tones with the total effect.

The following describes an electronic musical instrument practiced as a third preferred embodiment of the present invention. Basically, the third preferred embodiment has generally the same hardware constitution as that of the first preferred embodiment shown in FIG. 1 and a software sound source operating according to the principle shown in FIG. 2, and operates according to the main flowcharts shown in FIGS. 7A and 7B.

Figure 13:
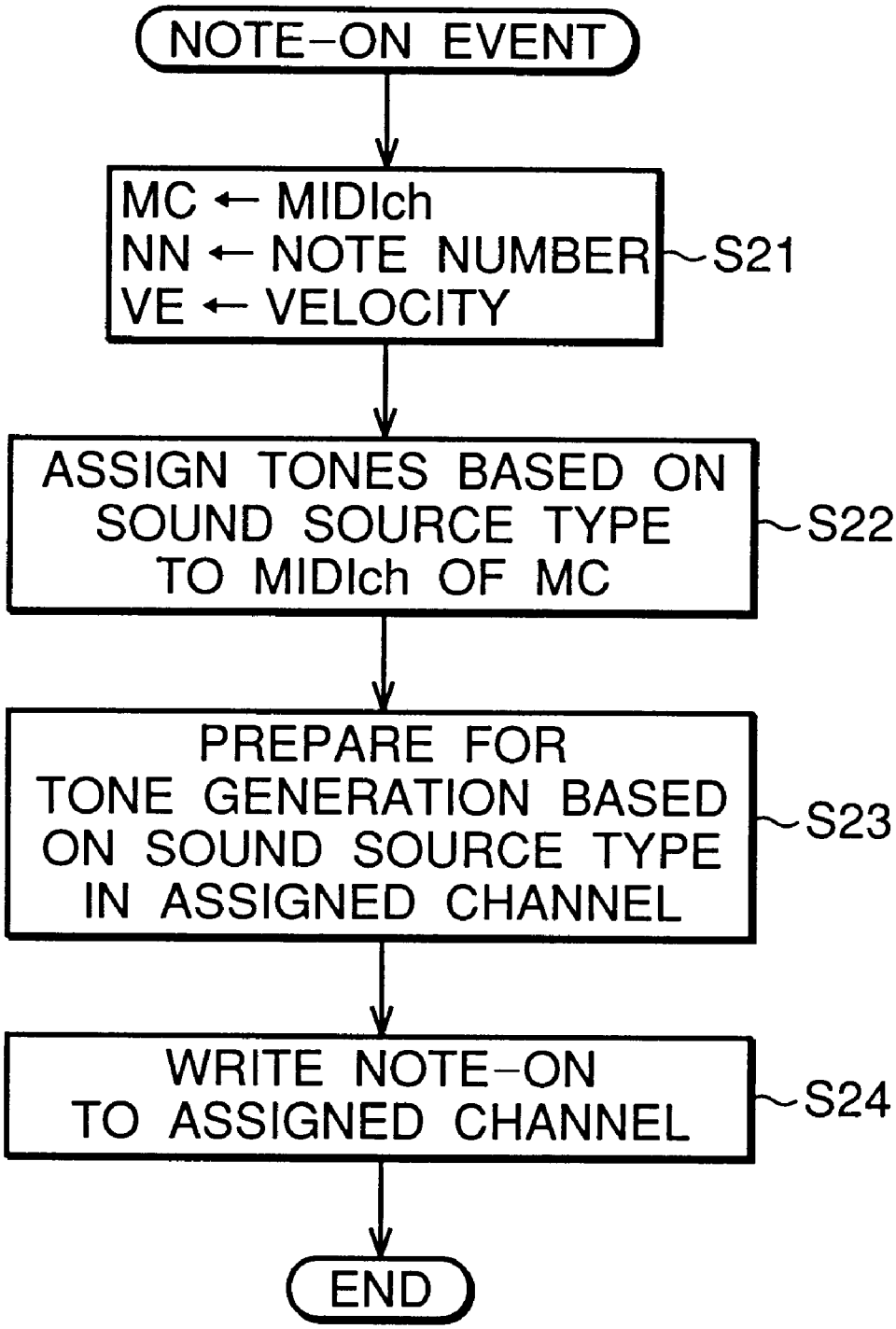
FIG. 13 shows a flowchart for explaining note-on event processing.

First, note-on event processing performed when a note-on event is inputted will be described for example of the MIDI processing of step 705 of FIG. 7A with reference to FIG. 13. If the inputted MIDI event is a note-on event, the MIDI channel number (MIDIch) allotted to the note-on event is recorded in an MC register, the note number is recorded in an NN register, and the velocity is recorded in a VE register in step S21.

In the third preferred embodiment, a timbre is selected for each MIDI channel, and each timbre parameter specifies a particular music tone generating method. Namely, each timbre parameter specifies the sound source type for generating a tone assigned to each MIDI channel. Therefore, based on the sound source type set to the MIDI channel registered in the above-mentioned MC register, tone assignment to the sounding channel concerned is performed (step S22). Next, for the sounding channel register of the sounding channel assigned in step S22, preparation is made for generating a tone having note number NN and velocity VE by the corresponding sound source type. Then in step S24, note-on is written to the sounding channel register of the sounding channel concerned. Thus, a corresponding channel is assigned when a note-on event occurs, thereby preparing the music tone generation processing based on the corresponding sound source type.

Figure 14:
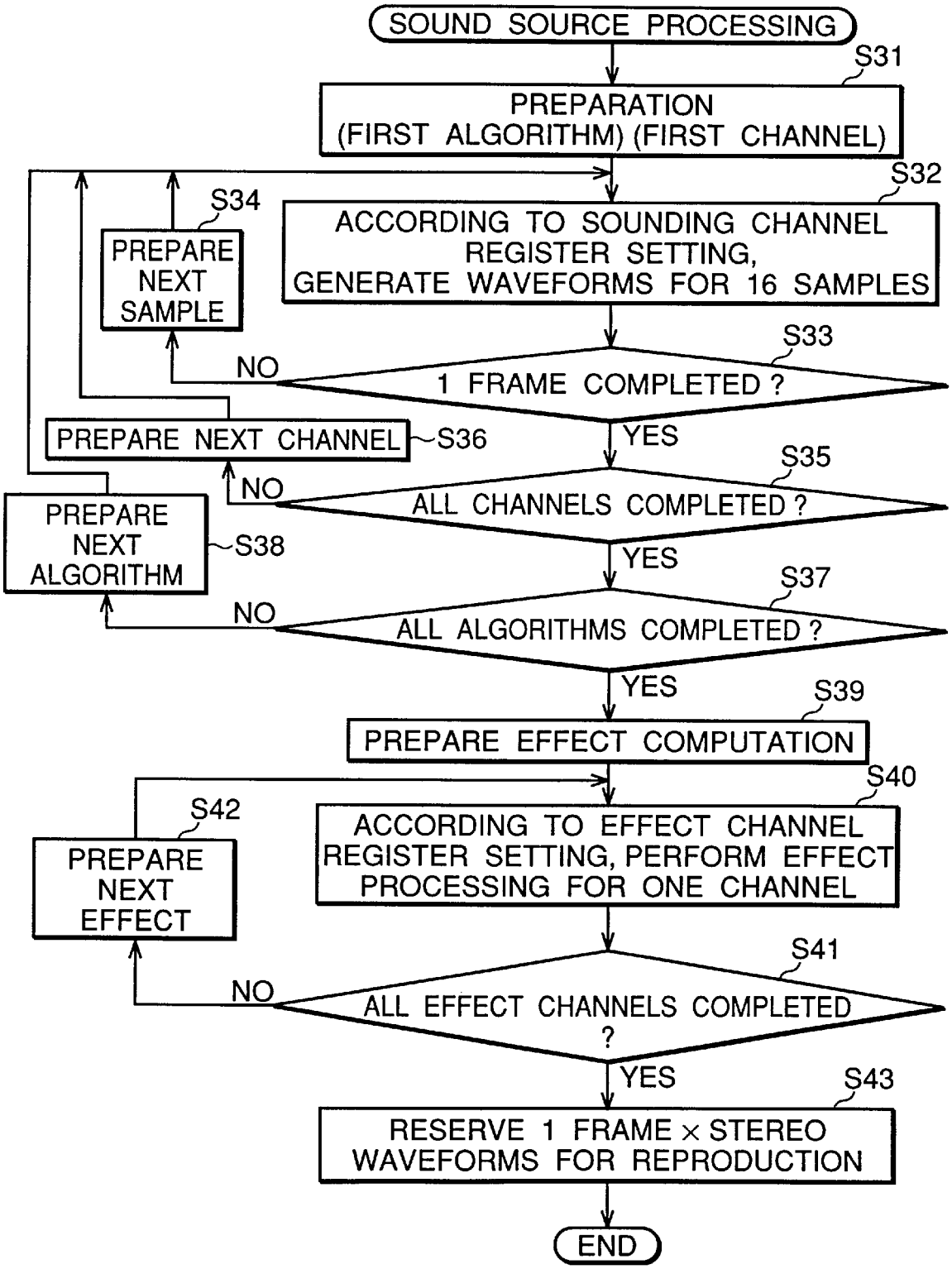
FIG. 14 shows a flowchart for explaining sound source processing.

The following describes in detail the waveform generation processing of step 706 executed in the main routine of FIG. 7A, with reference to FIG. 14. In the third preferred embodiment, this waveform generation processing is referred to as sound source processing. This sound source processing generates music tone waveform samples by computation, and provides the generated waveform samples with predetermined effects. When the trigger shown in FIG. 7A is a one-frame reproduction completion interrupt of (2) above, the sound source processing starts. First, in step S31, a preparation is made. As described before, in the music tone generating method according to the present invention, a music tone is synthesized by sound sources of a plurality of types. Hence, music tones are generated by use of one music tone synthesizing algorithm, and are collectively generated for the plurality of sounding channels. Next, music tones for sounding channels are collectively generated for the plurality of sounding channels by use of another music tone synthesizing algorithm. Thus, the music tone waveforms generated by the same program are collectively generated, thereby enhancing the hit rate of the cache, and hence increasing the processing speed. Therefore, in this preparation processing of step S31, a sounding channel is determined that first generates a music tone based on one music tone synthesizing algorithm used first, for example, PCM sound source. For silent channels currently generating no music tone, the waveform generation processing is skipped.

Next, in step S32, according to the setting of the sounding channel register for the sounding channel concerned, music tone waveform samples for 16 samples of the sounding channel are collectively generated by computation. The music tone waveform samples are collectively generated for 16 samples because one music tone waveform sample is two-byte data and 32-byte data is collectively transferred to the cache as described before. This enhances the processing speed.

Then, in step S33, it is determined whether generation of the music tone waveform samples for one frame of the sounding channel concerned has been completed. If the generation has not been completed, preparation is made for the next computation of waveform samples (step S34), and then the process goes back to step S32. If the generation has been completed and the decision of step S33 is YES, the process goes to step S35, in which it is determined whether the generation of the music tone waveform samples for one frame for all sounding channels using the first sound source algorithm has been completed.

If the decision is NO, then in step S36, preparation is made for music tone waveform generation by computation for a next channel using this ound source algorithm and the process goes back to step S32. On the other hand, if the generation of the music tone waveforms for all channels based on this algorithm has been completed, the process goes to step S37, in which it is determined whether the music tone waveform generation processing for all sound source algorithms has been completed. If a sound source algorithm not yet executed is found, the process goes to step S38, in which preparation is made for the music tone waveform generation processing using a next algorithm, and the process goes back to S32. Thus, the music tone waveform generation processing using the next algorithm starts in step S32.

When the generation of the music tone waveform samples for one frame for all corresponding sounding channels has been completed for all sound source algorithms, the decision of step S37 becomes YES, upon which step S39 is executed. Subsequent to step S39, the effect processing for the music tone waveform samples generated by computation in steps S31 through S38 is performed.

In step S39, preparation for the effect computation is made first. In this processing, the sequence of the effect processing operations to be performed is determined. It should be noted that the effect processing is skipped for the channels for which input/output levels are zero. Next, in step S40, the effect processing for one channel is performed according to the setting of the effect channel register. Thus, according to the third preferred embodiment of the invention, the effect channel register is provided for every effect processing, and an effect processing algorithm is designated for each channel register.

Then, it is determined whether the effect processing has been completed for all effect channels (step S41). If the effect processing has not been completed, preparation for next effect processing is made in step S42, and then the process goes back to step S40. On the other hand, if the effect processing has been completed, the process goes to step S43, in which reproduction of stereophonic waveforms for one frame is reserved. To be more specific, the stereophonic waveforms for one frame are transferred to the areas of the two frames for which DMAB reproduction has been completed.

Thus, the music tone waveforms are generated and outputted by software. According to the third preferred embodiment, the music tone waveforms can be generated by use of three sound source types; PCM sound source, FM sound source, and physical model sound source. Namely, according to the third preferred embodiment, the waveform generating programs and the effect programs for executing various effect processing operations are prepared corresponding to these three sound source types. Moreover, these programs use a common waveform processing subroutine to perform their processing. Thus, use of the common subroutine contributes to the reduced size of each program and the saved storage capacity of storage devices. Since the formats of various pieces of data are standardized, music tones can be synthesized by an integrated music tone generating algorithm in which various sound source types coexist.

Figure 15A:
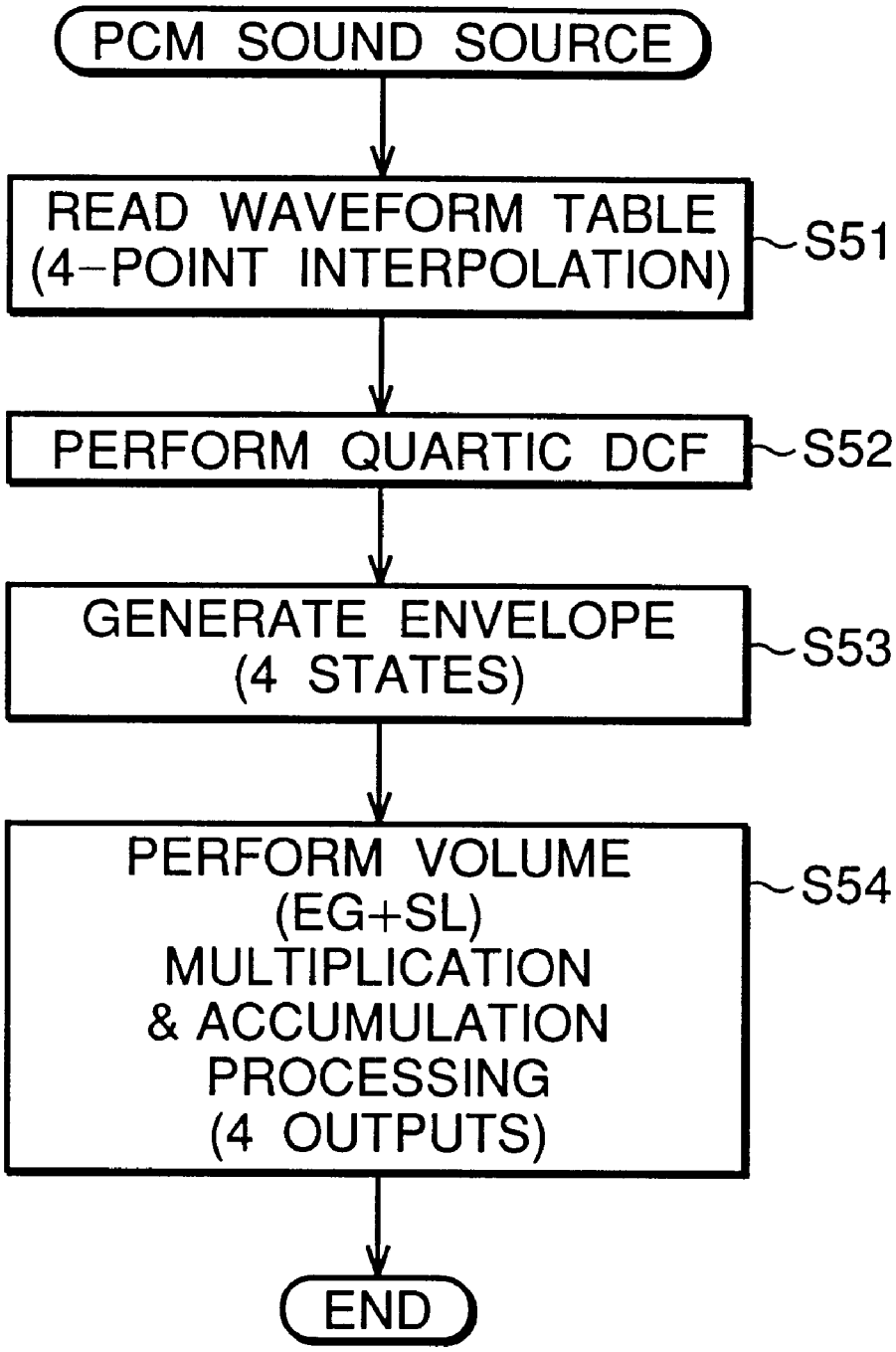
FIGS. 15A, 15B and 15C show flowcharts for explaining music tone generation processing by various sound sources.
Figure 15B:
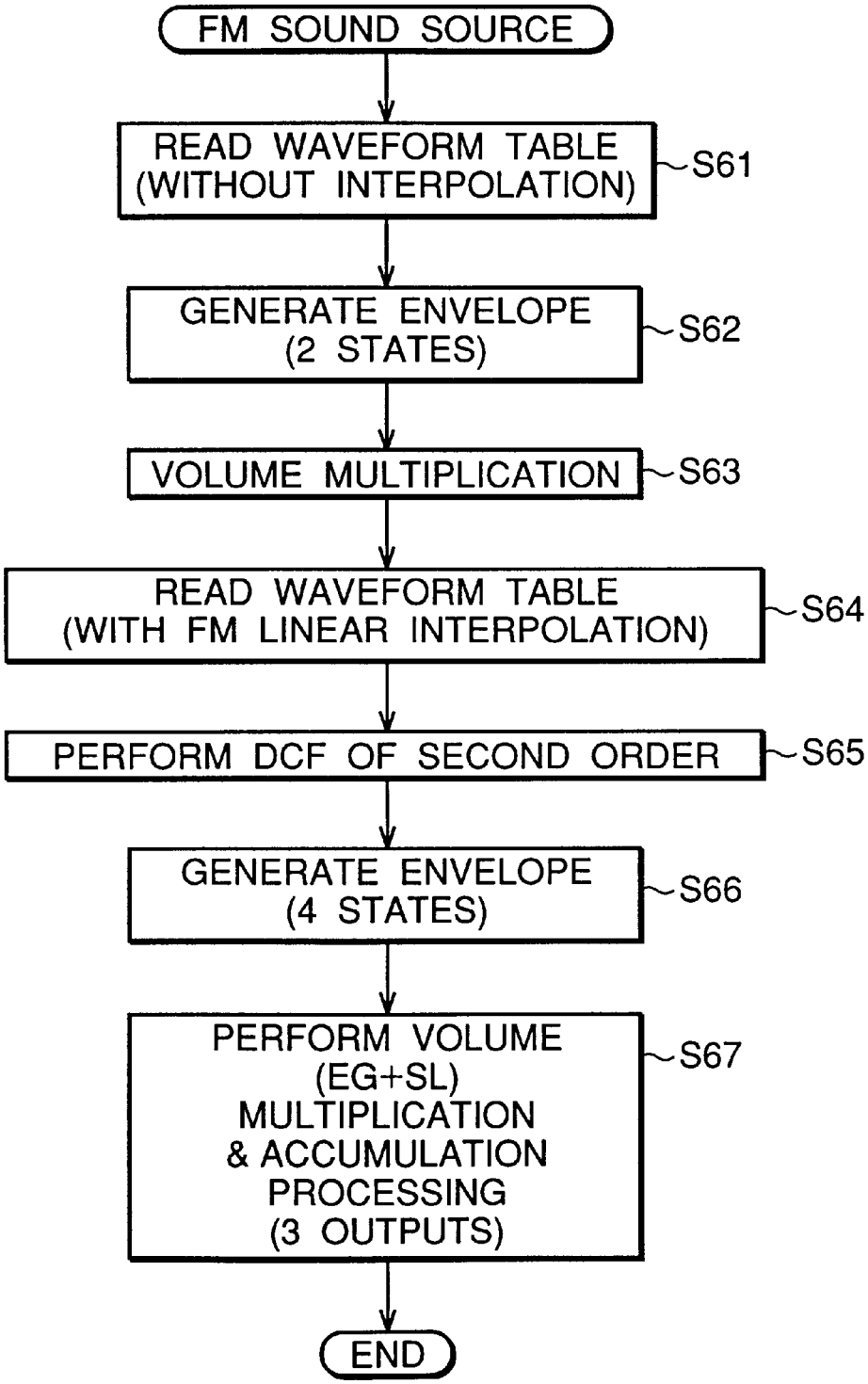
Figure 15C:
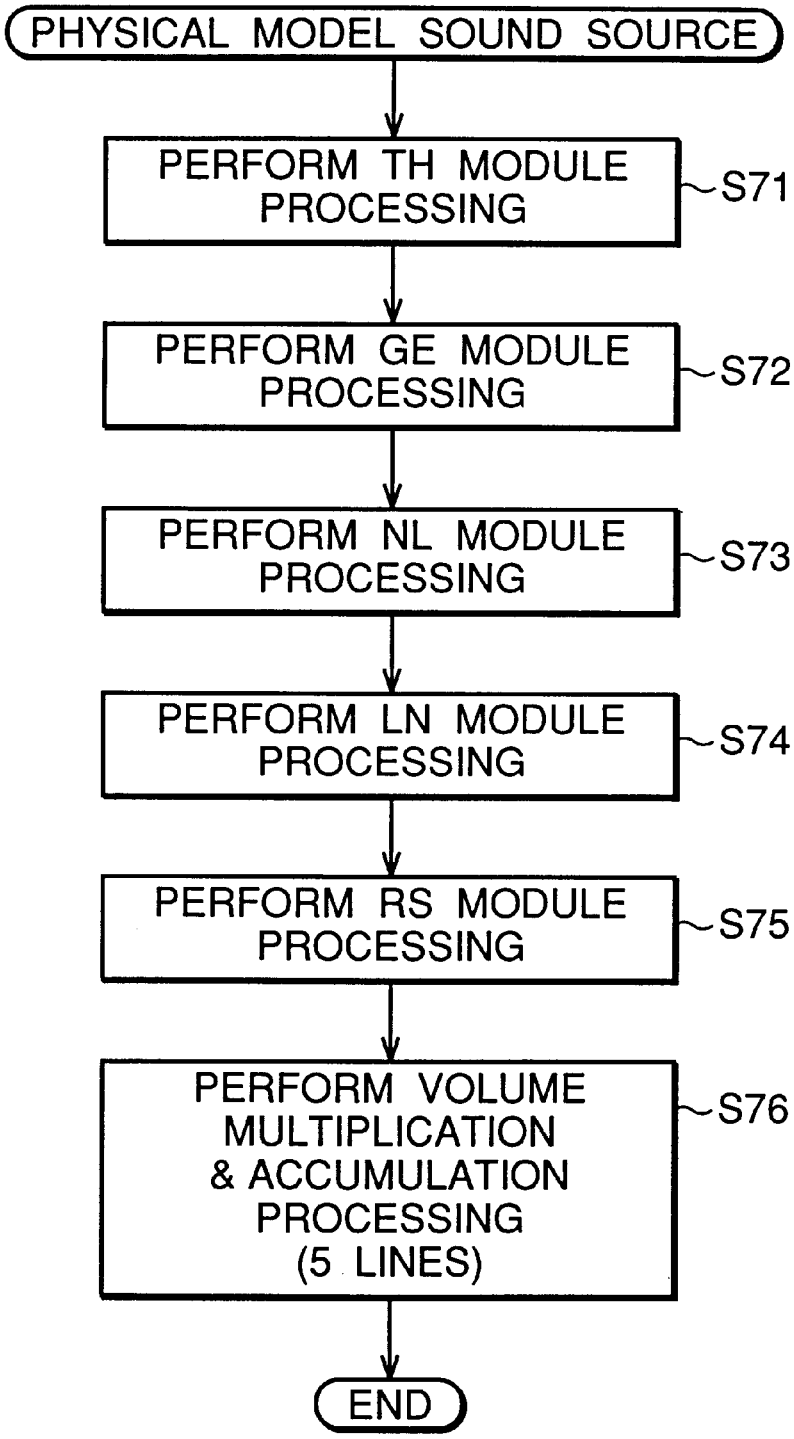

FIGS. 15A to 15C show three particular examples of the waveform generation processing for 16 samples executed in step S32 of FIG. 14. FIG. 15A denotes an example of the music tone generation processing by PCM sound source, FIG. 15B denotes an example of the music tone generation processing by FM sound source, and FIG. 15C denotes an example of the music tone generation processing by physical model sound source. In each example, when the processing is performed once, music tone waveforms for 16 samples are generated. Each step shown in FIGS. 15A to 15C denotes a waveform processing subroutine described above. Each music tone generation processing is composed of a combination of waveform processing subroutines. Therefore, some waveform processing subroutines can be used by different sound source types. That is, subroutine sharing is realized in the present embodiment.

In the music tone generation processing of the PCM sound source shown in FIG. 15A, a waveform table is first read in step S51. In the processing, a read address progressing at a speed corresponding to a note number NN is generated, waveform data is read out from the waveform table stored in the RAM 103, and the read data is interpolated by use of the fractional part of the read address. For this interpolation, two-point interpolation, four-point interpolation, six-point interpolation, and so on are available. In this example, a subroutine that performs four-point interpolation on the waveform data read from the waveform table is used in step S51. Next, in step S52, quartic DCF processing is performed in step S52. In this processing, filtering by a timbre parameter set according to velocity data and so on is performed. In this example, a quartic digital filter such as a bandpass filter is used for example.

Next, in step S53, envelope generation processing is performed. In this example, an envelope waveform composed of four states of attack, #1 decay, #2 decay, and release is generated. Then, in step S54, volume multiplication and accumulation processing is performed. In this processing, the music tone waveform read from the waveform table (step S51) and filtered (step S52) is multiplied by the envelope data generated in step S53, the resultant music tone waveform sample for each channel being accumulated into an output register and an effect register. To be more specific, the envelope waveform is added to an output transmission level by logarithmic scale and the resultant sum is logarithmically multiplied by the waveform. It should be noted that data corresponding to four registers, namely two stereophonic output registers (accumulation buffers #OL and #OR) and two effect registers (accumulation buffers #1 and #2) are outputted.

FIG. 15B shows an example of the music tone generation processing by FM sound source. In this processing, in step S61, waveform data is selectively read from a sine table, a triangular wave table, and so on at a speed corresponding to a note number NN. No interpolation is performed on the read data. Next, in step S62, an envelope waveform is generated. In this example, an envelope waveform having two states is generated. The generated envelope waveform is used for a modulator. Then, in step S63, a volume multiplication is performed. To be more specific, the envelope waveform is added to a modulation index by logarithmic scale and the resultant sum is logarithmically multiplied by the waveform data read from he waveform table, or the resultant sum is multiplied by the waveform data while converting the sum from linear to exponent.

Next, in step S64, the waveform table is read out. In this processing, the result of the above-mentioned volume multiplication is added to a phase generated such that the phase changes at a speed corresponding to the note number NN. The sine table, triangular wave table, and so on are selectively read with the integer part of the resultant sum used as an address. Linear interpolation according to the fractional part of the resultant sum is performed on the read output. Then, in step S65, quadratic digital filtering is performed on the interpolated read output. In step S66, four-state envelope generation processing is performed. This processing is generally the same as the processing of step S53 of FIG. 15A. In step S67, volume multiplication and accumulation processing is performed. In this example, the resultant data is outputted to three accumulation registers (L and R registers and an effect register).

FIG. 15C shows an example of the music tone generation processing by physical model sound source. In this processing, in step S71, TH (throat) module processing is performed for emulating the resonance of throat. In this processing, primary DCF processing and delay without one-tap interpolation are performed for example. Then, in step S72, GR (growl) module processing is performed for emulating the vibration of throat. In this processing, delay processing with one-tap interpolation is performed for example. It should be noted that the processing operations in steps 71 and 72 are not performed for a string model. Then, In step S73, NL (nonlinear) module processing is performed for emulating a breath blow-in section (for tube model) or emulating a contact between bow and string (for string model) to generate an excitation waveform. In this processing, linear DCF, quadratic DCF, referencing function table without interpolation, and referencing function table with interpolation are utilized. Next, in step S74, an LN (linear) module processing having a predetermined delay is performed for emulating the resonance of a tube (for tube model) or emulating the length of a string (for string model). In this processing, delay with two-tap interpolation, linear interpolation, and linear DCF are performed for example.

In step S75, RS (resonator) module processing is performed for emulating the resonance at an exit of tube or emulating the resonance of body (for string model).

In step S76, generally the same volume multiplication and accumulation processing as mentioned above is performed. In this example, five lines of outputs are provided.

For the constitution of these physical model sound sources, reference is made to Japanese Non-examined Patent Publication Nos. Hei 5-143078 and Hei 6-83364.

Figure 16:
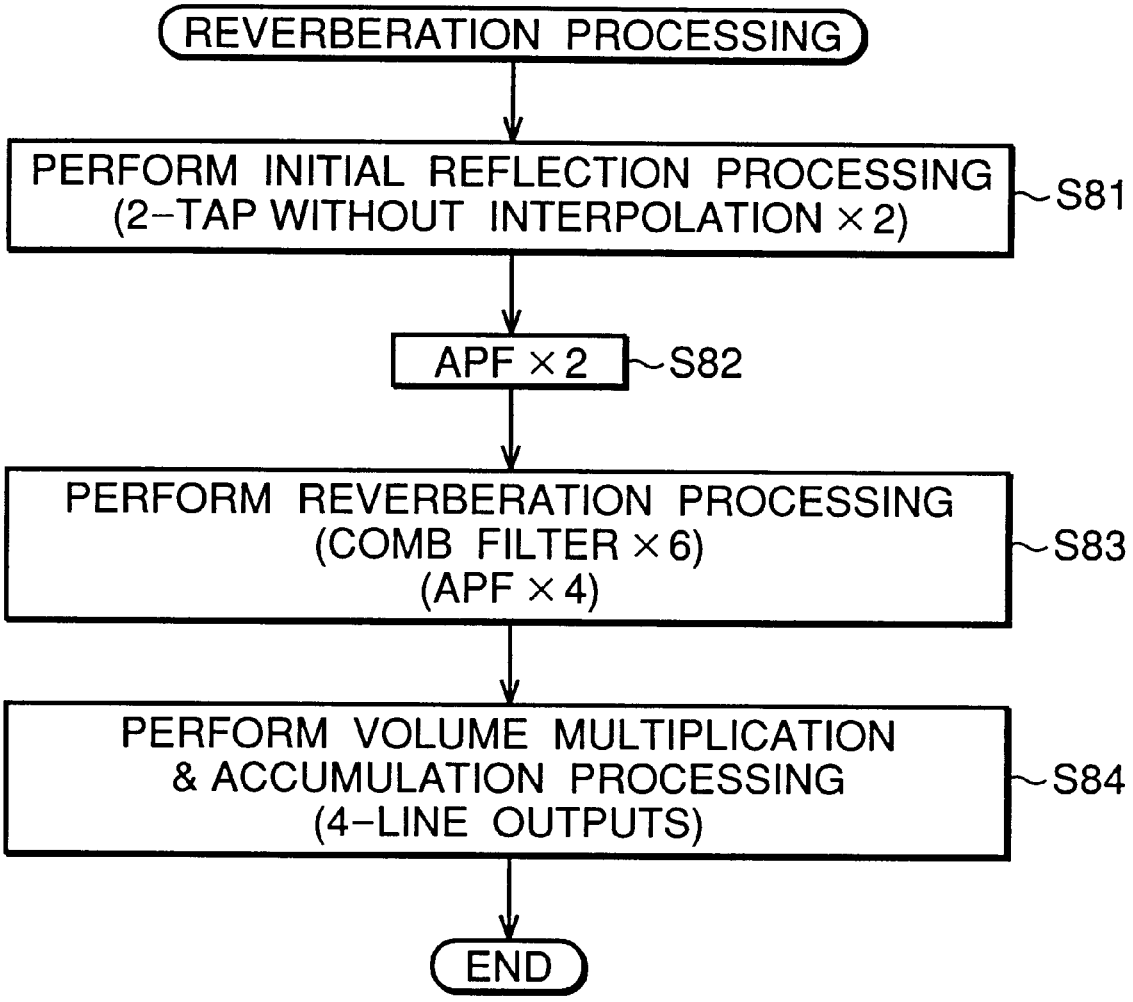
FIG. 16 shows a flowchart for explaining reverberation processing.

The following describes reverberation processing with reference to FIG. 16 as a particular example of effect processing for one channel performed in step S39 of FIG. 14. When this reverberation starts, initial reflection processing is performed in step S81. In this example, two lines of delay processing without two-tap interpolation are performed. Then, in step S82, two lines of all-pass filter processing are performed. In step S83, reverberation processing using six comb filters and four all-pass filters is performed. In step S84, generally the same volume multiplication and accumulation processing as mentioned before is performed. In this example, four lines of outputs are used.

As described in the examples shown in FIGS. 15A through 15C and FIG. 16, in the music tone generation processing and effect processing based on the above-mentioned sound source types, volume multiplication and accumulation, waveform table reading, DCF, and envelope generation are executed in common manner. Therefore, preparing these processing operations as subroutines beforehand and combining these subroutines to execute predetermined processing operations by the sound source programs can reduce a necessary storage capacity. This setup also allows music tones to be synthesized by an algorithm based on different sound source types, in which data generated by one sound source type can be used by another sound source type for music tone generation. For example, a waveform generated by PCM can be used as an excitation waveform in the physical model sound source.

The following describes the waveform processing subroutine groups shared by the above-mentioned processing operations.

(1) Subroutines associated with waveform table reading:
subroutines without interpolation, without FM interpolation, with linear interpolation, with FM linear interpolation, with four-point interpolation, and with six-point interpolation.

These subroutines perform processing for reading a waveform table prepared in RAM at a read speed designated by a note number NN or the like. These subroutines include a subroutine for providing frequency modulation on the read speed and a subroutine for performing interpolation for preventing aliasing noise form occurring. These subroutines are mainly used for PCM and FM sound sources.

(2) Subroutines associated with function table referencing:
subroutines without interpolation and with linear interpolation.

These subroutines perform processing in which a function table prepared in the RAM is referenced with waveform data as address, and values of the waveform data are converted. These subroutines are used for the physical model sound source and effect processing such as distortion.

(3) Subroutines associated with interpolation:
subroutines with linear interpolation and time interpolation.

The subroutine with linear interpolation is used for cross fading, or cross fading performed to alter delay length of delay processing in the physical model sound source. The subroutine with time interpolation is used for volume control of after-touch.

(4) Subroutines associated with filtering:
subroutines with APF (all-pass filter), linear DCF, quadratic DCF, and quartic DCF.

These subroutines are widely used for controlling the frequency characteristics and phase characteristics of music tones.

(5) Subroutines associated with comb filter:

These subroutines are mainly used for reverberation processing and in the physical model sound source.

(6) Subroutines associated with envelope generation processing:
subroutines with two-state EG, four-state EG, and so on.

The envelopes generated by these subroutines are used for controlling music tone waveform volume, filter cutoff, and pitch.

(7) Subroutines associated with volume control and output processing:
subroutines such as 1out, 2out, 3out, 4out, and 6out.

These subroutines multiply data such as the envelope for controlling music tone waveform volume by the volume data based on the transmission level classified by output lines (accumulation buffers), and accumulate the resultant volume-controlled music tone waveform data to the corresponding accumulation buffer for each output line.

(8) Subroutines associated with modulation processing:
subroutines such as one-modulation input and two-modulation input.

These subroutines modulate data such as music tone pitch and volume by a modulation waveform such as LFO waveform.

(9) Subroutines associated with LFO (Low Frequency Oscillator) processing.

(10) Subroutines associated with delay processing:
subroutines without one-tap interpolation, with one-tap interpolation, without 2-tap interpolation, and 2-tap interpolation.

These subroutines delay waveform data inputted by a time length corresponding to a specified delay length, and output the resultant delayed waveform data. For example, these subroutines are used for reverberation processing and the resonating section of the physical model sound source.

(11) Subroutines associated with mixer

These subroutines are used for the output section of a comb filter.

Figure 17:
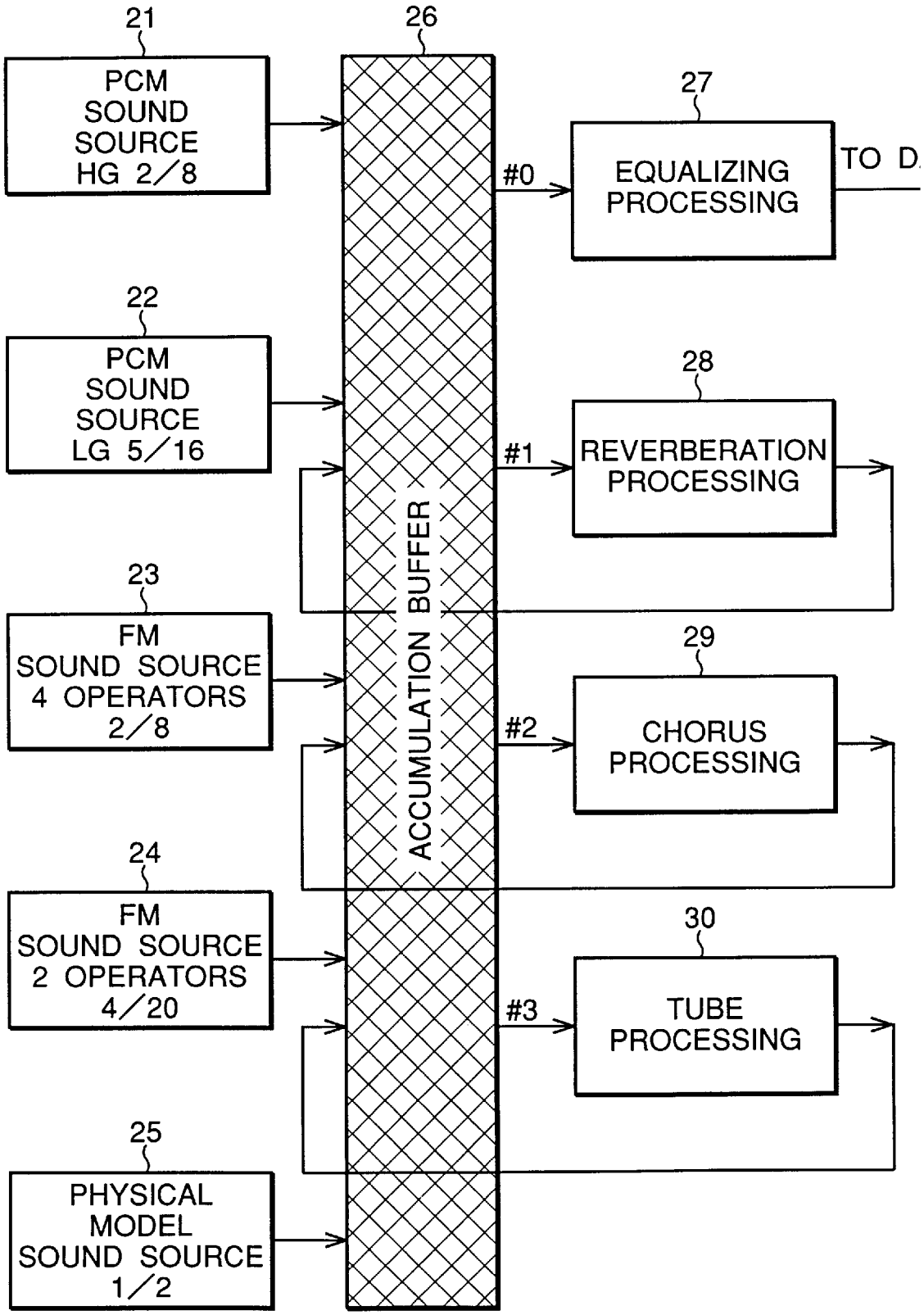
FIG. 17 is a diagram for explaining a music tone synthesizing algorithm in a music tone generating apparatus to which the present invention is applied.

The following describes, with reference to FIG. 17, an example of an overall algorithm of a music tone generator realized by the sound source processing described with reference to FIG. 14. FIG. 14 schematically shows a music tone synthesizing algorithm of a music tone generator to which the music tone generating method according to the present invention is applied. In the figure, reference numeral 21 denotes a first PCM sound source and reference numeral 22 denotes a second PCM sound source, the first PCM sound source 21 functionally precedding the second PCM sound source 22. Reference numeral 23 denotes a first FM sound source having four operators, reference numeral 24 denotes a second FM sound source having two operators, and reference numeral 25 denotes a physical model sound source. Thus, the illustrated music tone generator has five sound sources based on different methods (different sounding algorithms), and is realized by the processing of steps S31 through S38 shown in FIG. 14. The PCM sound source 21 corresponds to the routine of FIG. 15A. The FM sound source 24 corresponds to the routine of FIG. 15B. The physical model sound source 25 corresponds to the routine of FIG. 15C.

It should be noted in the figuer that the numbers on both sides of a slash (/) denote the number of channels being sounded/the maximum number of channels. For example, 2/8 in the first PCM sound source 21 denotes that the maximum number of channels of this PCM sound source is eight, of which two channels are current sounded.

Reference numeral 26 denotes an accumulation buffer (a mixer buffer) composed of four buffers #0 through #3. The accumulation buffers #0 and #3 are of stereophonic constitution, having the L channel section and the R channel section, respectively. The music tone waveform outputs from the sound sources 21 through 25 and the outputs of effect processing routines are written to these accumulation buffers. This writing is performed by accumulating the music tone waveform samples generated by each sounding channel or the music tone waveform samples attached with an effect to each accumulation buffer at a storage position corresponding to each sampling timing. In this writing, mixing of a plurality of music tone waveforms is also performed. In this example, the #0 accumulation buffer is used as an output buffer, the output thereof being equalized by equalizing processing 27 and then being outputted to a DAC.

The equalizing processing 27, reverberation processing 28, chorus processing 29, and tube processing 30 (for attaching vacuum tube characteristics, providing the same effect as distortion) are examples of the effect processing. These four effect processing operations are realized by steps S39 through S42 of FIG. 14. Further, the reverberation processing 28 corresponds to the reverberation processing described before with reference to FIG. 16. In each of these effect processing operations, the effect processing operation is performed on the inputs of the accumulation buffers #1 through #3 and the effect added output is written to at least one of these accumulation buffers #0 through #3.

Figure 18:
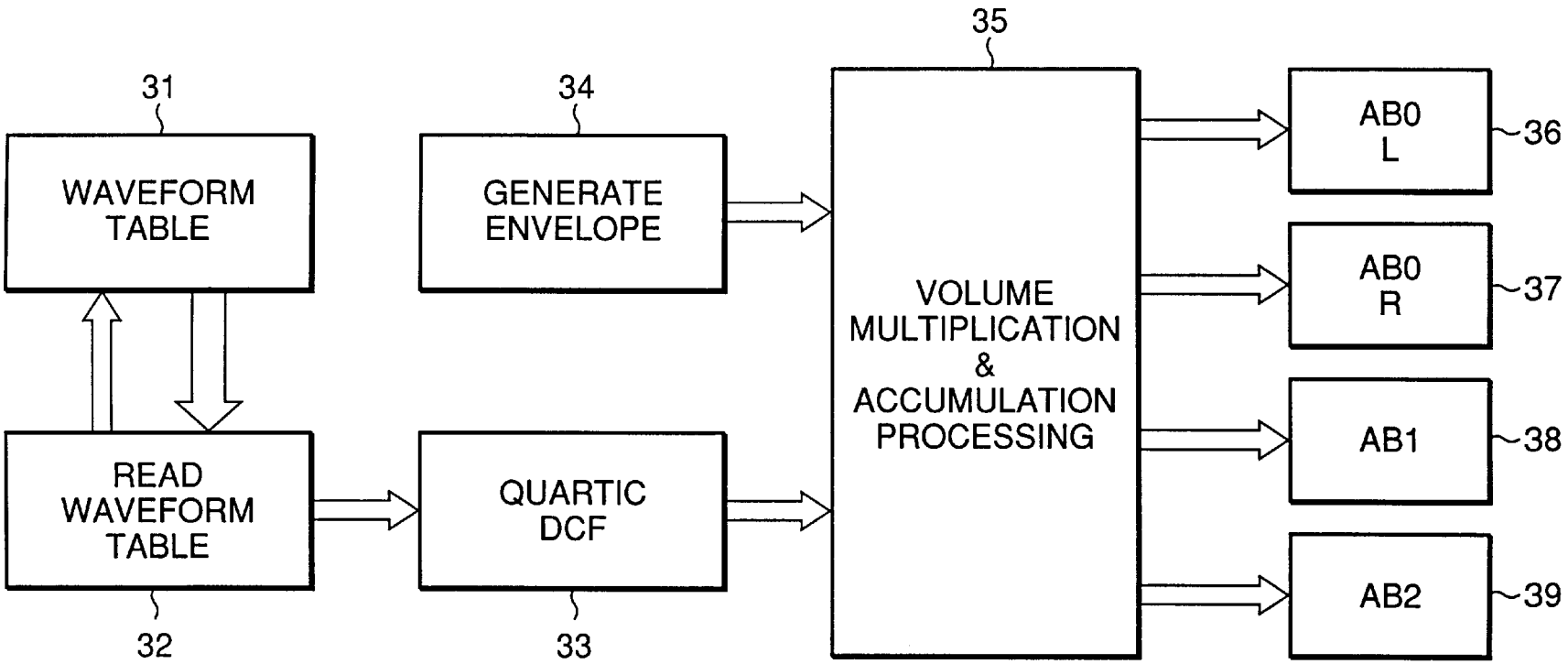
FIG. 18 is a diagram for explaining an algorithm of PCM sound source.

The following describes the algorithm of the above-mentioned sound sources 21 through 25 by using the PCM sound source, for example. FIG. 18 schematically illustrates a sounding algorithm of the above-mentioned PCM sound source (corresponding to FIG. 15A) for example. In the figure, reference numeral 31 denotes a waveform table, reference numeral 32 denotes a waveform table reading section (with four-point interpolation), reference numeral 33 denotes a quartic DCF section, reference numeral 34 denotes an envelope generating section, and reference numeral 35 denotes volume multiplication and accumulation processing section. Reference numerals 36 through 39 denote accumulation buffer sections, and reference numerals 36 and 37 denote an L channel section and an R channel section, respectively, of an output buffer corresponding to the #0 buffer of the above-mentioned accumulation buffer 26. Reference numerals 38 and 39 denote accumulation buffers corresponding to the #1 buffer and the #2 buffer, respectively, of the above-mentioned accumulation buffer 26.

In the PCM sound source having the above-mentioned algorithm, the waveform table reading section 32 (corresponding to step S51) generates a read address that progresses according to a note number NN. Based on the integer part thereof, waveform data is read out and, according to the fractional part, four-point interpolation is performed. The output of this section is filtered by the quartic DCF 33 (corresponding to step S52),and is then inputted in the volume multiplication and accumulation processing 35 (corresponding to step S54). Envelope data generated by the envelope generator 34 (corresponding to step S53) is also inputted in the volume multiplication and accumulation processing section 35. The above-mentioned waveform data, the envelope data, and the transmission level data classified by accumulation buffer are multiplied by each other, the multiplication results being inputted in the specified accumulation buffers, respectively. To be more specific, the music tone waveform data of a sounding channel on which no effect processing is performed is accumulated to the accumulation buffers 36 and 37 after being volume-controlled according to the envelope and the levels of the direct L and R outputs. The music tone waveform data of a sounding channel on which effect processing is performed is accumulated to the accumulation buffer 38 or 39 after being volume-controlled according to the envelope and the level of transmission to each effect.

Figure 19:
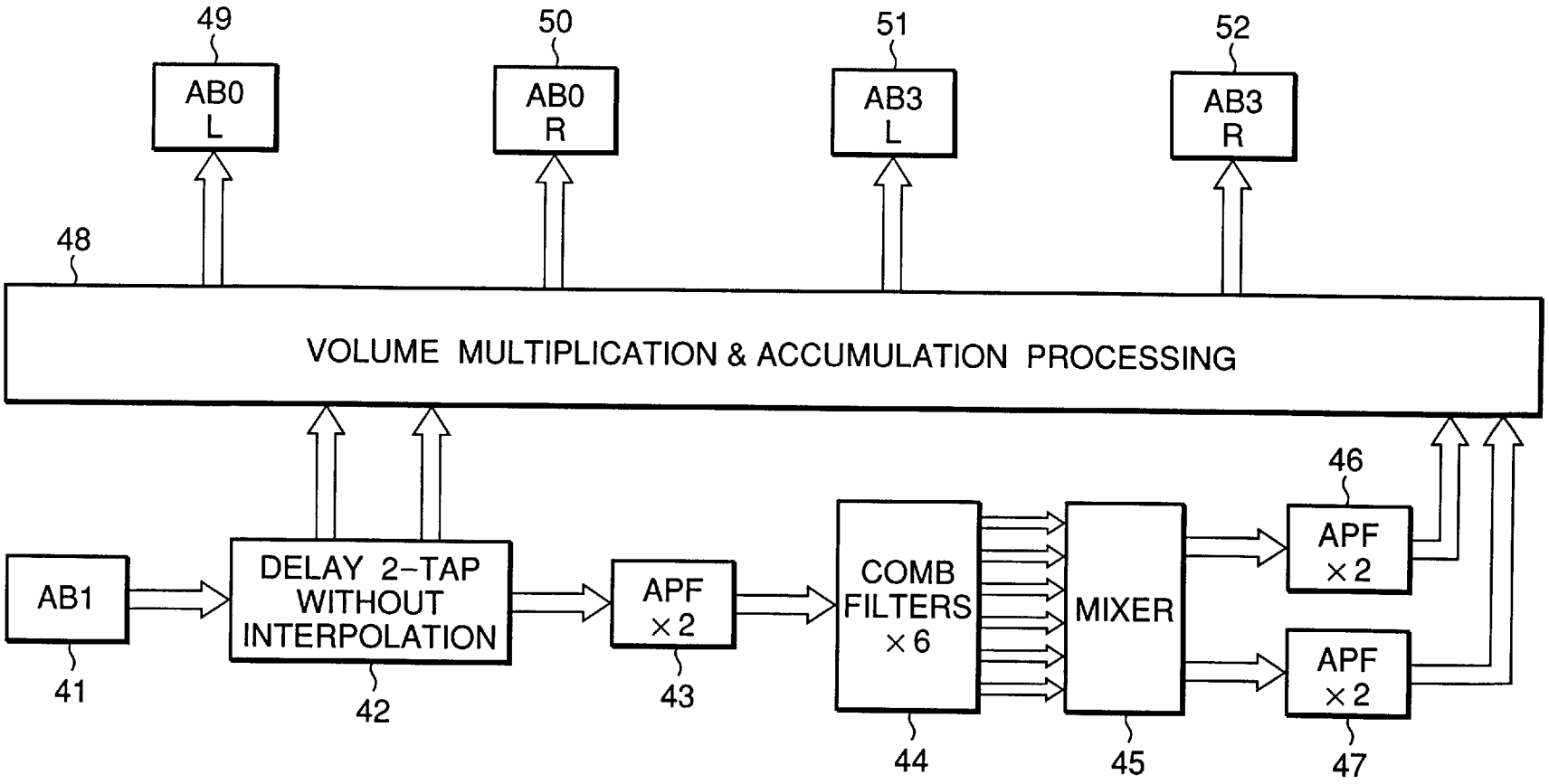
FIG. 19 is a diagram for explaining an algorithm of reverberation processing.

The following describes an effect algorithm of the above-mentioned effect processing section by using the reverberation processing 28 (corresponding to step 16) as an example. FIG. 19 schematically illustrates an algorithm in the above-mentioned reverberation processing 28. In the figure, reference numeral 41 denotes an accumulation buffer corresponding to the above-mentioned #1 buffer, and reference numeral 42 denotes a delay section (corresponding to step S81) representative of an initial reflective sound, which is a delay section without two-tap interpolation. Reference numeral 43 denotes two lines of all-pass filters (corresponding to step S82), reference numeral 44 denotes six lines of comb filters arranged in parallel, reference numeral 45 denotes a mixer for mixing the outputs of the comb filters 44 to generate outputs of the two channels L and R, and reference numerals 46 and 47 denote two lines of all-pass filters in each of which the output of the mixer 45 is inputted. These six lines of comb filters 44, mixer 45, and two lines of all-pass filters 46 and 47 correspond to the above-mentioned step S83. The outputs of these components are inputted in the volume multiplication and accumulation processing section 48 (corresponding to step S84).

In the volume multiplication and accumulation processing section 48, the output of the delay section 42 is mixed with the outputs of the all-pass filter 46 and 47 at a predetermined level, the mixed outputs being accumulated to the corresponding accumulation buffers 49 through 52. Reference numerals 49 and 50 denote an L channel section and an R channel section of the same accumulation buffer #0 for output as the above-mentioned accumulation buffers 36 and 37. The music tone waveform outputted after being attached with reverberation is written to these accumulation buffers. Reference numerals 51 and 52 denote accumulation buffers corresponding to the right and left channels, respectively, of the #3 of the above-mentioned accumulation buffer 26. The reverberated music tone waveform data on which another effect (for example, tubing) is performed is written to these buffers. It should be noted that the attaching of another effect is performed by using the outputs of the accumulation buffers 51 and 52 as the input.

Figure 20:
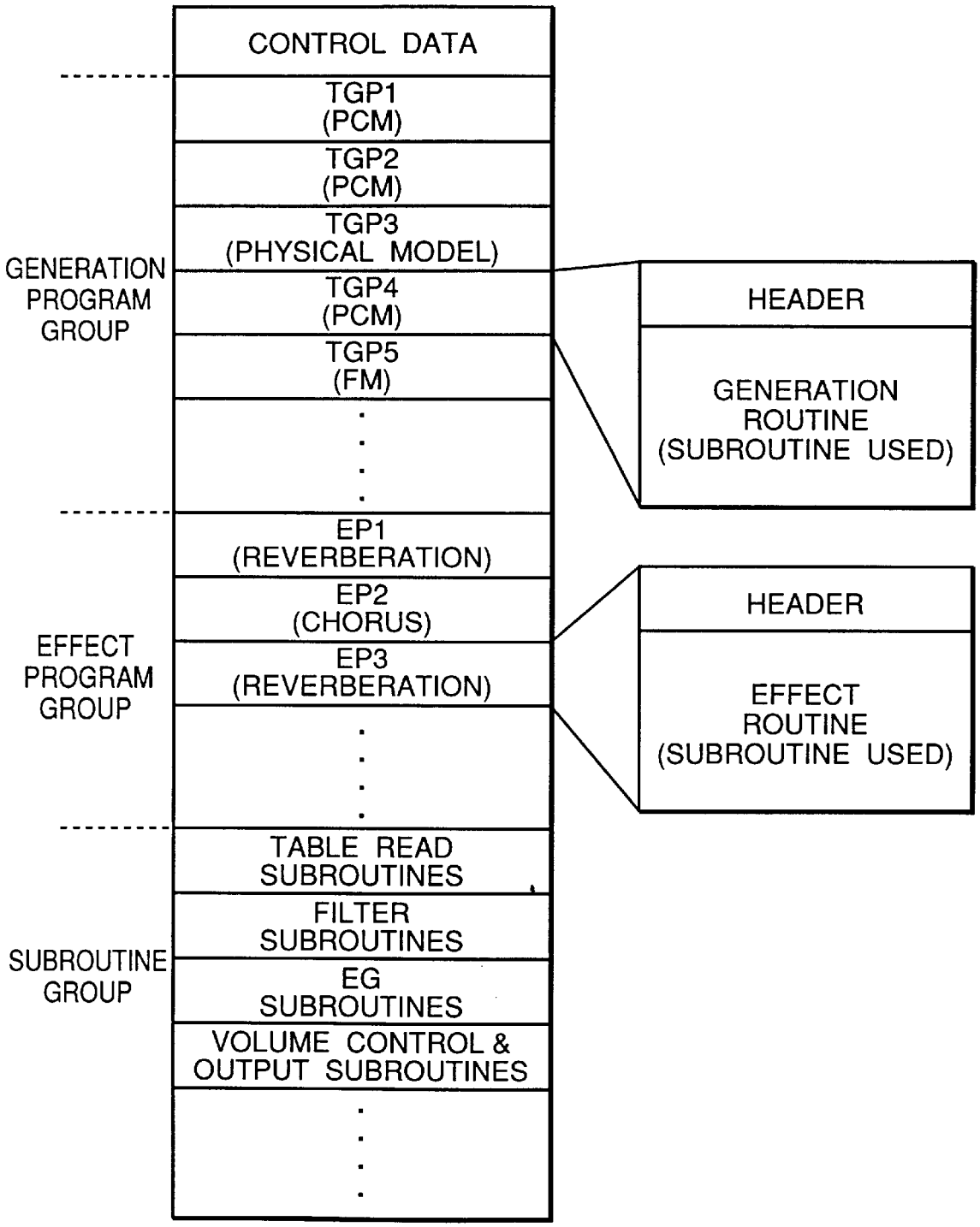
FIG. 20 is a diagram illustrating an example of memory map.

As described, in the music tone generating method according to the present invention, the waveform generating programs and the effect processing programs based on the various sound source types are constituted by common waveform processing subroutines. The following describes how these programs are stored in memory by using a memory map of the RAM 103 shown in FIG. 20 for example. It should be noted that control data is held in an area where the contents of these programs are written. Below the control data, the waveform generating programs (TGPs) are stored sequentially. As shown in the figure, the waveform generating programs required for this music performance are sequentially stored; namely, the waveform generating program TGP1 providing the first PCM sound source, the waveform generating program TGP2 providing the second PCM sound source, the waveform generating program TGP3 providing the physical model sound source, the waveform generating program TGP4 providing the third PCM sound source, the waveform generating program TGP5 providing the FM sound source, and so on. The three flowcharts shown in FIGS. 15A to 15C are specific examples of these waveform generating programs. As shown, each waveform generating program is composed of a header part and a generating routine part. The header part stores a name, characteristics, and parameters of this program, and the generating routine part stores a waveform generating routine using above-mentioned waveform processing subroutines.

Following the waveform generating programs, effect programs (EP) are stored. In this area, the programs for performing a variety of effect processing operations are stored. In the illustrated example, EP1 for reverberation processing, EP2 for chorus processing, EP3 for reverberation processing, and so on are stored in this order. The reverberation processing shown in FIG. 16 is a specific example of this effect program EP. Each of these effect programs is composed of a header part and an effect routine part as shown. The header part stores a name, characteristics, and parameters of this effect processing, and the effect routine part stores an effect routine using various waveform processing subroutines.

Following the effect programs, the waveform processing subroutines are stored. As shown, the above-mentioned waveform processing subroutines are stored in this area as classified by processing contents. In this example, the subroutines associated with table reading come first. Stored thereafter are the subroutines associated with filter processing, the subroutines associated with EG processing, and the subroutines associated with volume control and accumulation processing in this order. In this area, only the waveform processing subroutines actually used by the above-mentioned waveform generating programs TGPs or the effect programs EPs may be stored. On the other hand, all waveform processing subroutines including the other waveform subroutines are basically stored in the above-mentioned hard disk 110. Alternatively, all waveform processing subroutines may be supplied from the external storage medium 105 or another computer via a network.

As described, in the music tone generating method according to the present invention, the waveform processing subroutines are shared by the sound source programs, so that the user can select any waveform processing routines to edit the sounding algorithm of the sound source programs (music tone generation processing). The following describes these selecting and editing operations, or the setting processing. It should be noted that these operations are performed in the other processing of step 707 of the main routine shown in FIG. 7A.

Figure 21:
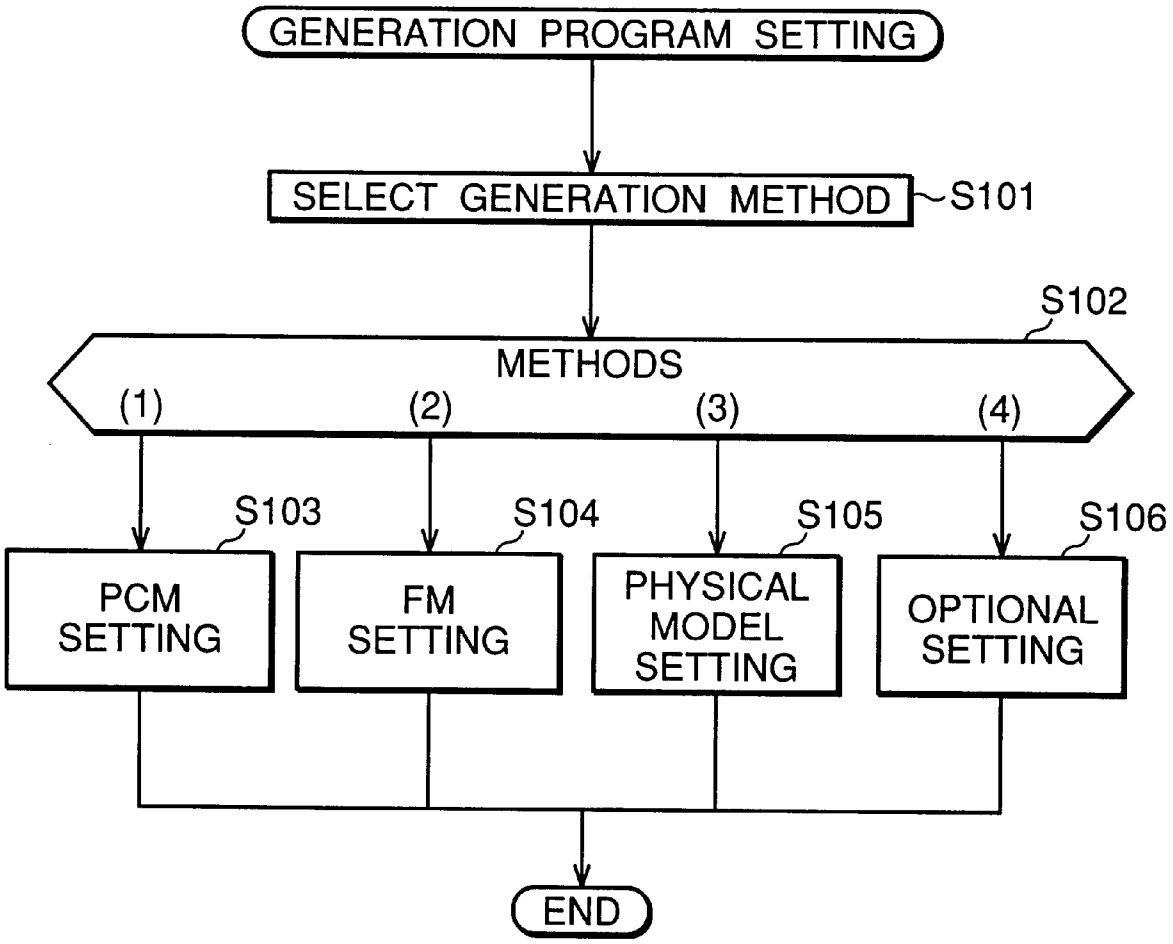
FIG. 21 is a diagram for explaining setting of a waveform generating program.

FIG. 21 is a flowchart for describing the above-mentioned setting processing. This setting processing starts when the operating for waveform generating program setting is performed by the user. First, in step S101, the user selects a waveform generating method. Next, in step S102, according to the selected waveform generating method, the process branches to PCM setting processing S103, FM setting processing S104, physical model setting processing S105, or any setting processing S106. Then, the setting processing to which the process branched is performed.

Figure 22:
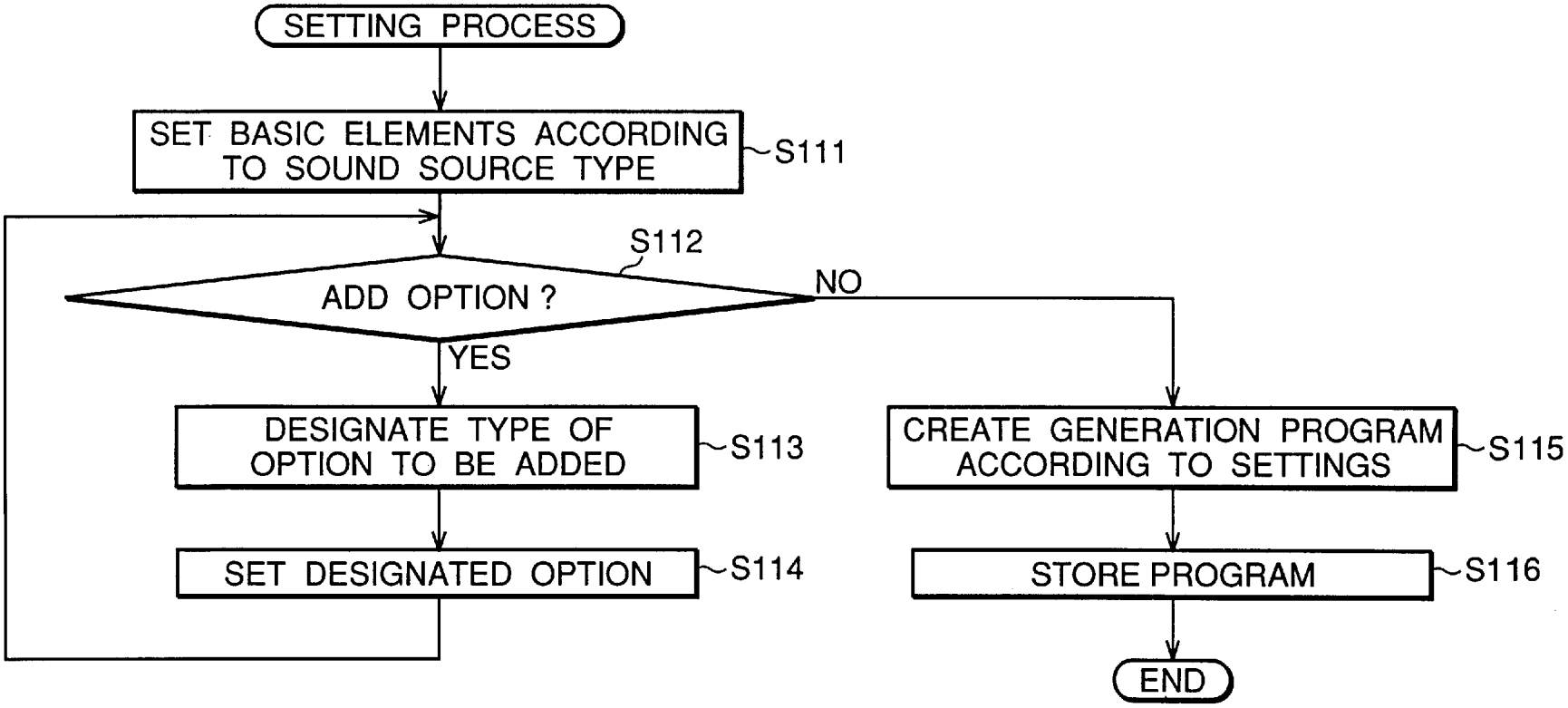
FIG. 22 is a diagram for explaining setting processing.

FIG. 22 illustrates the outline of the setting processing executed in the above-mentioned setting processing at S103 through S106. When the above-mentioned setting processing is started, basic elements according to each sound source type are set in step S111. This setting of the basic elements will be described later. Next, in step S112, the user determines whether there is an additional option. If yes, the process goes to step S113, in which the type of the option to be added is designated. In step 114, the processing for setting the designated option is performed. Then, back in step S112, the user determines whether there is another option to be added. Thus, the user can alter the generator algorithm in various ways such as adding filtering processing to the waveform data read from the waveform table and adding throat, growl, or resonator in the physical model sound source, by way of example.

When there is no option added, the process goes to step S115, the various waveform generating programs set in the basic element setting processing of step S111 and the option setting processing of step S114 are generated and, in step S116, the generated waveform generating programs are stored in memory. It will be apparent that, in the program generating processing of step S115, the necessary waveform generating programs may be selected from a mass storage medium such as a CD-ROM in which many waveform generating program are stored, instead of generating programs according to the above-mentioned setting.

Figure 23A:
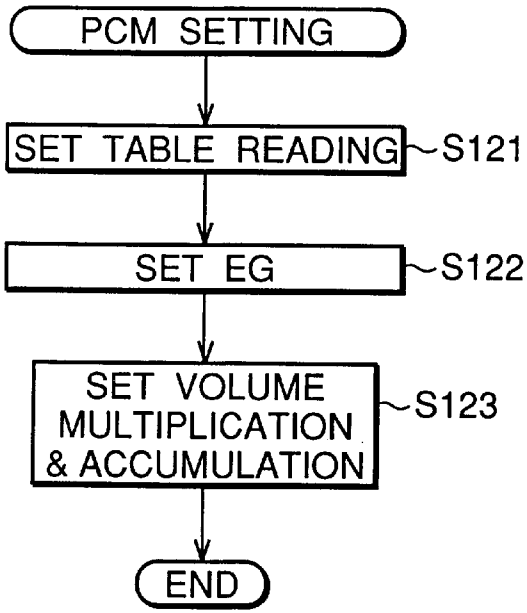
FIGS. 23A, 23B and 23C are flowcharts for explaining setting of basic elements in various sound sources.
Figure 23B:
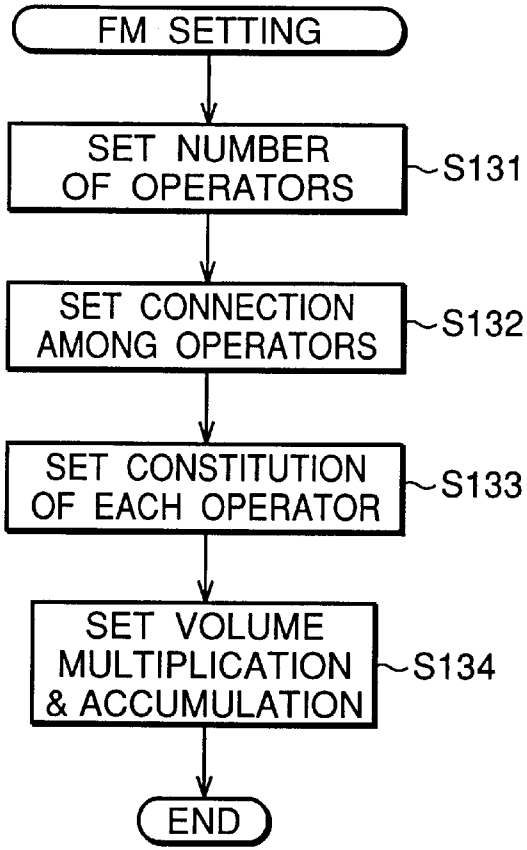
Figure 23C:
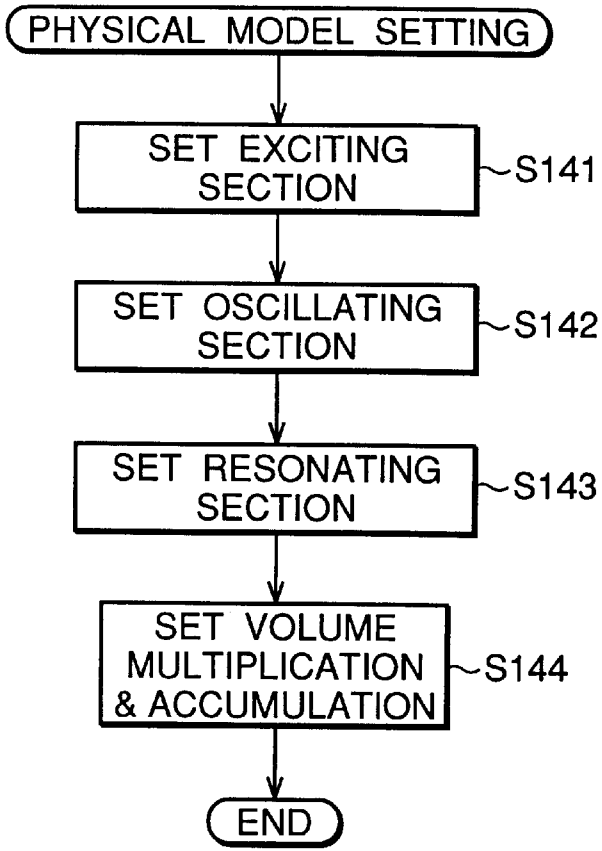

The following describes the basic element setting processing corresponding to each sound source type. FIGS. 23A to 23C illustrate a flowchart of this basic element setting processing, FIG. 23A indicating the basic element setting processing in the PCM method, FIG. 23B indicating the basic element setting processing in the FM method, and FIG. 23C indicating the basic element setting processing in the physical model method. In the PCM method, setting associated with table reading processing is performed in step S121. In step S122, EG setting is performed. In step S123, volume multiplication and accumulation processing is set. In steps S121 through S123, the user selects desired waveform processing subroutines from the subroutine group corresponding to each basic element setting processing.

In the FM method, the number of operators is set in step S131 as shown in FIG. 23B. Next, in step S132, the connection between the operators is set. In step S133, the constitution of each operator is set. In step S134, volume multiplication and accumulation processing is set.

In he physical model sound source, as shown in FIG. 23C, an exciting section is set first in step S141. Next, in step S142, an oscillating section is set. In step S143, a resonating section is set. In step S144, the volume multiplication and accumulation processing section is set.

The above-mentioned waveform generating program setting processing can easily generate, for example in the PCM sound source processing shown in FIG. 15A , a waveform generating program (music tone generation processing) that has an algorithm added with vibrato processing by LFO or a sounding algorithm with a desired order or a desired number of output lines of the filter.

Figure 24:
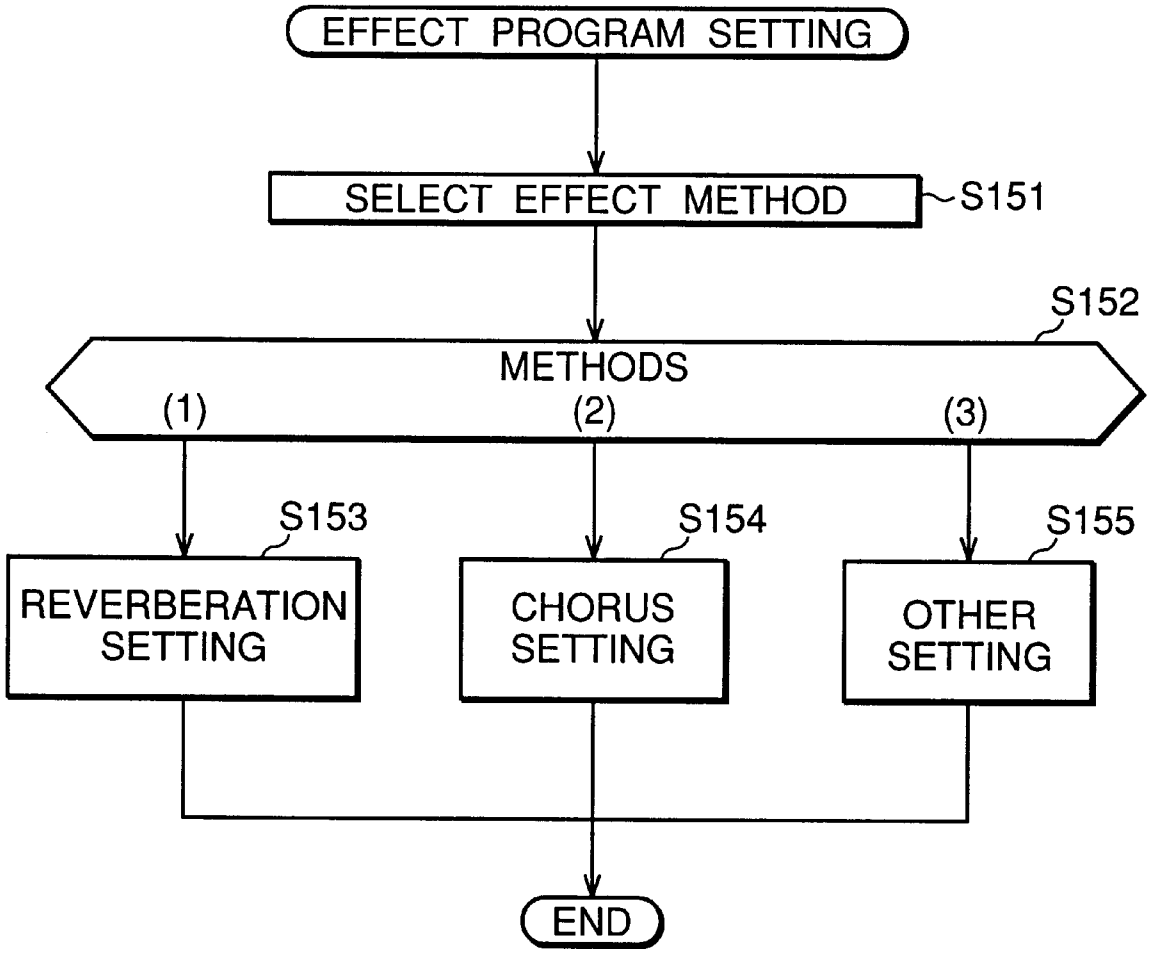
FIG. 24 is a flowchart for explaining setting of an effect program.

The following describes the effect program setting processing with reference to FIG. 24. In setting effect processing, the user first selects an effect method to be used in step S151. Next, in step S152, the process branches to the corresponding processing according to the method selected in step S152. For example, if the selected effect is reverberation, the reverberation setting processing of step S153 is performed; if the selected effect is chorus, the chorus setting processing of step S154 is performed; and if the selected effect is others, the corresponding setting processing is performed in step S155. It should be noted that these setting processing operations are basically the same as those of the generator programs mentioned above, so that no further description will be made thereof.

The above-mentioned effect program setting processing can easily generate, for example in the reverberation processing shown in FIG. 16, an effect program that has an effect algorithm with a desired number of initial reflections or an effect algorithm with a desired number of reverberation comb filters.

It should be noted that "waveform processing subroutine" referred to herein denotes a subroutine having capabilities of performing predetermined waveform generation and waveform manipulation characteristic to music tone generation and effect processing, rather than a simple subroutine for performing arithmetic operations.

In the description made so far, the generator programs and effect programs that have been set are not changed during the music performance processing period. It will be apparent that the waveform generating algorithm or the effect algorithm may be automatically altered to waveform processing subroutines of less load according to the total load of the sound source.

According to the third aspect of the invention, a method using a processor for generating musical tones through groups of channels according to performance information, comprises the steps of loading a first synthesis program prepared for a first group of channels and a second synthesis program prepared for a second group of channels together with a subroutine program utilized commonly for both of the first synthesis program and the second synthesis program, successively providing performance information to command generation of musical tones, periodically providing a trigger signal at a relatively slow rate to define one frame period between successive trigger signals, periodically providing a sampling signal at a relatively fast rate such that a plurality of sampling signals occur within one frame period, executing the first synthesis program by the processor at one frame period so as to carry out synthesis of each set of waveform samples allotted to one frame period through each channel of the first group such that the subroutine program runs to process the waveform samples during the synthesis, each set of the waveform samples being reserved in a buffer after the synthesis, executing the second synthesis program by the processor at one frame period so as to carry out synthesis of each set of waveform samples allotted to one frame period through each channel of the second group such that the subroutine program runs to process the waveform samples during the synthesis, each set of the waveform samples being reserved in a buffer after the synthesis, and converting each of the waveform samples reserved in the buffer in response to each sampling signal into a corresponding analog signal so as to generate the musical tones.

Preferably, the step of loading includes selecting at least one of subroutine programs which are designed for reading out waveform samples from a wave table, for filtering the waveform samples to modify the music tones, for creating an envelope of the waveform samples, for controlling an amplitude of the waveform samples, and for accumulating each set of the waveform samples into the buffer.

Preferably, the step of loading includes loading the selected subroutine program from a secondary memory into a primary memory which is used as a working area of the processor.

Preferably, the inventive method further includes the step of addressing a cache having a capacity sufficient to store a subset of the waveform samples which is a division of the set of the waveform samples allotted to one frame period, the cache being hit by the processor before the buffer is addressed by the processor while the processor runs the subroutine program to process each subset of the waveform samples.

The inventive method using a processor for generating musical tones through groups of channels according to performance information, comprises the steps of loading a first synthesis program prepared for a first group of channels and a second synthesis program prepared for a second group of channels, successively providing performance information to command generation of musical tones, periodically providing a trigger signal at a relatively slow rate to define one frame period between successive trigger signals, periodically providing a sampling signal at a relatively fast rate such that a plurality of sampling signals occur within one frame period, executing the first synthesis program by the processor at one frame period so as to carry out synthesis of each set of waveform samples allotted to each channel of the first group such that each set of the waveform samples belonging to the first group is preceding reserved in a buffer, executing the second synthesis program by the processor at the same frame period so as to carry out synthesis of each set of waveform samples allotted to each channel of the second group such that each set of the waveform samples belonging to the second group is succeeding reserved in a buffer after each set of the waveform samples belonging to the first group is reserved, and converting each of the waveform samples reserved in the buffer in response to each sampling signal into a corresponding analog signal so as to generate the musical tones.

The inventive method using a processor for generating musical tones according to performance information, comprises the steps of loading a synthesis program and an effector program together with a subroutine program utilized commonly for both of the synthesis program and the effector program, successively providing performance information to command generation of musical tones, periodically providing a trigger signal at a relatively slow rate to define one frame period between successive trigger signals, periodically providing a sampling signal at a relatively fast rate such that a plurality of sampling signals occur within one frame period, executing the synthesis program by the processor at one frame period so as to carry out synthesis of a set of waveform samples allotted to one frame period such that the subroutine program runs to process the waveform samples during the synthesis, the set of the waveform samples being reserved in a buffer after the synthesis, executing the effector program by the processor at one frame period so as to carry out modification of the set of the waveform samples reserved in the buffer to create a desired effect such that the subroutine program runs to process the waveform samples during the modification, each set of the waveform samples being reserved in a buffer after the modification, and converting each of the waveform samples reserved in the buffer in response to each sampling signal into a corresponding analog signal so as to generate the musical tones together with the desired effect.

The inventive method using a processor for generating musical tones according to performance information, comprises the steps of arranging an algorithm to designate desired ones of subroutine programs provisionally stored in a memory, assembling a synthesis program according to the algorithm such that the synthesis program contains call instructions for calling the designated subroutines from the memory, successively providing performance information to command generation of musical tones, periodically providing a trigger signal at a relatively slow rate to define one frame period between successive trigger signals, periodically providing a sampling signal at a relatively fast rate such that a plurality of sampling signals occur within one frame period, executing the synthesis program by the processor at one frame period so as to carry out synthesis of a set of waveform samples allotted to one frame period such that the designated subroutine programs are sequentially called in response to the call instructions to process the waveform samples during the synthesis, the set of the waveform samples being reserved in a buffer after the synthesis, and converting each of the waveform samples reserved in the buffer in response to each sampling signal into a corresponding analog signal so as to generate the musical tones together with the desired effect.

As described and according to the first aspect of the present invention, the same algorithm portions are collectively processed in parallel for a plurality of channels in a software sound source using a processing unit having an extended instruction set capable of executing a plurality of operations with a single instruction, thereby realizing faster computation for waveform generation. In addition, as compared with use of extended instructions for realizing parallelism by contrivance in the processing algorithm in each channel, the prevent invention can realize parallelism in a plurality of channels, thereby generating parallel programs for the plurality of channels from the algorithms for one channel and hence enhancing processing speed significantly.

As described and according to the second aspect of the present invention, a unit in which waveform generation processing is performed in a waveform generating buffer of a software sound source is identical to the line size of cache memory or a predetermined integral multiple of the line size, thereby realizing the waveform generation processing that is fast in operation and hard for cache miss to occur. Further, the waveform buffer is provided for each effect processing, so that connection among effects can be altered easily and the cache hit ratio in each effect processing is enhanced. Still further, a plurality of waveform generating buffers provided respectively for the effects have the same constitution, each effect processing is performed in the corresponding buffer, and data in one buffer can be accumulated to another by the add processing, so that, if the user designates any software effector algorithm, the sequence of the effect processing and the add processing may be freely changed to execute the designed algorithm. Consequently, the sequence of the computations for effect attaching processing can be altered dynamically according to user designation. Yet further, since the cache hit ratio in generating the waveform data for a plurality of channels is increased, the processing time for waveform generation is shortened. In addition, since the cache hit ratio at outputting the waveform data for each sounding channel to the plurality of buffers is increased, the processing time for waveform generation is shortened. Moreover, the cache hit ratio at generating the waveform data for a plurality of channels is increased, so that the music tone generating method for shortening the processing time for waveform generation can be provided in a machine readable media.

As described and according to the third aspect of the present invention, the components of the waveform generating programs and the effect programs in each sound source type are made of subroutines that can be shared by these programs, thereby realizing a software sound source based on a plurality of sound source types in less storage capacity. Further, the same waveform processing subroutines can be used by a plurality of sound source types, thereby easily realizing an integrated sound source based on mixed methods. Still further, shared waveform subroutines are used by the waveform generation processing operations based on at least two different sounding algorithms simultaneously executable on two sounding channels, thereby resulting in a saved program storage area. Yet further, when the processing is performed in a CPU having instruction cache, the cache hit ratio can be increased for the shared subroutines. In addition, when performing waveform generation based on the algorithms of a plurality of sounding channels by the CPU having cache, the processing operations for the plurality of sounding channels are collectively performed for each algorithm, thereby enhancing the cache hit ratio and hence increasing the processing speed. Moreover, since waveform processing subroutines are shared between the waveform generation processing performed in a sounding channel and the effect processing for attaching an effect to the generated waveform data, the program storage area can be saved. Furthermore, if the processing is performed by a CPU having instruction cache, the cache hit ratio can be enhanced for the shared subroutines. Besides, the user designates an algorithm and a generator program is made by combining waveform processing subroutines according to the designation, thereby realizing algorithm editing with high degree of freedom. And, since the generated generator program incorporates only a call instruction of the selected waveform processing subroutines, there is no need for performing branch processing in the routines according to the selection.

While the preferred embodiments of the present invention have been described using specific terms, such description is for illustrative purposes only, and it is understood that changes and variations may be made without departing from the spirit or scope of the appended claims.

What is claimed is:

1. A music apparatus comprising:

a processing unit used to carry out parallel computation steps in response to a single instruction which is successively issued when executing a program;

a software module defining a plurality of channels and being composed of a synthesis program executed by the processing unit so as to carry out synthesis of waveforms of musical tones through the plurality of the channels such that the plurality of the channels are grouped into parallel sets each containing at least two channels and such that the synthesis of the waveforms of at least two channels belonging to each parallel set are carried out concurrently by the parallel computation steps;

a buffer memory for accumulatively storing the waveforms of the plurality of the channels; and a converter for converting the waveforms into the musical tones.

2. A music apparatus according to claim 1, wherein the processing unit executes the synthesis program so as to carry out the synthesis of the waveforms, the synthesis including one type of the parallel computation steps where the plurality of the channels are grouped into parallel sets each containing a first number of channels, and another type of the parallel computation steps where the plurality of the channels are grouped into parallel sets each containing a second number of channels, which is different from the first number of channels.

3. A music apparatus according to claim 1, further comprising another software module composed of an effector program executed by the processing unit if the effector program contains parallel computation steps to apply an effect to the waveforms stored in the buffer memory.

4. A method of generating musical tones through a plurality of channels by means of a processing unit used to carry out parallel computation steps in response to a single instruction which is successively issued when executing a program, the method comprising:

executing a synthesis program by the processing unit so as to carry out synthesis of waveforms of musical tones through the plurality of the channels such that the plurality of the channels are grouped into parallel sets each containing at least two channels and such that the synthesis of the waveforms of at least two channels belonging to each parallel set are carried out concurrently by the parallel computation steps;

accumulatively storing the waveforms of the plurality of the channels; and converting the waveforms into the musical tones.

5. A method according to claim 4, wherein the synthesis program is executed by the processing unit so as to carry out the synthesis of the waveforms, the synthesis including one type of the parallel computation steps where the plurality of the channels are grouped into parallel sets each containing a first number of channels, and another type of the parallel computation steps where the plurality of the channels are grouped into parallel sets each containing a second number of channels, which is different than the first number of channels.

6. A method according to claim 4, further comprising the step of executing an effector program by the processing unit if the effector program contains parallel computation steps so as to apply to the waveforms stored in the buffer memory.

7. A machine readable medium containing a synthesis program for causing a computer machine to undergo operation of generating musical tones through a plurality of channels by means of a processing unit used to carry out parallel computation steps in response to a single instruction which is successively issued when executing the synthesis program, wherein the operation comprises: executing the synthesis program by the processing unit so as to carry out synthesis of waveforms of musical tones through the plurality of the channels such that the plurality of the channels are grouped into parallel sets each containing at least two channels and such that the synthesis of the waveforms of at least two channels belonging to each parallel set are carried out concurrently by the parallel computation steps;

accumulatively storing the waveforms of the plurality of the channels; and converting the waveforms into the musical tones.

8. A machine readable medium according to claim 7, wherein the synthesis program is executed by the processing unit so as to carry out the synthesis of the waveforms, the synthesis including one type of the parallel computation steps where the plurality of the channels are grouped into parallel sets each containing a first number of channels, and another type of the parallel computation steps where the plurality of the channels are grouped into parallel sets each containing a second number of channels, which is different than the first number of channels.

9. A machine readable medium according to claim 7, wherein the operation further comprises the step of executing an effector program by the processing unit if the effector program contains parallel computation steps so as to apply an effect to the waveforms stored in the buffer memory.

10. A method of generating musical tones according to performance information through a plurality of channels by parallel computation steps, the method comprising:

successively providing performance information to command generation of musical tones;

periodically counting a frame period;

periodically counting a sampling period such that a plurality of sampling periods occur within one frame period;

carrying out continuous synthesis to produce a sequence of waveform samples of the musical tones for each frame period according to the provided performance information, the continuous synthesis being carried out such that the plurality of the channels are grouped into parallel sets each containing at least two channels so that the continuous synthesis of the waveform samples of at least two channels belonging to each parallel set are carried out concurrently by the parallel computation steps; and converting each of the waveform samples at each sampling period into a corresponding analog signal to thereby generate the musical tones.

11. A machine readable medium containing instructions for causing a computer machine to perform operation of generating musical tones according to performance information through a plurality of channels by parallel computation steps, wherein the operation comprises:

successively providing performance information to command generation of musical tones;

periodically counting a frame period;

periodically counting a sampling period such that a plurality of sampling periods occur within one frame period;

carrying out continuous synthesis to produce a sequence of waveform samples of the musical tones for each frame period according to the provided performance information, the continuous synthesis being carried out such that the plurality of the channels are grouped into parallel sets each containing at least two channels so that the continuous synthesis of the waveform samples of at least two channels belonging to each parallel set are carried out concurrently by the parallel computation steps; and converting each of the waveform samples at each sampling period into a corresponding analog signal to thereby generate the musical tones.

12. A music apparatus for generating musical tones by means of a software, comprising:

a processor that executes the software at each frame period to carry out synthesis of a set of waveform samples allotted to each frame period;

a buffer having a capacity sufficient to store the waveform samples allotted to one frame period, the buffer being used as a working area by the processor for storing a temporary set of the waveform samples which are treated by the processor during the course of the synthesis and for storing a final set of the waveform samples which are obtained upon completion of the synthesis;

a cache having a capacity sufficient to store a subset of the waveform samples which is smaller than the set allotted to one frame period such that the capacity of the buffer is set greater than the capacity of the cache, the cache being hit by the processor before the buffer is addressed by the processor so as to carry out the synthesis of each subset of the waveform samples more efficiently than that the buffer is otherwise addressed by the processor; and a converter that converts the final set of the waveform samples stored in the buffer into the musical tones.

13. A music apparatus using a processor to generate musical tones, comprising:

a synthesis module executed by the processor at each frame period so as to carry out synthesis of a set of waveform samples allotted to one frame period;

a plurality of buffers each having a capacity sufficient to store the set of the waveform samples allotted to the same frame period after the synthesis;

a plurality of effector modules each being linked to a corresponding one of the buffers, each effector module being executed by the processor to carry out modification of the set of the waveform samples reserved in the corresponding buffer to create a different effect;

at least one output buffer for storing a set of waveform samples after modification by the effector modules;

a mixer module executed by the processor to add one set of the waveform samples modified by one effector module to another set of the waveform samples stored in either of the output buffer or in another buffer to be modified by another effector module; and a converter for converting the set of the waveform samples stored in the output buffer into the musical tones.

14. A music apparatus according to claim 13, wherein the mixer module is executed by the processor to carry out computation of adding one set of the waveform samples to another set of the waveform samples by a certain ratio so as to mix different effects.

15. A music apparatus according to claim 13, wherein the mixer module is commonly utilized to carry out the computation between any pair of the buffers.

16. A music apparatus according to claim 13, further comprising a cache having a capacity sufficient to store a subset of the waveform samples which is smaller than the set of the waveform samples allotted to one frame period such that the capacity of each buffer is set greater than the capacity of the cache, the cache being hit by the processor before the buffer is addressed by the processor so as to carry out the synthesis of each subset of the waveform samples more efficiently than that each buffer is otherwise addressed by the processor.

17. A music apparatus according to claim 12, further comprising a controller that provides a total effect algorithm for instructing the processor to execute the effector modules and the mixer module in a predetermined sequence to create a total effect which is a mixture of the different effects.

18. A music apparatus according to claim 17, wherein the controller comprises an editor that edits the total effect algorithm to arrange the sequence by which the processor sequentially executes selected ones of the effector modules and the mixer module in an order corresponding to the edited total effect algorithm.

19. A method of generating musical tones according to performance information, the method comprising:

successively providing performance information to command generation of musical tones;

periodically counting a frame period;

periodically counting a sampling period such that a plurality of sampling periods occur within one frame period;

periodically executing a synthesis module at each frame period so as to carry out synthesis of a set of waveform samples allotted to one frame period;

addressing a plurality of buffers each having a capacity sufficient to store the set of the waveform samples allotted to the same frame period after the synthesis;

executing a plurality of effector modules each being linked to a corresponding one of the buffers to carry out modification of the set of the waveform samples reserved in the corresponding buffers to create different effects;

executing a mixer module to add one set of the waveform samples modified by one effector module to another set of the waveform samples stored in either an output buffer or in another buffer to be modified by another effector module; and converting each of the waveform samples stored in the output buffer at each sampling period into a corresponding analog signal so as to generate the musical tones.

20. A method according to claim 19, wherein the mixer module is executed to carry out computation of adding one set of the waveform samples to another set of the waveform samples in another buffer by a certain ratio so as to mix different effects.

21. A method according to claim 19, wherein the mixer module is commonly utilized to carry out the computation between any pair of the buffers.

22. A method according to claim 19, further comprising the step of addressing a cache having a capacity sufficient to store a subset of the waveform samples which is smaller than the set of the waveform samples allotted to one frame period, the cache being addressed before the buffer is addressed so as to carry out the synthesis of each subset of the waveform samples more efficiently than that each buffer is otherwise addressed.

23. A method according to claim 19, further comprising the step of providing a total effect algorithm for instructing execution of the effector modules and the mixer module in a predetermined sequence to create a total effect which is a mixture of the different effects.

24. A method according to claim 23, further comprising the step of editing the total effect algorithm to arrange the sequence by which selected ones of the effector modules and the mixer module are sequentially executed in an order corresponding to the edited total effect algorithm.

25. A machine readable medium containing instructions for causing a computer machine to perform operation of generating musical tones according to performance information through a plurality of channels, wherein the operation comprises:

successively providing performance information to command generation of musical tones;

periodically counting a frame period;

periodically counting a sampling period such that a plurality of sampling periods occur within one frame period;

carrying out continuous synthesis at each frame period to produce a set of waveform samples of the musical tones through the plurality of channels for one frame period according to the provided performance information, accessing a buffer having a capacity sufficient to store the waveform samples allotted to one frame period, the buffer being used as a working area for storing a temporary set of the waveform samples which are treated during the course of the continuous synthesis and for storing a final set of the waveform samples which are obtained upon completion of the continuous synthesis and which are accumulated throughout the plurality of the channels;

addressing a cache having a capacity sufficient to store a subset of the waveform samples which is smaller than the set of the waveform samples allotted to one frame period, the cache being hit before the buffer is addressed so as to carry out the continuous synthesis of each subset of the waveform samples more efficiently than that the buffer is otherwise addressed; and converting each of the waveform samples reserved in the buffer as the final set at each sampling period into a corresponding analog signal to thereby generate the musical tones.

26. A machine readable medium containing instructions for causing a computer machine to perform operation of generating musical tones according to performance information through a plurality of channels, wherein the operation comprises:

successively providing performance information to command generation of musical tones;

periodically counting a frame period;

periodically counting a sampling period such that a plurality of sampling periods occur within one frame period;

periodically executing a synthesis module at each frame period so as to carry out synthesis of a set of waveform samples allotted to one frame period;

addressing a plurality of buffers each having a capacity sufficient to store the set of the waveform samples allotted to the same frame period after the synthesis;

executing a plurality of effector modules each being linked to a corresponding one of the buffers to carry out modification of the set of the waveform samples reserved in the corresponding buffers to create different effects;

executing a mixer module executed to add one set of the waveform samples modified by one effector module to another set of the waveform samples stored in either of an output buffer or in another buffer to be modified by another effector module; and converting each of the waveform samples stored in the output buffer at each sampling period signal into a corresponding analog signal so as to generate the musical tones.

27. A machine readable medium according to claim 26, wherein the mixer module is executed to carry out computation of adding one set of the waveform samples to another set of the waveform samples by a certain ratio so as to mix different effects.

28. A machine readable medium according to claim 26, wherein the mixer module is commonly utilized to carry out the computation between any pair of the buffers.

29. A machine readable medium according to claim 26, wherein the operation further comprises addressing a cache having a capacity sufficient to store a subset of the waveform samples which is smaller than the set of the waveform samples allotted to one frame period, the cache being addressed before the buffer is addressed so as to carry out the synthesis of each subset of the waveform samples more efficiently than that each buffer is otherwise addressed.

30. A machine readable medium according to claim 26, wherein the operation further comprises the step of providing a total effect algorithm for instructing execution of the effector modules and the mixer module in a predetermined sequence to create a total effect which is a mixture of the different effects.

31. A machine readable medium according to claim 30, wherein the operation further comprises editing the total effect algorithm to arrange the sequence by which selected ones of the effector modules and the mixer module are sequentially executed in an order corresponding to the edited total effect algorithm.

32. A method using a processor for generating musical tones through groups of channels according to performance information, the method comprising the steps of:

loading a first synthesis program prepared for a first group of channels and a second synthesis program prepared for a second group of channels together with a subroutine program utilized commonly for both of the first synthesis program and the second synthesis program;

successively providing performance information to command generation of musical tones;

periodically counting a frame period;

periodically counting a sampling period such that a plurality of sampling periods occur within one frame period;

executing the first synthesis program by the processor at one frame period so as to carry out synthesis of each set of waveform samples allotted to one frame period through each channel of the first group such that the subroutine program runs to process the waveform samples during the synthesis, each set of the waveform samples being reserved in a buffer after the synthesis;

executing the second synthesis program by the processor at one frame period so as to carry out synthesis of each set of waveform samples allotted to one frame period through each channel of the second group such that the subroutine program runs to process the waveform samples during the synthesis, each set of the waveform samples being reserved in a buffer after the synthesis; and converting each of the waveform samples reserved in the buffer at each sampling period into a corresponding analog signal so as to generate the musical tones.

33. A method according to claim 32, further including the step of addressing a cache having a capacity sufficient to store a subset of the waveform samples which is smaller than the set of the waveform samples allotted to one frame period, the cache being hit by the processor before the buffer is addressed by the processor while the processor runs the subroutine program to process each subset of the waveform samples.

34. A method according to claim 32, wherein the step of loading includes selecting at least one of a mixer subroutine program for mixing the waveform samples, a digital filter subroutine for filtering the waveform samples to modify the music tones, and an envelope generator subroutine program for creating an envelope of the waveform samples.

35. A method according to claim 32, wherein the step of loading includes selecting at least one of subroutine programs which are designed for reading out waveform samples from a wave table, for filtering the waveform samples to modify the music tones, for creating an envelope of the waveform samples, for controlling an amplitude of the waveform samples, and for accumulating each set of the waveform samples into the buffer.

36. A method according to claim 35, wherein the step of loading includes loading the selected subroutine program from a secondary memory into a primary memory which is used as a working area of the processor.

37. A method using a processor for generating musical tones through groups of channels according to performance information, the method comprising the steps of:

loading a first synthesis program prepared for a first group of channels and a second synthesis program prepared for a second group of channels, successively providing performance information to command generation of musical tones;

periodically counting a frame period;

periodically counting a sampling period such that a plurality of sampling periods occur within one frame period;

executing the first synthesis program by the processor at one frame period so as to carry out synthesis of each set of waveform samples allotted to each channel of the first group such that each set of the waveform samples belonging to the first group is preceding reserved in a buffer;

executing the second synthesis program by the processor at the same frame period so as to carry out synthesis of each set of waveform samples allotted to each channel of the second group such that each set of the waveform samples belonging to the second group is succeeding reserved in a buffer after each set of the waveform samples belonging to the first group is reserved; and converting each of the waveform samples reserved in the buffer at each sampling period into a corresponding analog signal so as to generate the musical tones.

38. A method according to claim 37, further comprising the step of addressing a cache having a capacity sufficient to store a subset of the waveform samples which is smaller than the set of the waveform samples allotted to one frame period, the cache being addressed to carry out the synthesis of each subset of the waveform samples.

39. A method using a processor for generating musical tones according to performance information, the method comprising the steps of:

loading a synthesis program and an effector program together with a subroutine program utilized commonly for both of the synthesis program and the effector program;

successively providing performance information to command generation of musical tones;

periodically counting a frame period;

periodically counting a sampling period such that a plurality of sampling periods occur within one frame period;

executing the synthesis program by the processor at one frame period so as to carry out synthesis of a set of waveform samples allotted to one frame period such that the subroutine program runs to process the waveform samples during the synthesis, the set of the waveform samples being reserved in a buffer after the synthesis;

executing the effector program by the processor at one frame period so as to carry out modification of the set of the waveform samples reserved in the buffer to create an effect such that the subroutine program runs to process the waveform samples during the modification, each set of the waveform samples being reserved in a buffer after the modification; and converting each of the waveform samples reserved in the buffer at each sampling period into a corresponding analog signal so as to generate the musical tones together with the effect.

40. A method according to claim 39, wherein the step of loading includes selecting at least one of subroutine programs which are designed for filtering the waveform samples to modify the music tones, for delaying the waveform samples to modify the music tones, for controlling an amplitude of the waveform samples, and for accumulating each set of the waveform samples into the buffer.

41. A method according to claim 39, further including the step of addressing a cache having a capacity sufficient to store a subset of the waveform samples which is smaller than the set of the waveform samples allotted to one frame period, the cache being hit by the processor before the buffer is addressed by the processor while the processor runs the subroutine program to process each subset of the waveform samples.

42. A method according to claim 39, wherein the step of loading includes selecting at least one of a mixer subroutine program for mixing the waveform samples and a digital filter subroutine program for filtering the waveform samples to modify the music tones.

43. A method using a processor for generating musical tones according to performance information, the method comprising the steps of:

arranging an algorithm such that subroutine programs provisionally stored in a memory, are selectively designated by the arranged algorithm;

assembling a synthesis program according to the algorithm such that the synthesis program contains call instructions for calling the designated subroutines from the memory;

successively providing performance information to command generation of musical tones;

periodically counting a frame period;

periodically counting a sampling period such that a plurality of sampling periods occur within one frame period;

executing the synthesis program by the processor at one frame period so as to carry out synthesis of a set of waveform samples allotted to one frame period such that the designated subroutine programs are sequentially called in response to the call instructions to process the waveform samples during the synthesis, the set of the waveform samples being reserved in a buffer after the synthesis; and converting each of the waveform samples reserved in the buffer at each sampling period into a corresponding analog signal so as to generate the musical tones, wherein different synthesis programs assembled according to different algorithms contain at least one call instruction for calling the same subroutine.

44. A method according to claim 43, wherein the step of arranging comprises designating at least one of subroutine programs which are designed for reading out waveform samples from a wave table, for filtering the waveform samples to modify the music tones, for creating an envelope of the waveform samples, for controlling an amplitude of the waveform samples, and for accumulating each set of the waveform samples into the buffer.

45. A method according to claim 43, wherein the step of assembling includes loading the designated subroutine programs from a secondary memory into a primary memory which is used as a working area of the processor.

46. A machine readable medium containing instructions for causing a computer machine having a processor to perform operation of generating musical tones according to performance information through groups of channels, wherein the operation comprises:

loading a first synthesis program prepared for a first group of channels and a second synthesis program prepared for a second group of channels together with a subroutine program utilized commonly for both of the first synthesis program and the second synthesis program;

successively providing performance information to command generation of musical tones;

periodically counting a frame period;

periodically counting a sampling period such that a plurality of sampling periods occur within one frame period;

executing the first synthesis program by the processor at one frame period so as to carry out synthesis of each set of waveform samples allotted to one frame period through each channel of the first group such that the subroutine program runs to process the waveform samples during the synthesis, each set of the waveform samples being reserved in a buffer after the synthesis;

executing the second synthesis program by the processor at one frame period so as to carry out synthesis of each set of waveform samples allotted to one frame period through each channel of the second group such that the subroutine program runs to process the waveform samples during the synthesis, each set of the waveform samples being reserved in a buffer after the synthesis; and converting each of the waveform samples reserved in the buffer at each sampling period into a corresponding analog signal so as to generate the musical tones.

47. A machine readable medium according to claim 46, wherein the step of loading includes selecting at least one of a mixer subroutine program for mixing the waveform samples, a digital filter subroutine program for filtering the waveform samples to modify the music tones, and an envelope generator subroutine program for creating an envelope of the waveform samples.

48. A machine readable medium containing instructions for causing a computer machine having a processor to perform operation of generating musical tones according to performance information, wherein the operation comprises:

loading a first synthesis program prepared for a first group of channels and a second synthesis program prepared for a second group of channels;

successively providing performance information to command generation of musical tones;

periodically counting a frame;

periodically counting a sampling period such that a plurality of sampling periods occur within one frame period;

executing the first synthesis program by the processor at one frame period so as to carry out synthesis of each set of waveform samples allotted to each channel of the first group such that each set of the waveform samples belonging to the first group is preceding reserved in a buffer;

executing the second synthesis program by the processor at the same frame period so as to carry out synthesis of each set of waveform samples allotted to each channel of the second group such that each set of the waveform samples belonging to the second group is succeeding reserved in a buffer after each set of the waveform samples belonging to the first group is reserved; and converting each of the waveform samples reserved in the buffer at each sampling period into a corresponding analog signal so as to generate the musical tones.

49. A machine readable medium according to claim 48, wherein the operation further comprises the step of addressing a cache having a capacity sufficient to store a subset of the waveform samples which is smaller than the set of the waveform samples allotted to one frame period, the cache being addressed to carry out the synthesis of each subset of the waveform samples.

50. A machine readable medium containing instructions for causing a computer machine having a processor to perform operation of generating musical tones according to performance information, wherein the operation comprises:

loading a synthesis program and an effector program together with a subroutine program utilized commonly for both of the synthesis program and the effector program;

successively providing performance information to command generation of musical tones;

periodically counting a frame period;

periodically counting a sampling period such that a plurality of sampling periods occur within one frame period;

executing the synthesis program by the processor at one frame period so as to carry out synthesis of a set of waveform samples allotted to one frame period such that the subroutine program runs to process the waveform samples during the synthesis, the set of the waveform samples being reserved in a buffer after the synthesis;

executing the effector program by the processor at one frame period so as to carry out modification of the set of the waveform samples reserved in the buffer to create an effect such that the subroutine program runs to process the waveform samples during the modification, each set of the waveform samples being reserved in a buffer after the modification; and converting each of the waveform samples reserved in the buffer at each sampling period into a corresponding analog signal so as to generate the musical tones together with the effect.

51. A machine readable medium according to claim 50, wherein the step of loading includes selecting at least one of a mixer subroutine program for mixing the waveform samples and a digital filter subroutine program for filtering the waveform samples to modify the music tones.

52. A machine readable medium containing instructions for causing a computer machine having a processor to perform operation of generating musical tones according to performance information, wherein the operation comprises:

arranging an algorithm such that subroutine programs provisionally stored in a memory are selectively designated according to the arranged algorithm;

assembling a synthesis program according to the algorithm such that the synthesis program contains call instructions for calling the designated subroutines from the memory;

successively providing performance information to command generation of musical tones;

periodically counting a frame period;

periodically counting a sampling period such that a plurality of sampling periods occur within one frame period;

executing the synthesis program by the processor at one frame period so as to carry out synthesis of a set of waveform samples allotted to one frame period such that the designated subroutine programs are sequentially called in response to the call instructions to process the waveform samples during the synthesis, the set of the waveform samples being reserved in a buffer after the synthesis; and converting each of the waveform samples reserved in the buffer at each sampling period into a corresponding analog signal so as to generate the musical tones, wherein different synthesis programs assembled according to different algorithms contain at least one call instruction for calling the same subroutine.

53. A method of generating musical tones according to performance information through a plurality of channels, the method comprising:

successively providing performance information to command generation of musical tones;

periodically counting a frame period;

periodically counting a sampling period such that a plurality of sampling periods occur within one frame period;

carrying out continuous synthesis at each frame period to produce a set of waveform samples of the musical tones through the plurality of channels for one frame period according to the provided performance information, accessing a buffer having a capacity sufficient to store the waveform samples allotted to one frame period, the buffer being used as a working area by the processor for storing a temporary set of the waveform samples which are treated by the processor during the course of the continuous synthesis and for storing a final set of the waveform samples which are obtained upon completion of the continuous synthesis and which are accumulated throughout the plurality of the channels;

addressing a cache having a capacity sufficient to store a subset of the waveform samples which is smaller than the set of the waveform samples allotted to one frame period, the cache being hit by the processor before the buffer is addressed by the processor so as to carry out the continuous synthesis of each subset of the waveform samples more efficiently than that the buffer is otherwise addressed by the processor; and converting each of the waveform samples reserved in the buffer as the final set at each sampling period into a corresponding analog signal to thereby generate the musical tones.

* * * * *